US012233314B2

(12) United States Patent
Fox et al.

(10) Patent No.: US 12,233,314 B2
(45) Date of Patent: Feb. 25, 2025

(54) GOLF BALL

(71) Applicant: Taylor Made Golf Company, Inc., Carlsbad, CA (US)

(72) Inventors: Michael Fox, Carlsbad, CA (US); Erin Peavy, Carlsbad, CA (US); Tim Durham, Carlsbad, CA (US); Eric M. Loper, Carlsbad, CA (US); Dennis Kennedy, Carlsbad, CA (US); Rick Fowler, Jupiter, FL (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 18/080,239

(22) Filed: Dec. 13, 2022

(65) Prior Publication Data

US 2023/0158369 A1 May 25, 2023

Related U.S. Application Data

(63) Continuation of application No. 16/795,126, filed on Feb. 19, 2020, now Pat. No. 11,577,127, which is a continuation of application No. 16/565,283, filed on Sep. 9, 2019, now Pat. No. 11,013,961.

(60) Provisional application No. 62/882,237, filed on Aug. 2, 2019.

(51) Int. Cl.

| | |
|---|---|
| ***A63B 37/06*** | (2006.01) |
| ***A63B 37/00*** | (2006.01) |
| *A63B 45/02* | (2006.01) |

(52) U.S. Cl.

CPC ..... *A63B 37/0022* (2013.01); *A63B 37/0074* (2013.01); *A63B 37/0075* (2013.01); *A63B 37/0076* (2013.01); *A63B 45/02* (2013.01)

(58) Field of Classification Search

CPC ..... A63B 43/008; A63B 37/0022

See application file for complete search history.

(56) References Cited

U.S. PATENT DOCUMENTS

| | | | | |
|---|---|---|---|---|
| 5,778,793 | A * | 7/1998 | Mello | A63B 37/0003 101/32 |
| 8,617,004 | B2 | 12/2013 | Morgan et al. | |
| 8,727,913 | B2 | 5/2014 | Morgan | |
| 8,758,168 | B2 | 6/2014 | Morgan et al. | |
| 8,915,802 | B2 | 12/2014 | Morgan | |
| 8,915,803 | B2 | 12/2014 | Hogge et al. | |
| 8,915,804 | B2 | 12/2014 | Hogge et al. | |
| 8,979,678 | B2 | 3/2015 | Hogge et al. | |
| 9,056,223 | B2 | 6/2015 | Hogge et al. | |
| 9,056,224 | B2 | 6/2015 | Hogge et al. | |
| 9,199,127 | B2 | 12/2015 | Zieske et al. | |

(Continued)

OTHER PUBLICATIONS

John F. Hotchkiss, 500 Years of Golf Ball History and Collector's Guide, 1997, pp. 191-192. (Year: 1997).*

*Primary Examiner* — Raeann Gorden

(74) *Attorney, Agent, or Firm* — Klarquist Sparkman, LLP

(57) ABSTRACT

A golf ball including an outer surface having dimples located on the outer surface, at least one core, at least one mantle layer, at least one cover layer, and a plurality of images located on the outer surface, the images being provided with at least two contrasting colors, wherein the plurality of images each have a Major Peak Ratio of between 0.18 and 1, a Major Valley Ratio of between 0.18 and 1, a slope value of between −5 and 5, and an intercept value between 5 and 80.

11 Claims, 18 Drawing Sheets

(56) References Cited

U.S. PATENT DOCUMENTS

| | | | | |
|---|---|---|---|---|
| 9,199,134 | B2 | 12/2015 | Zieske et al. | |
| 9,238,160 | B2 | 1/2016 | Zieske et al. | |
| 9,283,443 | B1 * | 3/2016 | Hanna | A63B 45/02 |
| 9,480,880 | B2 | 11/2016 | Morgan et al. | |
| 10,022,954 | B1 * | 7/2018 | Melanson | B41F 17/30 |
| D860,344 | S * | 9/2019 | Brewer, III | D21/708 |
| D860,348 | S * | 9/2019 | Bartels | D21/708 |
| 10,532,251 | B1 * | 1/2020 | Madson | A63B 1/00 |
| 10,611,181 | B1 * | 4/2020 | Moylan | B41F 17/30 |
| D944,347 | S * | 2/2022 | Hocknell | D21/708 |
| 2002/0032076 | A1 * | 3/2002 | Isogawa | A63B 45/02 473/351 |
| 2008/0039563 | A1 * | 2/2008 | Manami | A63B 37/0023 524/332 |
| 2012/0258815 | A1 * | 10/2012 | Barrett | A63B 69/3685 473/378 |
| 2013/0316849 | A1 | 11/2013 | Zieske et al. | |
| 2013/0323427 | A1 | 12/2013 | Zieske et al. | |
| 2014/0018193 | A1 | 1/2014 | Morgan et al. | |
| 2014/0073462 | A1 | 3/2014 | Morgan et al. | |
| 2014/0106905 | A1 | 4/2014 | Morgan et al. | |
| 2014/0178586 | A1 | 6/2014 | Strozyk | |
| 2020/0108297 | A1 * | 4/2020 | Madson | A63B 37/0018 |
| 2021/0038949 | A1 * | 2/2021 | Barrett | A63B 43/008 |

* cited by examiner

GOLF BALL

This application is a continuation of U.S. application Ser. No. 16/795,126, filed Feb. 19, 2020, which is a continuation of U.S. application Ser. No. 16/565,283, filed Sep. 9, 2019, issued as U.S. Pat. No. 11,013,961 on May 25, 2021, which claims the benefit of U.S. Provisional Application No. 62/882,237, filed Aug. 2, 2019, which is incorporated herein by reference in its entirety.

BACKGROUND

The playability of a golf ball may be adversely impacted by the visibility conditions. In addition, it is useful for players to know whether or not a putted ball has a true roll.

SUMMARY

The use of an image placed in multiple locations on the golf ball provide feedback to the golfer on how the club was presented to the ball. For example, on wedge shots around the green feedback on how much spin is generated assists the golfer in improving their game. Using multiple contrasting colors within the image improves visibility of the element in varying light conditions.

Disclosed herein is a golf ball comprising an outer surface having dimples located on the outer surface, at least one core, at least one cover layer, and a plurality of images located on the outer surface, the images being provided with at least two contrasting colors; wherein the plurality of images each have a Major Peak Ratio of between 0.18 and 1, a Major Valley Ratio of between 0.18 and 1, a slope value of between −5 and 5, and an intercept value between 5 and 80.

Also disclosed herein is a golf ball comprising an outer surface having dimples located on the outer surface, at least one core, at least one cover layer, a base color located on the outer surface, and a plurality of images located on the outer surface, the plurality of images being provided with a first contrasting color and a second contrasting color, the first contrasting color and the second contrasting color have an absolute value difference between CIELab L values of between 5 to 70, an absolute value difference between CIELab "a" values of between 3 and 50, and an absolute value difference between CIELab "b" values of between 5 and 90;

wherein the first contrasting color having an absolute value difference in CIELab L value ($|\Delta L|$), relative to the base color of the ball, of between 30 and 90 is provided.

Additionally disclosed herein is a golf ball comprising an outer surface having dimples located on the outer surface, at least one core, at least one cover layer, a base color located on the outer surface, and a plurality of images located on the outer surface, the plurality of images being provided with a first contrasting color and a second contrasting color, the first contrasting color and the second contrasting color have a $\Delta E^*ab$ value relative to the base color of the ball that is between 40 and 100.

The foregoing will become more apparent from the following detailed description, which proceeds with reference to the accompanying figures.

DETAILED DESCRIPTION

Figure 1:
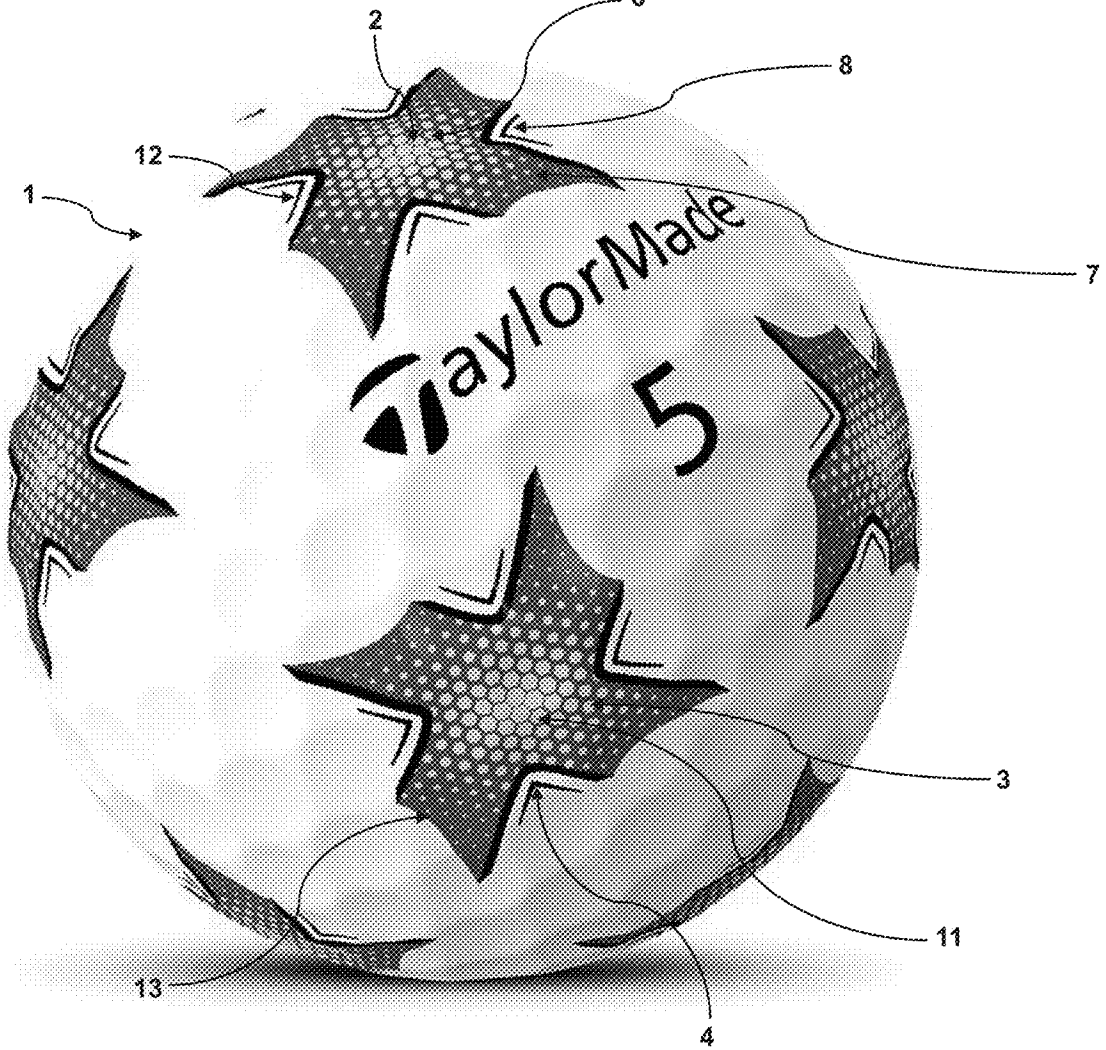
FIG. 1 depicts a golf ball having a first embodiment of an image.
Figure 2:
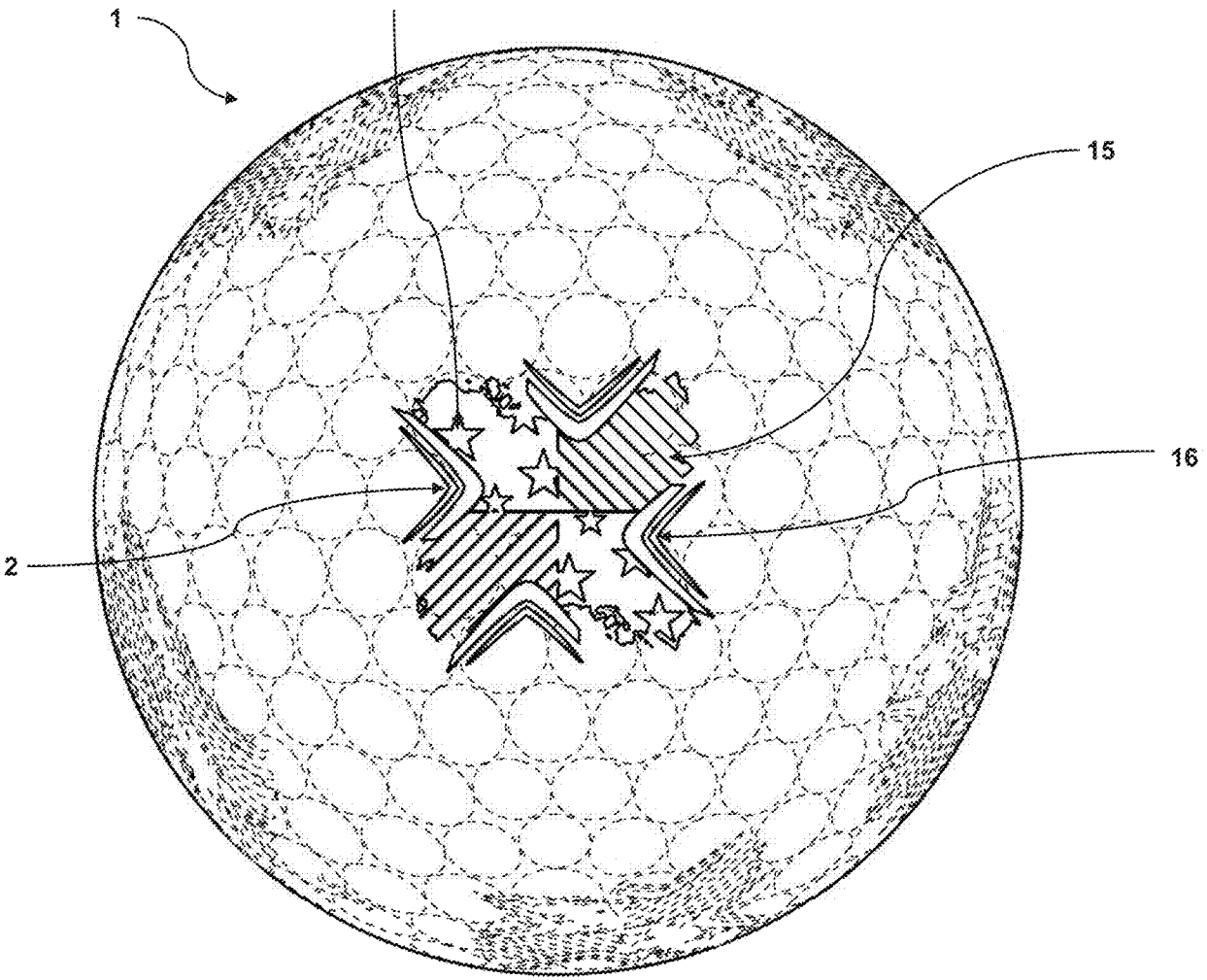
FIG. 2 depicts a second embodiment of an image for placement on the surface of a golf ball.
Figure 3:
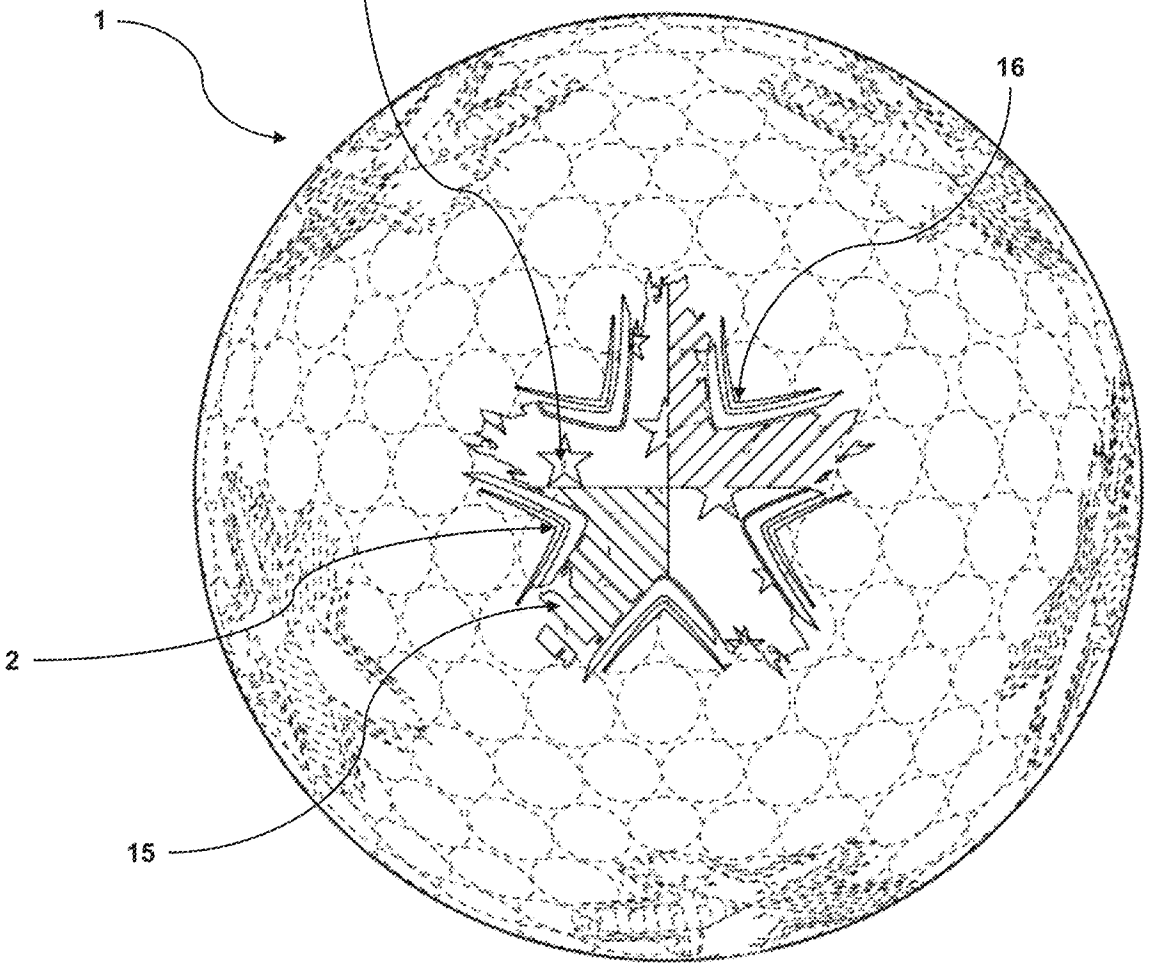
FIG. 3 depicts a third embodiment of an image for placement on the surface of a golf ball.

Disclosed herein are useful approaches for enhancing the playability of a golf ball.

As used herein, "image" refers to a physically discrete design that has a border and includes at least two individual design elements. One of the individual design elements may be a border design element. An "image" as used herein is not a pole stamp, pole marking, seam stamp or seam marking.

In certain embodiments, an image includes at least two different colors. In certain embodiments, an image includes at least three different colors. In certain embodiments, an image includes at least four different colors. In certain embodiments, an image includes at least five different colors. In yet another embodiment, an image can include between two to one-hundred different color shades, between three to twenty different colors, between four to ten different colors, between two to ten different colors, between three to ten different colors, or between four to nine different colors.

The image border may, or may not, be a continuous line. In certain embodiments, all of the border region is the same color, particularly black. In certain embodiments, the border region includes at least two different colors.

In certain embodiments, there are at least 2, 3, 4, 5, 6, 7, 9, 10, 11, 12, 13, 14 or 15 individual images on the surface of a single ball. Every image on the ball may be the same or there may be different images on an individual ball.

In certain embodiments, there are at least three images on the ball, and each image includes at least three different contrasting colors. In certain embodiments, there are at least six images on the ball, and each image includes at least three different contrasting colors. In certain embodiments, there are at least twelve images on the ball, and each image includes at least three different contrasting colors.

The term "contrast" or "contrasting" as used herein refers to two colors that are visually distinct from one another. The visibly distinct colors can be part of the visible light spectrum or can be white or black or any other color. In some embodiments, a color residing in a different wavelength can be considered "contrasting". For example, the first, second, third, and fourth colors (or however many colors are used to make the image) are each within a color wavelength category. For example, one contrasting color may be in the violet category having a wavelength of 380 to 450 nm, a frequency of 680 to 790 THz, and a photon energy of 2.95 to 3.10 eV. In another example, one of the contrasting colors may be in the blue category having a wavelength of 450 to 485 nm, a frequency of 620 to 680 THz, and a photon energy of 2.64 to 2.75 eV. In another example, one of the contrasting colors may be in the cyan category having a wavelength of 485 to 500 nm, a frequency of 600 to 620 THz, and a photon energy of 2.48 to 2.52 eV. In another example, one of the contrasting colors may be in the green category having a wavelength of 500 to 565 nm, a frequency of 530 to 600 THz, and a photon energy of 2.25 to 2.34 eV. In another example, one of the contrasting colors may be in the yellow category having a wavelength of 565 to 590 nm, a frequency of 510 to 530 THz, and a photon energy of 2.10 to 2.17 eV. In another example, one of the contrasting colors may be in the orange category having a wavelength of 590 to 625 nm, a frequency of 480 to 510 THz, and a photon energy of 2.00 to 2.10 eV. In another example, one of the contrasting colors may be in the red category having a wavelength of 625 to 740 nm, a frequency of 405 to 480 THz, and a photon energy of 1.65 to 2.00 eV.

In certain embodiments, at least one of the colors is orange. In certain embodiments, at least one of the colors is black. In certain embodiments, at least one of the colors is gray. In certain embodiments, at least one of the colors is yellow. In certain embodiments, at least one of the colors is red.

In certain embodiments, each image includes at least two individual design elements. In a single image, the individual design elements may be the same shape or different shapes. In certain embodiments, each image includes at least 2, 3, 4, 5, 6, 7, 8, 9 or 10 individual design elements. In certain embodiments, each image includes up to 3, 4, 5, 6, 7, 8, 9 or 10 individual design elements. There may, or may not, be white space between individual design elements. In certain embodiments of an image, there is at least one negative shape that is white and at least one positive shape that is not white. In certain embodiments, an image may be at least partially tessellated.

Each individual design element included in the image may be any shape. The shape may a geometric shape that conforms to the principles of Euclidean geometry. The shape may be irregular and/or asymmetrical (such as, for example, an organic shape reminiscent of a shape found in nature (also known as a biomorphic shape)). Illustrative shapes include, but are not limited to, a rectilinear shape such as a triangle, a quadrilateral, a pentagon, a hexagon, a heptagon, an octagon, a nonagon, a decagon, or a star polygon; a curvilinear shape such as a circle, an astroid, a deltoid, an ellipse, or an oval; and a shape that includes at least one straight boundary line and at least one curved boundary line. In certain embodiments, an image that includes at least one non-linear shape is particularly useful for avoiding a golfer's inaccurate perception of the ball position when taking a shot.

The shape boundary may be a line, or it may be implied by a change in color. For example, a change in color value, hue and/or chroma can create a shape boundary.

An image may have a border that defines a shape. Illustrative shapes for an image include those listed above for the individual design elements. In certain embodiments, the image shape or the individual design element of a shape may be substantially a triangle, particularly a truncated triangle, a cross, a five-point star, a parallelogram, a circle, a trapezoid, a trapezium, an irregular quadrilateral, a kite, a rhombus, or any of the listed shapes herein with minor shape variations with the addition or removal of a segment of the shape.

In certain embodiments, an image includes at least three different colors having respective colors that facilitate visibility of the ball. For example, a first color may enhance ball visibility in low visibility playing light, a second color may enhance ball visibility in medium visibility playing light, a third color may enhance ball visibility in high visibility playing light. Illustrative embodiments of several images are shown in FIGS. 1-7A.

FIG. 1 shows a golf ball 1 that includes on its outer visible surface a plurality of images 2. FIGS. 2-7A show other image embodiments.

Each image 2 include a plurality of individual design elements 3. A plurality of individual design elements may have the same shape and/or each individual design element may have a different shape. Each individual design element 3 is defined by shape boundary 9.

In the embodiment shown in FIG. 1 there are hexagon-shaped design elements 11 and L-shaped design elements 12. In the embodiments shown in FIGS. 2, 3 and 6 there are star-shaped design elements 14, quadrilateral-shaped elements 15, and L-shaped elements 16. In the embodiment shown in FIG. 4 there is a single cross-shaped element 17 having x- and y-axis that are end-bounded by a curved line 13 and L-shaped elements 18. In the embodiment shown in FIG. 5 there is a single truncated star-shaped design element 19 and L-shaped elements 20. In the embodiment shown in FIG. 7A there are triangle-shaped elements 25, quadrilateral-shaped elements 26, and circle-shaped elements 27.

Figure 7A:
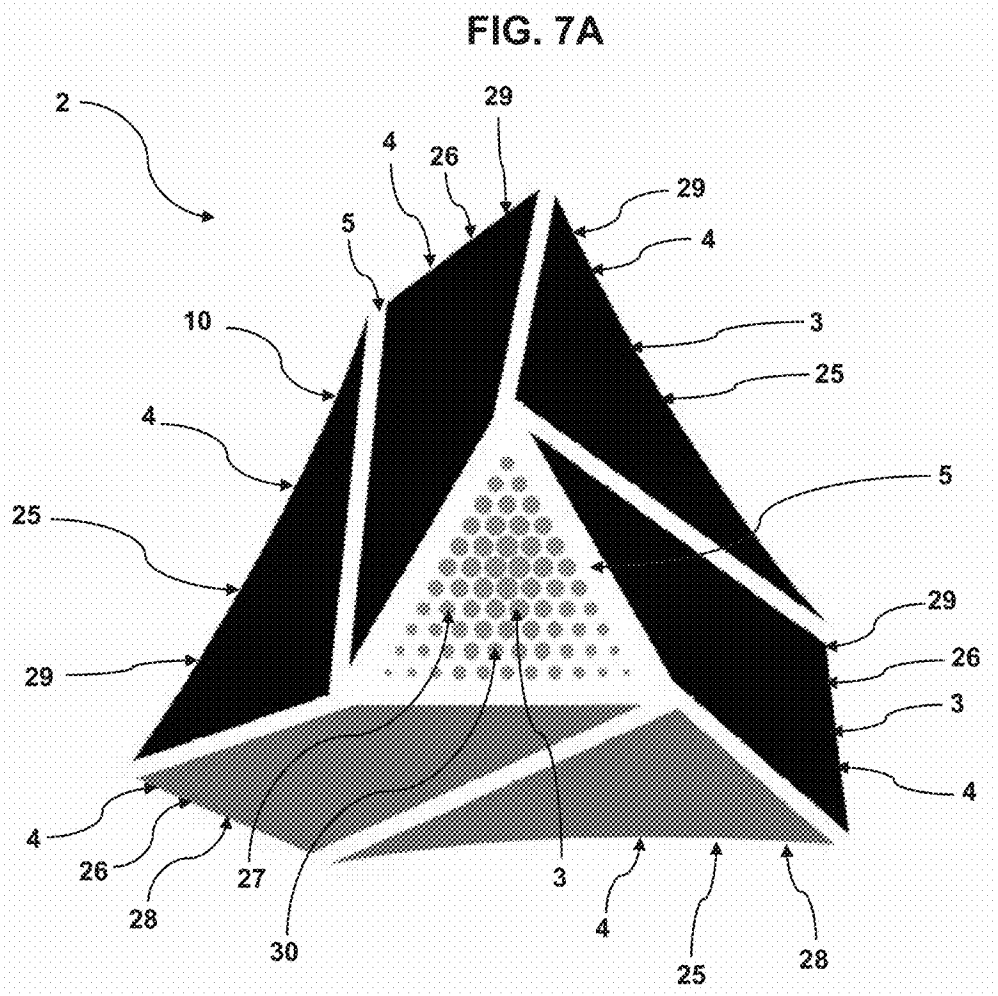
FIG. 7A depicts a seventh embodiment of an image for placement on the surface of a golf ball.

The image 2 includes at least one border design element 4. A spatial arrangement of the border element(s) defines an image shape boundary 10. For example, in the FIG. 7A image there are border design elements 4 (triangle-shaped elements 25 and quadrilateral-shaped elements 26). The overall impression of the design image shown in FIG. 7A, is of a generally triangular shape.

Figure 4:
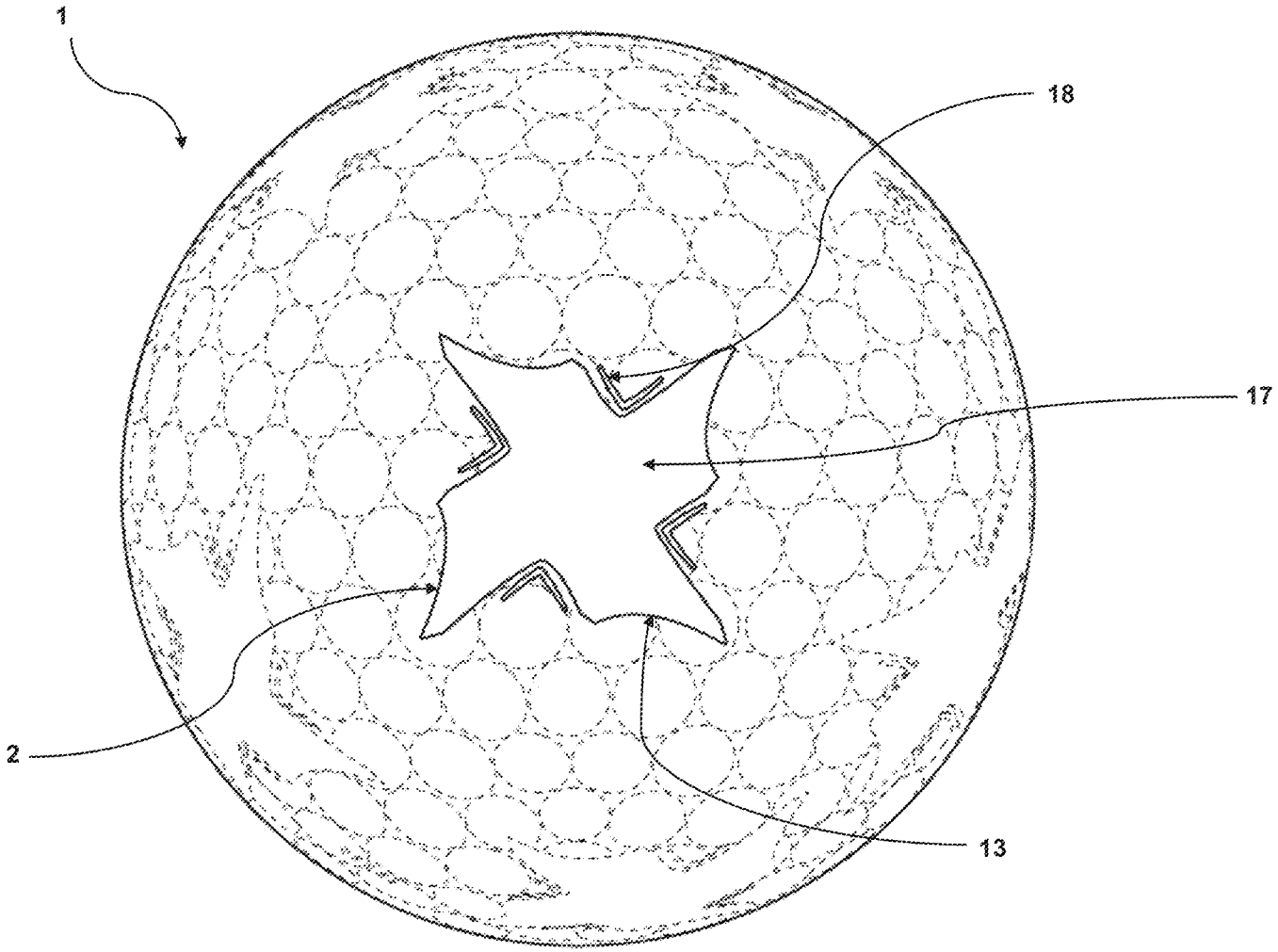
FIG. 4 depicts a fourth embodiment of an image for placement on the surface of a golf ball.
Figure 5:
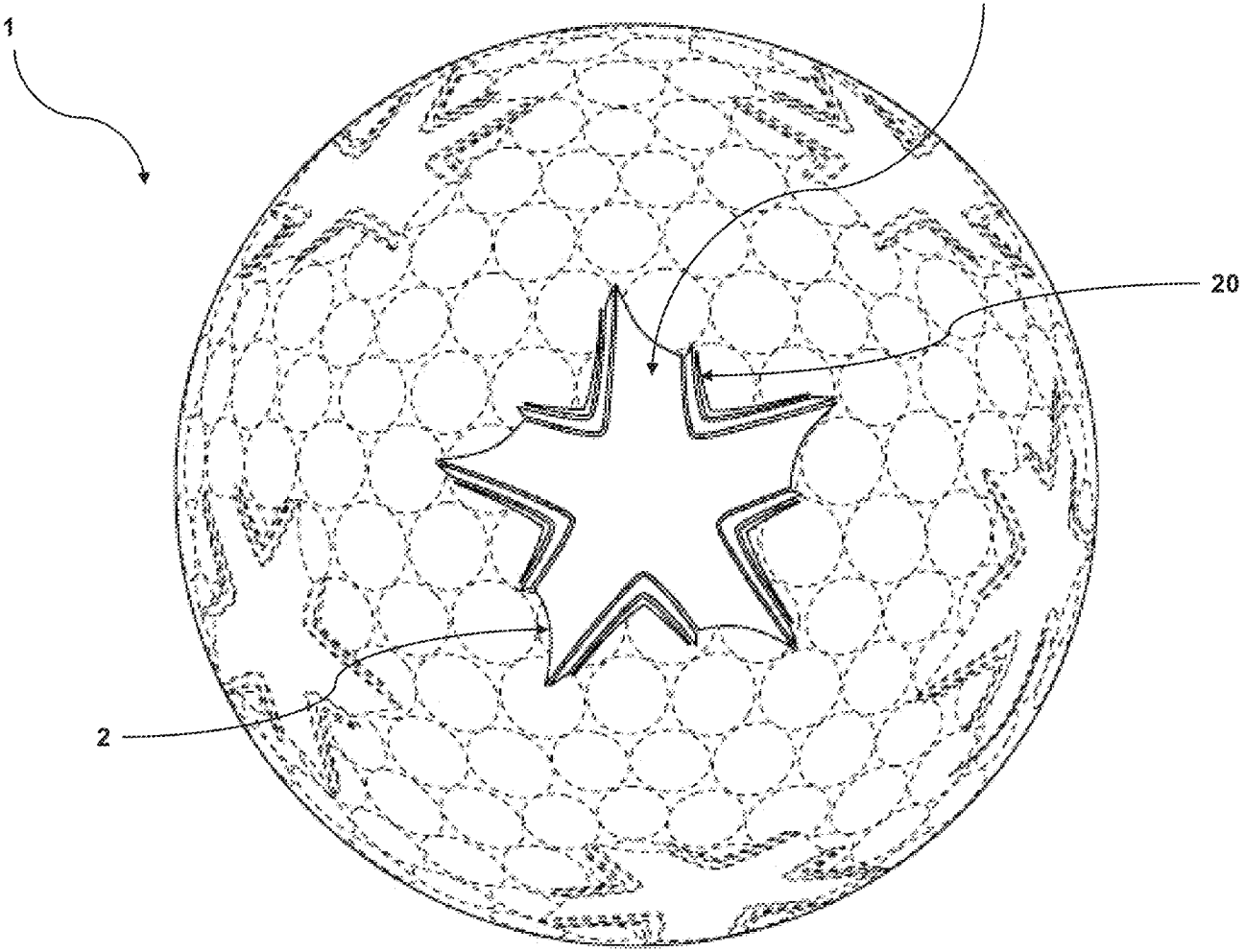
FIG. 5 depicts a fifth embodiment of an image for placement on the surface of a golf ball.
Figure 6:
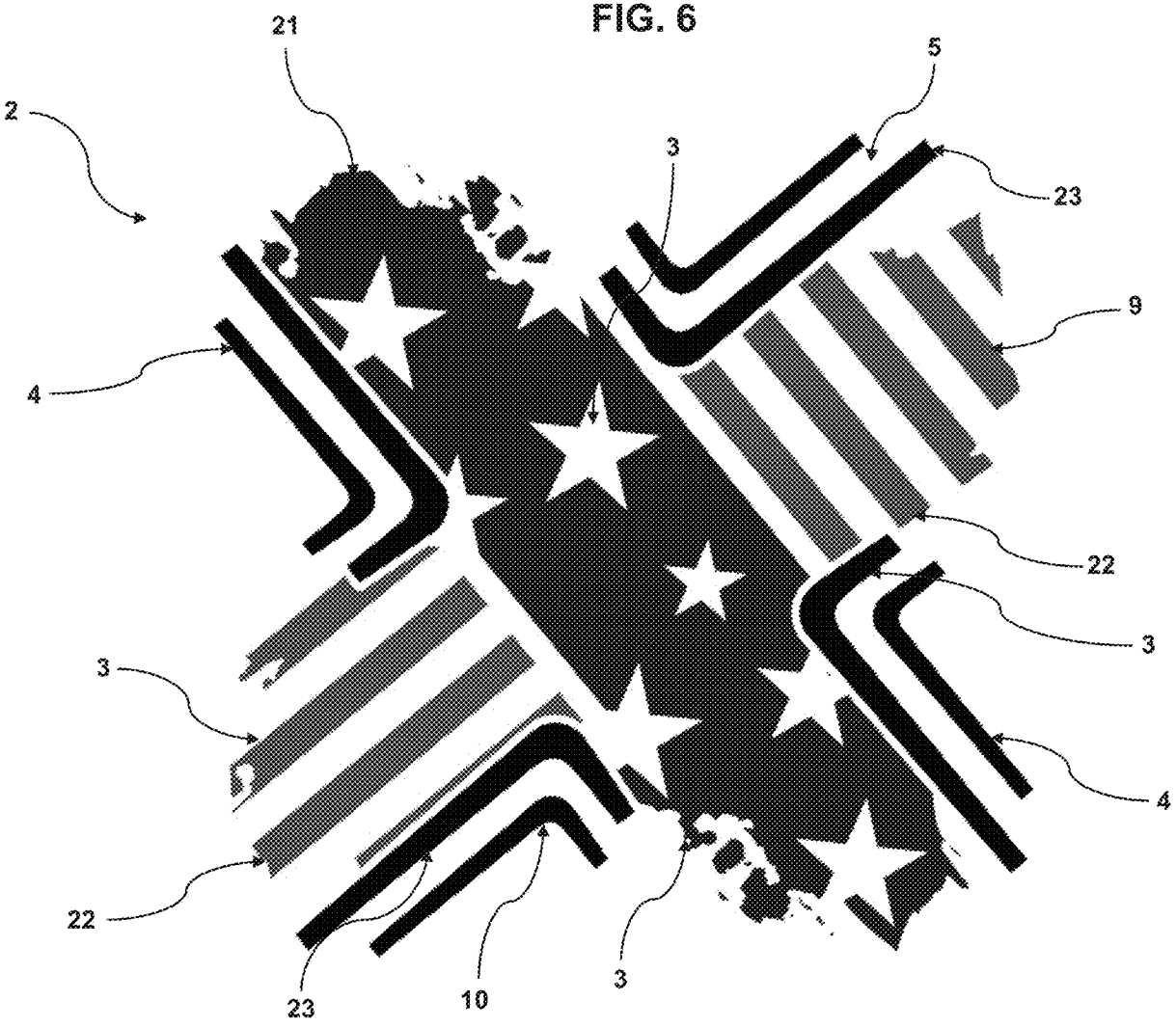
FIG. 6 depicts a sixth embodiment of an image for placement on the surface of a golf ball.

In the embodiments shown in FIGS. 1, 4 and 6 the image 2 has a boundary 10 in the shape of a cross having x- and y-axis that are end-bounded by a curved line 13. In the embodiment shown in FIG. 2 the image 2 has a boundary 10 in the shape of a cross. In the embodiment shown in FIGS. 2 and 5 the image 2 has a boundary 10 in the shape of a truncated star. In the embodiment shown in FIG. 7A the image 2 has a boundary 10 in the shape of a truncated triangle.

As described above, an image may include at least two, three, four, five, or up to one-hundred different colors. For example, in the embodiment shown in FIG. 1 there is a first design element 6 having a first color, a second design element 7 having a second color, and a third design element having a third color, wherein the first color, the second color, and the third color are each different from each other and are not white. For example, the first design element 6 may be red, the second design element 7 may be orange, and the third design element 8 may be black.

In the embodiment shown in FIG. 6 there is a first design element 21 having a first color (e.g., blue), a second design element 22 having a second color (e.g., red), and a third design element 23 having a third color (e.g., black). The embodiment in FIG. 6 also includes a fourth design element 24 (star-shaped) that is white.

In the embodiment shown in FIG. 7A there is at least one first design element 28 having a first color (e.g., orange), a second design element 29 having a second color (e.g., black), and a third design element 30 having a third color (e.g., gray).

In certain embodiments, an image includes at least a first border design element having a first color and a second border design element having a second color, wherein the first color and the second color are different from each other. The respective border elements are arranged such that when the golf ball is struck by a putter the first color produces an appearance of a continuous line as the ball is rolling if the ball has been struck straight resulting in a true roll. If the ball has not been struck straight by the putter, then a continuous line will not result as the ball is rolling. For example, in the embodiment shown in FIG. 7A at least one border design element (e.g., triangle-shaped elements 25 and/or quadrilateral-shaped elements 26) is a first color that is not black (e.g., orange) and at least one border design element (e.g., triangle-shaped elements 25 and/or quadrilateral-shaped elements 26) is black.

Figure 7B:
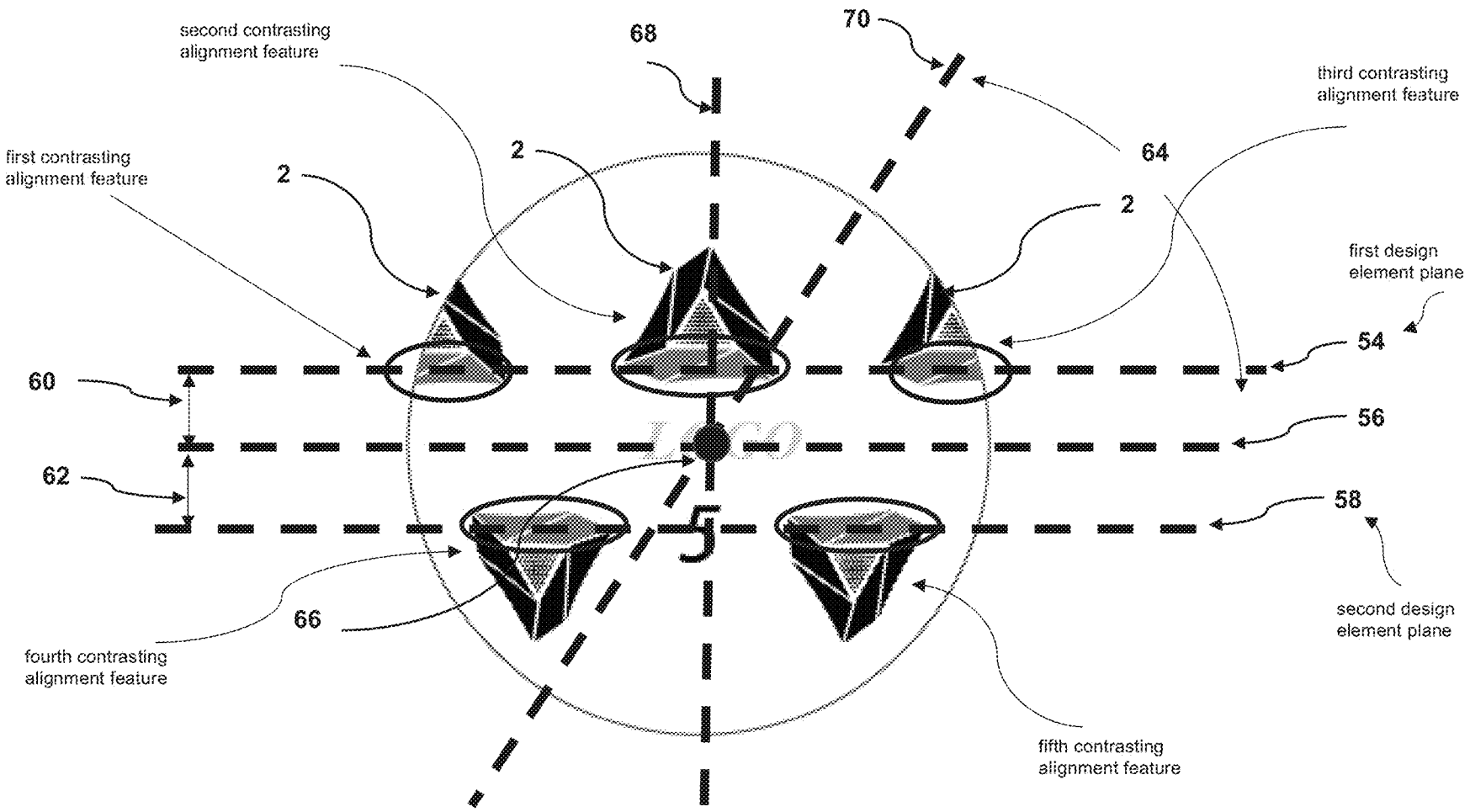
FIG. 7B depicts an exemplary layout of multiple images from FIG. 7A on a golf ball.
Figure 7C:
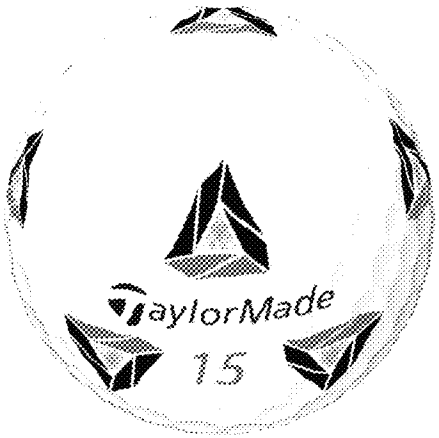
FIG. 7C depicts an exemplary three-dimensional view of the seventh embodiment.

As shown in FIG. 7B, the border design element, composed of one or more elements, colored with a high visibility color is aligned relative to other similarly colored design elements located in other triangle-shaped elements so that the high visibility segments are substantially aligned within a single design element plane 54,58. In other words, the colored high visibility design elements are intersected by a single design element plane 54,58 so that when the ball rolls in a direction parallel to the single plane, a stripe of high visibility color (any color) is visible to the golfer. The single design element plane 84,58 can be parallel to an imaginary center equator plane 56 that intersects a center 66 of the ball. Generally, the equator plane is located in the vicinity where two halves of a mold come together during the manufacturing of the golf ball. For non-linear mold half seams, the equator would be a best fit circumference line relative to the non-linear mold engagement. In instances where the golf ball is injection molded and does not comprise two mold halves, the equator can be a circumferential circular line that passes through a logo of the ball. In some embodiments, the colored design elements can be arranged to intersect a single design element plane or even two, three, four, five, six, seven, eight, nine, or ten different planes that are either parallel, angled, or even perpendicular to one another. In FIG. 7B, two design element planes 54,58 that each intersect at least two high visibility design colored design elements located within an image 2 are shown. FIG. 7B illustrates three high visibility design elements of three different triangle-shaped elements 2 that are aligned with one another so that they intersect a single upper design element plane 54 that is located just above the ball logo. In some instances, the single design element plane is parallel with the equator plane 56 of the ball or may intersect with the equator of the ball while also intersecting with colored design elements. FIG. 7B further shows another lower design element plane 58 that intersects at least two-colored design elements within two triangle shaped elements 2. In one embodiment, the upper design element plane 54 and the lower design element plane 58 are each located on two different halves of the ball and are parallel to one another (also parallel to the equator) so that when the ball rolls, an illusion of two colored circumferential stripes is created with one illusory stripe being located in an upper location with respect to the ball logo and another illusory colored stripe being located in a lower location below the ball logo.

FIG. 7B shows the upper design element plane 54 being spaced and parallel from the equator plane 56 by a first distance 60. In addition, the lower design element plane 58 is spaced and parallel from the equator plane 56 by a second distance 62. In one embodiment, the first distance 60 and the second distance 62 are substantially equal. In another embodiment, the first distance 60 is greater than the second distance 62. In yet another embodiment, the second distance 62 is greater than the first distance 60. In another embodiment, a plurality of design elements planes are provided that intersect high visibility design elements on the surface of the ball. The plurality of design element planes can be equidistance from each other, symmetrical about the equator plane 56, or unequal in distance from each other.

In FIG. 7B, it is also possible to have high visibility design elements aligned along a circumference, or offset circumference, of the ball so that a vertical design element plane 68 or an angled design element plane 40 (relative to an equator 56 plane) passes through the high visibility elements. The vertical design element plane 68 and the angled design element plane maybe pass through the center of the ball 66 or may be offset by a first or second distance from a plane that intersects the center of the ball. In some embodiments, the angled plane 40 can be angled relative to the equator plane by an angle 64 that can vary between 0° and 90°, between 10° and 80°, between 20° and 70°, or between 30° and 60°. A high visibility design element need only have a portion of the element intersect the imaginary plane and need not be perfectly centered about the respective design element plane to be within the scope of this invention.

In FIG. 7B, some triangle shaped elements 2 have at least one differently colored design element that is a second color (with respect to the similar shaped design elements within the image) while other triangle shaped elements 2 have the same color that is a first color for each design element. In one embodiment shown in FIG. 9, there are more design images (e.g. triangle shaped elements 25) that have a contrasting first color and second color for alignment purposes when compared to other design images on the same ball that do not have contrasting colors for alignment purposes. In one embodiment, at least 50% of the total ball images have a contrasting alignment feature. For example, if there are twelve images located on the ball, at least six of them have a contrasting alignment feature. In another embodiment, at least 25% of the total ball images placed on the golf ball surface have a contrasting alignment features. In yet another embodiment, at least 5%, 10%, 20%, 30%, 40%, 60%, 70%, 80%, 90%, or 100% of the total ball images have a contrasting alignment feature allowing the golfer to more easily align the ball prior to impact with a golf club.

In certain embodiments, there are interstitial white spaces 5 located between individual design elements 3.

One image metric for describing what a golfer perceives visually is referred to herein as contrast. In general, an image is loaded into an imaging system and the results are converted to grayscale to analyze contrast. The imaging setup utilized herein includes a white 12 inches cube light box and three diffused sources, which are three LED 13W FEIT Electric, 750 lumens, 2700K color temperature, used to minimize hot spots and provide diffused multi-angle source light. The three light sources are placed approximately 12 inches from the outside walls of the light cube on the left and right sides and top of cube as viewed from the front opening of the cube light box. A black drape may be used to cover the floor and back wall on the inside of the cube light box. Framing of a ball within a camera is held constant as is distance of the ball to focal plane. The ball is placed such that the center of focus is near the center of an image on the ball. The camera is a Canon EOS Rebel XTi Digital SLR camera with a Sigma 24-70 mm zoom lens setup on a tripod. The camera settings are set to the following parameters: automatic focus, white balance-auto, metering mode-average, exposure program-manual, color representation-sRGB, and a resolution of 3888 (w)×2592 (h) pixels. The end of the camera lens is placed at 12 inches from the ball horizontally and 6 inches higher than the ball. The camera is angled down to center the ball in the frame. Exposure of all images is held constant at f/8 1/6 sec. ISO-100 64 mm focal length. Pixel values of final images do not need to be rescaled—kept exposure to just below saturation values—and consistent from ball to ball. MATLAB Image Processing Toolbox is used for image analysis.

In the measuring process, a centroid closest to the center of the image is located. The center of the image is defined as the geometric center of the overall image. Interpolation is used to obtain grayscale (0-255) values along two lines from the centroid extending 300 pixels vertically and horizontally with 501 equidistance points measured between the beginning of the first pixel and the end of the 300th pixel. In order to normalize the 500 points of measurement, each measured location is divided by 500 and multiplied by 100 to obtain values on a 0 to 100 scale. For example, pixel location number 1 is divided by 500 and multiplied by 100. Therefore, the first location that a pixel is evaluated along the scale of 100 is at a location of 0.2 and so forth in order to generate the graphs shown in FIGS. 8B, 8C, 9B, 9C, 10B, and 10C. The interpolated grayscale pixel values are plotted along the normalized horizontal and vertical lines which describe the contrast variation within the image and from the geometric center of the image to whitespace (i.e., a white surface of the golf ball surrounding the image boundary). In other words, each pixel value, on the vertical axis of the graph, obtained at a given point is divided by 255 multiplied by 100 in order to normalize the data within the grayscale values as a percentage value. The result of this normalized data is shown within the charts shown in FIGS. 8B, 8C, 9B, and 9C. A value of 0% pixel value is equivalent to a zero value on the grayscale and corresponds to a perfectly black color while a value of 100% pixel value is equivalent to a 255 value on the grayscale and corresponds to a perfectly white color.

In certain embodiments a color contrast variation along the normalized horizontal and/or vertical line within an image (i.e., from the centroid to image edge) may have at least two, at least three, or at least four, at least five, at least six, at least seven, at least eight, at least nine, at least ten, at least eleven, at least twelve, at least thirteen, at least fourteen, at least fifteen, at least sixteen, at least seventeen, at least eighteen, at least nineteen, at least twenty peaks. The number of peaks can be between 2 to 100, between 3 to 90, between 4 to 80, between 5 to 70, between 6 to 60, between 7 to 50, between 8 to 40, or between 9 to 30.

In certain embodiments each of the peaks has a peak height of at least 10% pixel value. In certain embodiments at least one of the peaks has peak height of at least 20% pixel value. In certain embodiments at least one of the peaks has peak height of at least 30% pixel value. In certain embodiments the peak-to-peak length may be 5% to 25%, more particularly 5% to 20%, of the distance from the centroid to the image edge. The peak-to-peak length is measured along the Line Distance (%) axis from one maximum major peak value to the immediately following maximum major peak value.

Figure 8A:
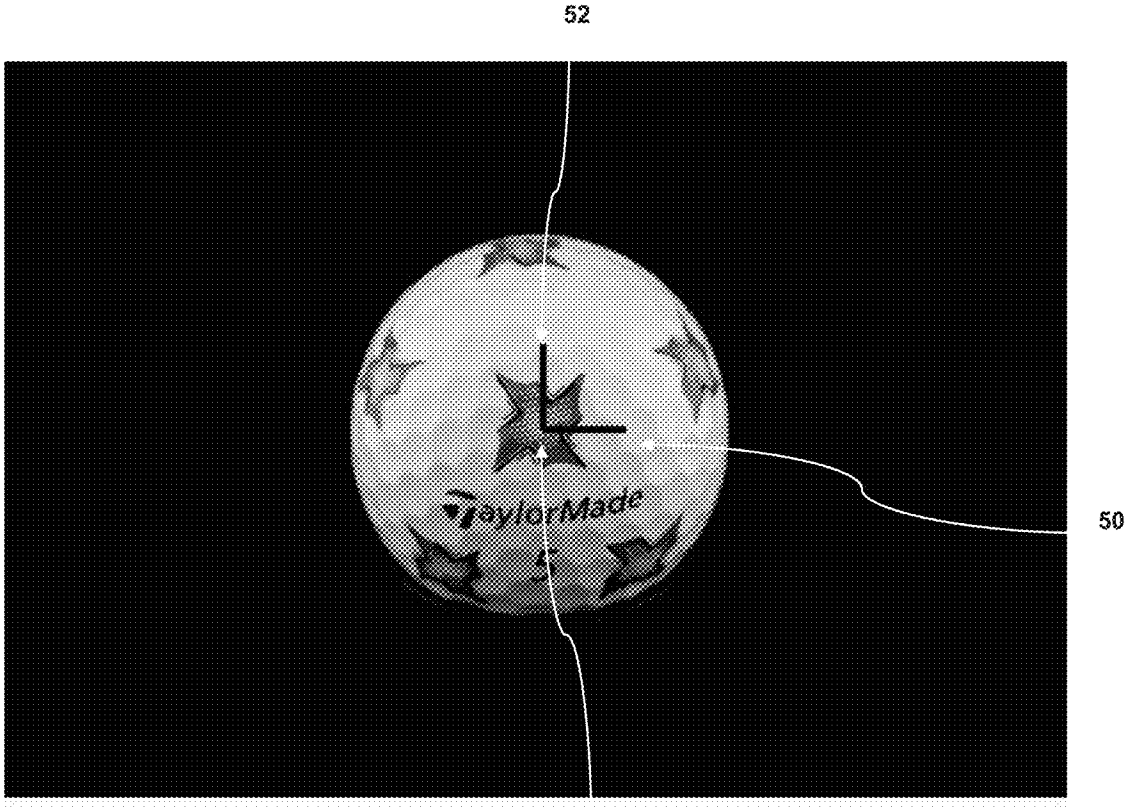
FIG. 8A shows color contrast variation within the image of FIG. 1.
Figure 9A:
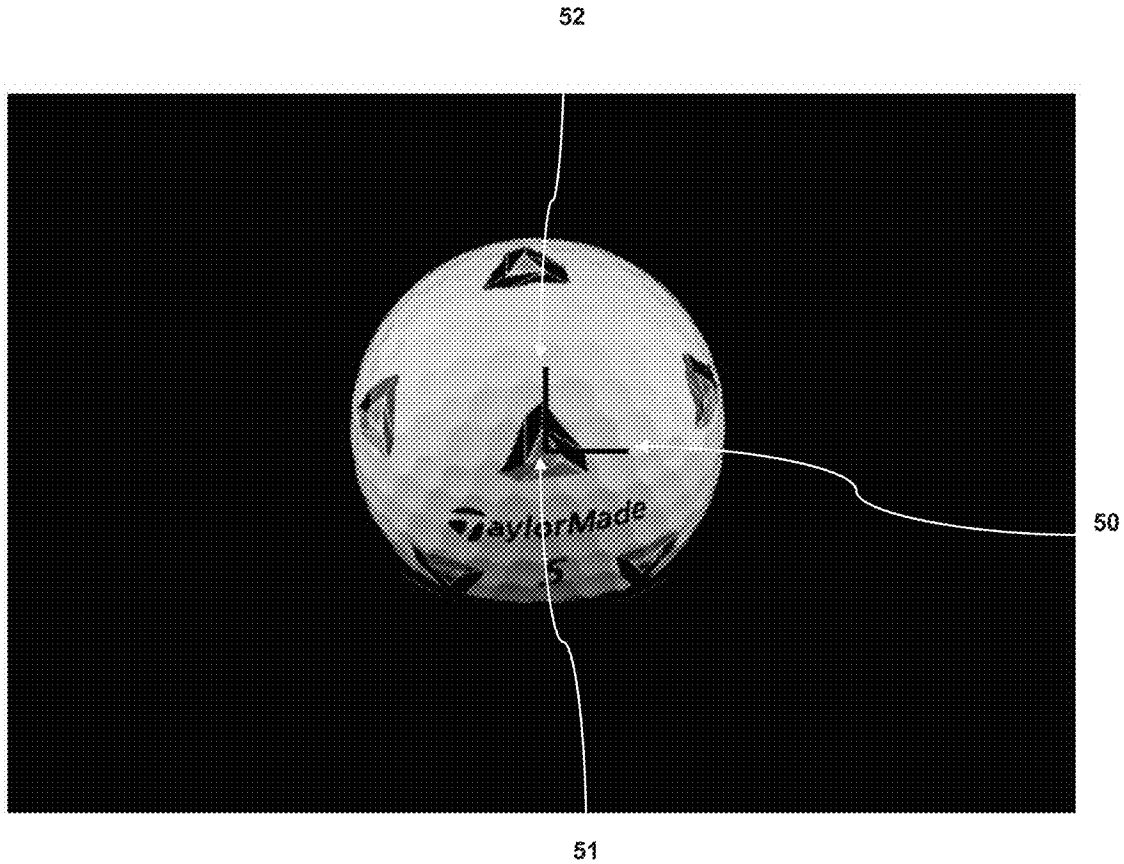
FIG. 9A shows color contrast variation within the image of an embodiment utilizing the image from FIG. 7A.
Figure 10A:
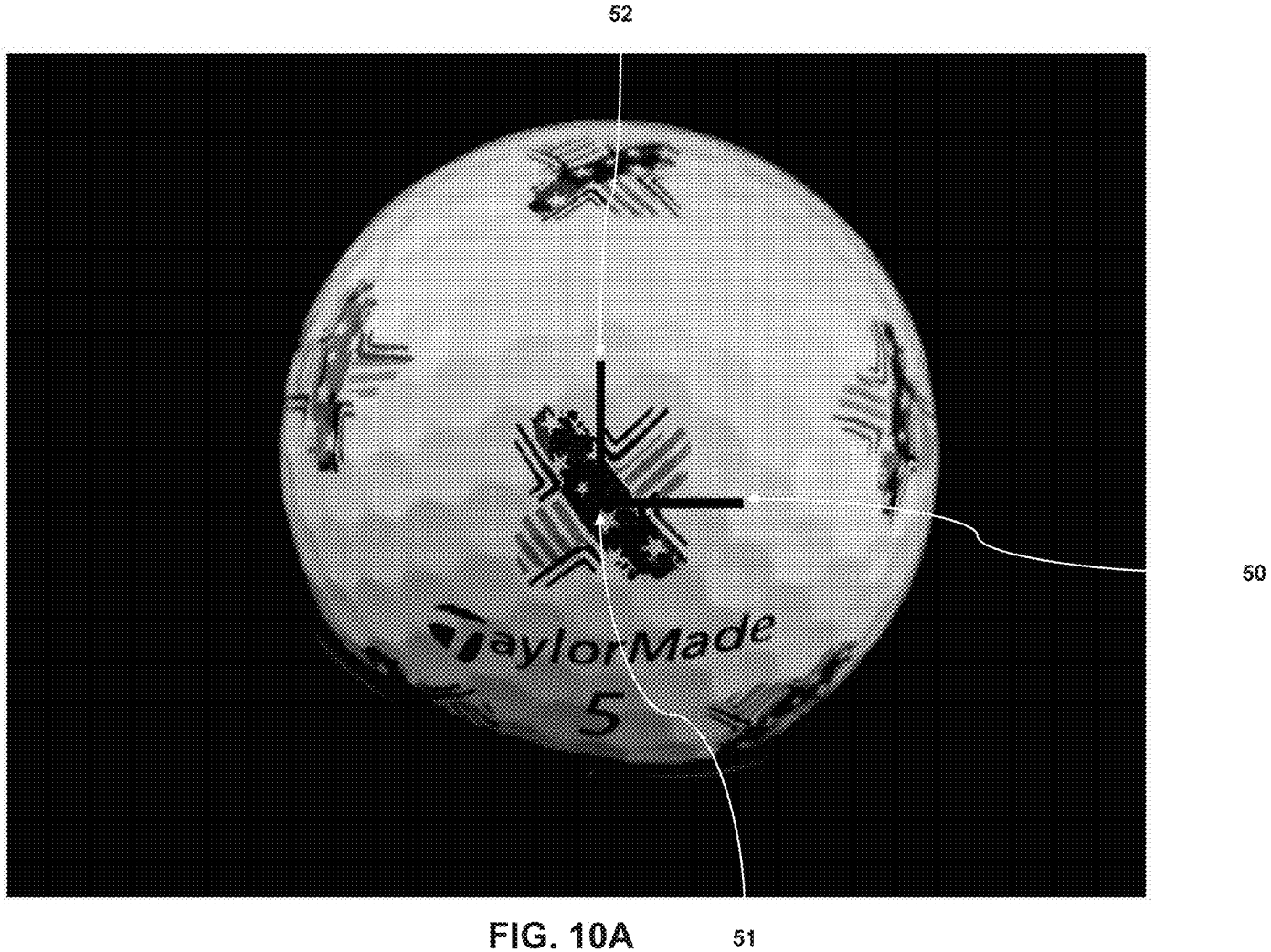
FIG. 10A shows a color contrast variation within the image of an embodiment utilizing the image from FIG. 6.

FIG. 8A shows a color contrast image of an actual golf ball used to analyze color contrast variation along the normalized horizontal and vertical line. The image located on the golf ball is identical to the image provided in the first embodiment in FIG. 1. In FIGS. 8A, 9A, and 10A, the normalized vertical line 52 and the normalized horizontal line 50 intersect at a geometric center of the image at a center point 51.

Figure 8B:
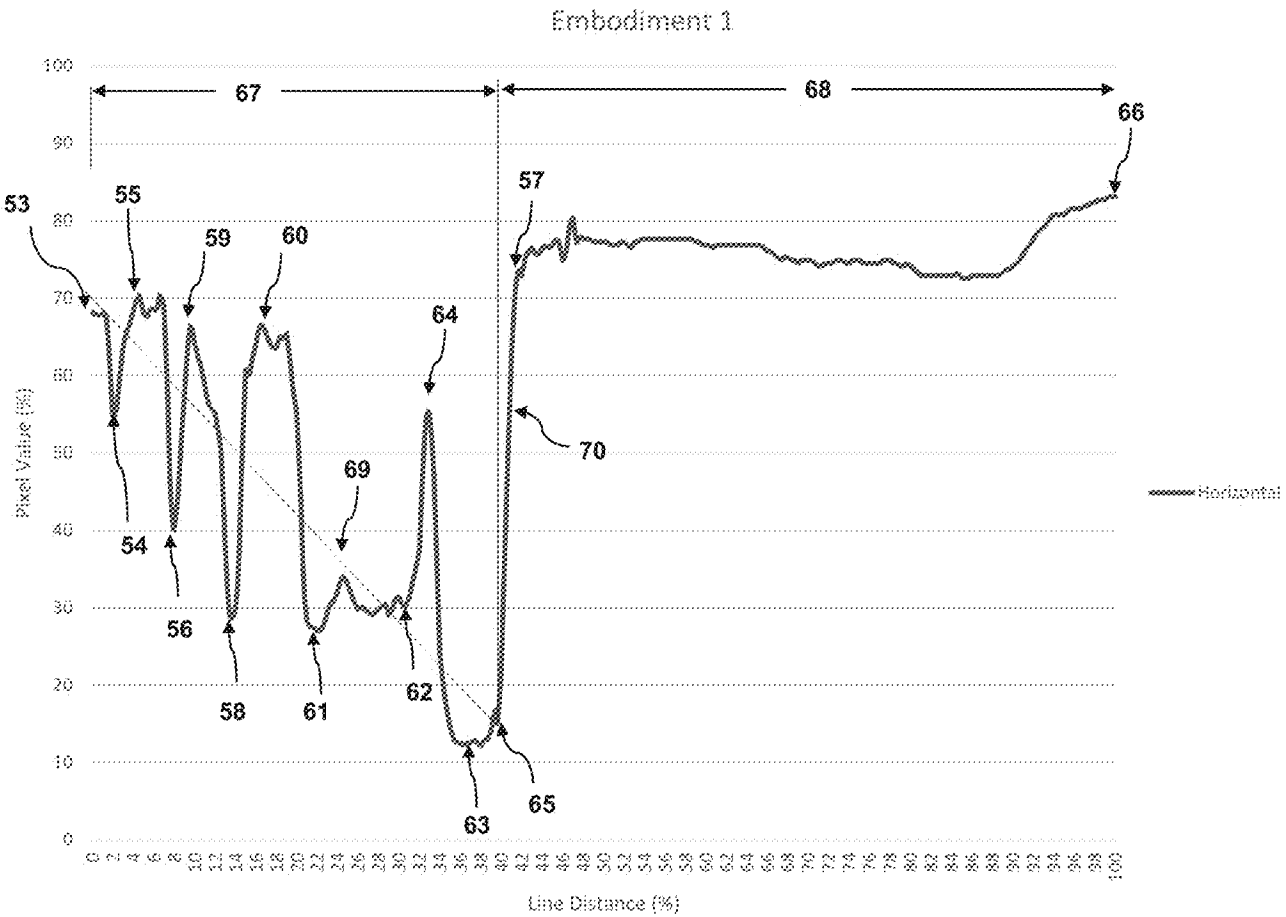
FIG. 8B illustrates a pixel value along a horizontal line for the embodiment shown in FIG. 8A.

FIG. 8B illustrates the normalized pixel values measured at 501 equidistant points across 300 pixels located along the horizontal line 50. At the first measurement location 53 having a Line Distance % of one along the horizontal line 50 (x-axis of FIG. 8B) of the image in FIG. 8A, the pixel value begins at sixty-eight.

FIG. 8B shows a first zone 67 and a second zone 68. The first zone 67 is located along the horizontal line 50 where the image is being analyzed. The second zone 68 illustrates a portion of the horizontal line 50 where the image ends and the base color of the golf ball is analyzed. In the embodiments shown herein, the base color of the golf ball is white but can be any color described herein.

Within the first zone 67, the image being analyzed includes four major peaks shown as a first major peak 55, a second major peak 59, a third major peak 60, and a fourth major peak 64. A major peak is defined as occurring when a pixel value rises more than ten pixel value points total relative to a previous minimum valley value and subsequently decreases by more than ten pixel value points total in a following minimum valley value. The increase or decrease of pixel value does not need to be a consecutive pixel value gain or loss to define a major peak or major valley. In other words, the pixel value gain or loss may have multiple minor valleys or peaks as it reaches the major peak or major valley. A major peak is present when two conditions are met: 1) the total gain of pixel value is ten or more when comparing a maximum peak value and the lowest valley point prior to the peak being analyzed (irrespective of whether there were undulations in the graphed line between the lowest valley point prior to the peak being analyzed), and 2) when the total loss of pixel value is ten or more after the maximum peak value of the peak being analyzed relative to the following lowest valley point after the peak being analyzed (irrespective of whether there were undulations in the graphed line between the maximum peak and the lowest valley point after to the peak being analyzed). In essence, the absolute minimum pixel value (located in a valley) before and after the peak being analyzed is compared to the peak maximum pixel value to determine whether the peak qualifies as a major peak. In FIG. 8B, the first measurement location 53 does not qualify as a major peak because there is no rise in more than ten pixel value points to create a major peak.

A major valley is present when two conditions are met: 1) the total loss of pixel value is ten or more when comparing a minimum valley value and the highest peak point prior to the valley being analyzed (irrespective of whether there were undulations in the graphed line between the highest peak point prior to the valley being analyzed), and 2) when the total gain of pixel value is ten or more after the minimum valley value of the valley being analyzed relative to the following highest peak point after the valley being analyzed (irrespective of whether there were undulations in the graphed line between the minimum valley and the highest peak point after to the valley being analyzed). In essence, the absolute maximum pixel value (located in a peak) before and after the valley being analyzed is compared to the valley minimum pixel value to determine whether the valley qualifies as a major valley.

In addition, the first zone 67 includes five major valleys shown as a first major valley 54, second major valley 56, third major valley 58, fourth major valley 61,62, and fifth major valley 63. A major valley is defined as occurring when a pixel value drops more than ten pixel value points, reaching a minimum valley, and subsequently rises by more than ten pixel value points. For illustrative purposes, the beginning of the fourth major valley 61 and end of the fourth major valley 62 are considered to be the same major valley because the minor rises in pixel value between the start point 61 and end point 62 do not create a major peak. In other words, between the start point 61 and the end point 62, the pixel value does not rise greater than ten points, therefore, the valley continues until the fourth major peak 64 begins. Peaks that are not considered major peaks are defined as minor peaks and valleys that are not considered major valleys are defined as minor valleys. The fifth major valley 63 occurs before the image ends and the base color of the ball begins. The image end point 65 is defined as the point located in the fifth major valley 63 (or last major valley) before the significant slope increase along the last slope increase segment 70 before reaching the base color value at the peak 57 of the last slope increase to stabilize at a fairly constant pixel value with no major peaks until the last measurement point 66 (at a Line Distance % of one-hundred). If the image end point 65 is difficult to identify, it can be determined as the last point located in the last major valley before an increase of ten pixel values points in a row or more. The second zone 68 begins at the image end point 65 and continues until the last measurement point 66.

In FIG. 8B, a linear trend line 69 is fit to the data points located within the first zone 67 only and, therefore, the trend line does not include data from the second zone 68.

In some embodiments, the first zone 67 may contain 1 to 500 major peaks, 2 to 250 major peaks, 3 to 100 major peaks, 4 to 50 major peaks, 5 to 25 major peaks, 6 to 20 major peaks, 7 to 15 major peaks, between 1 and 20 major peaks, between 2 and 10 major peaks, between 3 and 10 major peaks, between 4 and 10 major peaks, or between five and 10 major peaks.

Furthermore, in some embodiments, the first zone 67 may contain 1 to 500 major valleys, 2 to 250 major valleys, 3 to 100 major valleys, 4 to 50 major valleys, 5 to 25 major valleys, 6 to 20 major valleys, 7 to 15 major valleys, between 1 and 20 major valleys, between 2 and 10 major valleys, between 3 and 10 major valleys, between 4 and 10 major valleys, or between five and 10 major valleys.

In FIG. 8B, a Major Peak Ratio within the first zone 67 is defined as Equation 1:

$$\text{Major Peak Ratio} = \text{Number of Major Peaks/Line Distance \%} \quad \text{Eq. 1}$$

In the embodiment shown in FIG. 8B, four major peaks occur within a Line Distance % value of 39.8. The first zone 67 extends from 0 to 39.8. Therefore, the Major Peak Ratio is 0.10 (4/39.8). In some embodiments, the Major Peak Ratio is between 0.018 and 1, between 0.02 and 0.90, between 0.03 and 0.90, between 0.04 and 0.80, between 0.05 and 0.70, between 0.06 and 0.60, between 0.07 and 0.50, between 0.08 and 0.40, between 0.09 and 0.30, or between 0.10 and 0.20.

Furthermore, in FIG. 8B, a Major Valley Ratio within the first zone 67 is defined as Equation 2:

$$\text{Major Valley Ratio} = \text{Number of Major Valleys/Line Distance \%} \quad \text{Eq. 2}$$

In the embodiment shown in FIG. 8B, five major valleys occur within a Line Distance % value of 39.8. Therefore, the Major Valley Ratio is 0.13 (5/39.8). In some embodiments, the Major Valley Ratio is between 0.018 and 1, between 0.02 and 0.90, between 0.03 and 0.90, between 0.04 and 0.80, between 0.05 and 0.70, between 0.06 and 0.60, between 0.07 and 0.50, between 0.08 and 0.40, between 0.09 and 0.30, or between 0.10 and 0.20.

The Major Peak Ratio and the Major Valley Ratio are significant ratios that indicate whether the image provided has a pixelated or high contrast pattern that allows the golfer to better align the ball during various golf shots, such as putting, chipping, driving, and iron striking. Also, the visual contrast allows for better visibility in low visibility conditions on the golf course.

In FIG. 8B, all the major peaks have a maximum peak value in the first zone 67 that falls between a pixel value of 20 to 75. In some embodiments, all the major peaks in the first zone 67 have a maximum peak value that falls between pixel values of 25 to 75, between 35 to 75, between 40 to 75, between 45 to 75, or between 50 to 75.

In FIG. 8B, all the major valleys in the first zone 67 have a minimum valley value that falls between a pixel value of 10 to 60. In some embodiments, all the major valleys in a first zone have a minimum valley value that falls between pixel values of 2 and 60, between 5 and 60, between 10 and 50

Figure 8C:
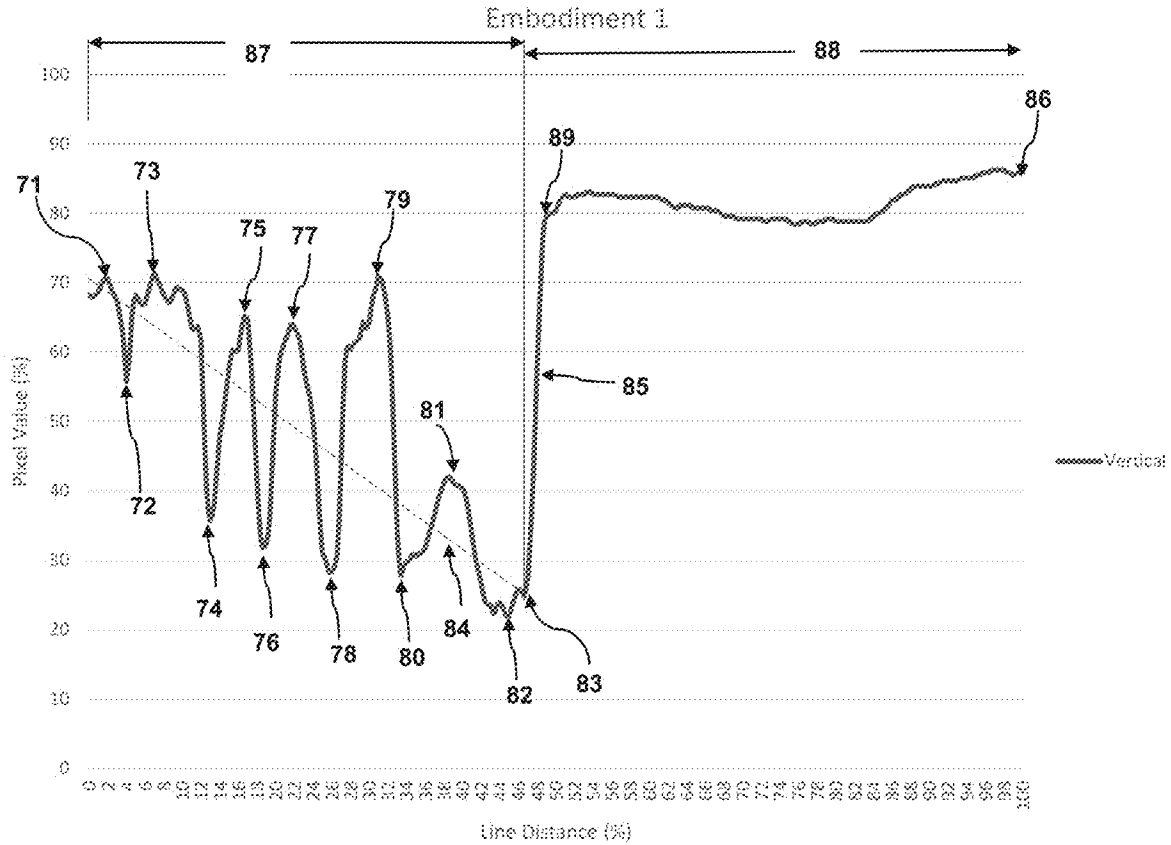
FIG. 8C illustrates a pixel value along a vertical line for the embodiment shown in FIG. 8A.

FIG. 8C illustrates the normalized pixel values measured at 501 equidistant points across 300 pixels located along the vertical line 52 of FIG. 8A.

FIG. 8C shows a first zone 87 and a second zone 88. The first zone 87 is located along the vertical line 52 where the image is being analyzed. The second zone 88 illustrates a portion of the vertical line 52 where the image ends and the base color of the golf ball is analyzed. In some embodiments, the base color of the golf ball may have a pixel value between 50 to 100, between 60 to 90, between 70 to 90, or between 75 to 85.

Within the first zone 87, the image being analyzed includes five major peaks shown as a first major peak 73, a second major peak 75, a third major peak 77, a fourth major peak 79 and a fifth major peak 81. The minor peak 71 is not considered a major peak because it does not increase by a value of more than ten pixel value points prior to reaching a maximum peak value.

In addition, the first zone 87 includes six major valleys shown as a first major valley 72, second major valley 74, third major valley 76, fourth major valley 78, fifth major valley 80, and sixth major valley 82. The sixth major valley 82 occurs before the image ends and the base color of the ball begins. The image end point 83 is defined as the point located in the sixth major valley 82 (or last major valley) before the significant slope increase along the last slope increase segment 85 before reaching the base color value at the peak 89 of the last slope increase to stabilize at a fairly constant pixel value with no major peaks until the last measurement point 86 (at a Line Distance % of one-hundred). The second zone 88 begins at the image end point 83 and continues until the last measurement point 86.

In FIG. 8C, a linear trend line 84 is fit to the data points located within the first zone 87 only and, therefore, the trend line does not include data from the second zone 88.

In the embodiment shown in FIG. 8C, five major peaks occur within a Line Distance % value of 47. The first zone 87 extends from 0 to 47. Therefore, the Major Peak Ratio is 0.11 (5/47).

In the embodiment shown in FIG. 8C, six major valleys occur within a Line Distance % value of 47. Therefore, the Major Valley Ratio is 0.13 (6/47).

In another embodiment, FIG. 9A shows a color contrast image of an actual golf ball used to analyze color contrast variation along the normalized horizontal 50 and vertical line 52 that intersect at center point 51. The image design located on the golf ball is identical to the image design provided in the seventh embodiment in FIG. 7A.

Figure 9B:
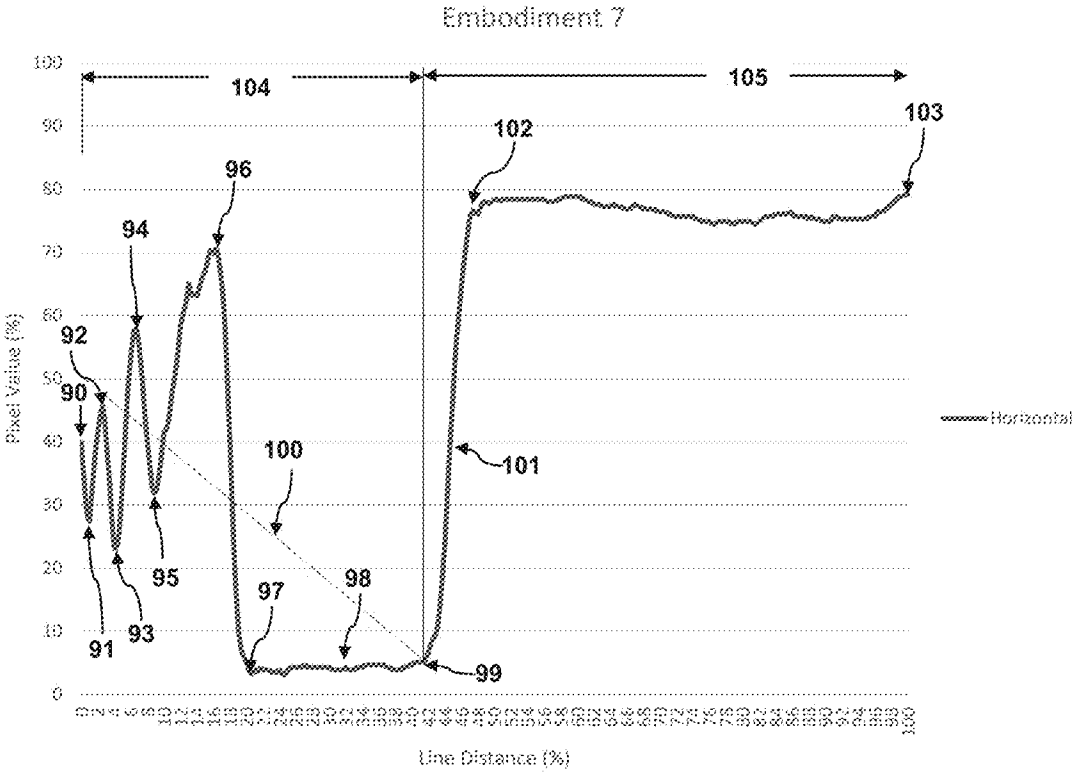
FIG. 9B illustrates a pixel value along a horizontal line for the embodiment shown in FIG. 9A.

FIG. 9B illustrates the normalized pixel values measured at 501 equidistant points across 300 pixels (starting at the beginning edge of the first pixel and ending with the ending edge of the last pixel) located along the horizontal line 50 of FIG. 9A.

FIG. 9B shows a first zone 104 and a second zone 105. The first zone 104 is located along the horizontal line 50 where the image is being analyzed. The second zone 105 illustrates a portion of the horizontal line 50 where the image ends and the base color of the golf ball is analyzed.

Within the first zone 104, the image being analyzed includes three major peaks shown as a first major peak 92, a second major peak 94, and a third major peak 96. The first measurement point 90 is not considered a major peak because it does not increase by a value of more than ten pixel value points prior to reaching a maximum peak value.

In addition, the first zone 104 includes four major valleys shown as a first major valley 91, second major valley 93, third major valley 95, and fourth major valley 98. The fourth major valley 98 occurs before the image ends and the base color of the ball begins. The image end point 99 is defined as the point located in the fourth major valley 98 (or last major valley) before the significant slope increase along the last slope increase segment 101 before reaching the base color value at the peak 102 of the last slope increase to stabilize at a fairly constant pixel value with no major peaks until the last measurement point 103 (at a Line Distance % of one-hundred). The fourth major valley 98 extends a significant distance along the x-axis of the graph (or horizontal axis of the graph). The fourth major valley 98 begins at the beginning point 97 and extends for more than 20 points along the Line Distance % axis. In some embodiments, a major valley or a major peak can extend for at least 5, at least 10, at least 15, at least 20, at least 25, at least 30, at least 35, at least 40, or at least 50 Line Distance % points along the x-axis of the graph. The second zone 105 begins at the image end point 99 and continues until the last measurement point 103.

In FIG. 9B, a linear trend line 100 is fit to the data points located within the first zone 104 only and, therefore, the trend line does not include data from the second zone 105.

In the embodiment shown in FIG. 9B, three major peaks occur within a Line Distance % value of 42.8. The first zone 104 extends from 0 to 42.8. Therefore, the Major Peak Ratio is 0.07 (3/42.8).

In the embodiment shown in FIG. 9B, four major valleys occur within a Line Distance % value of 42.8. Therefore, the Major Valley Ratio is 0.09 (4/42.8).

Figure 9C:
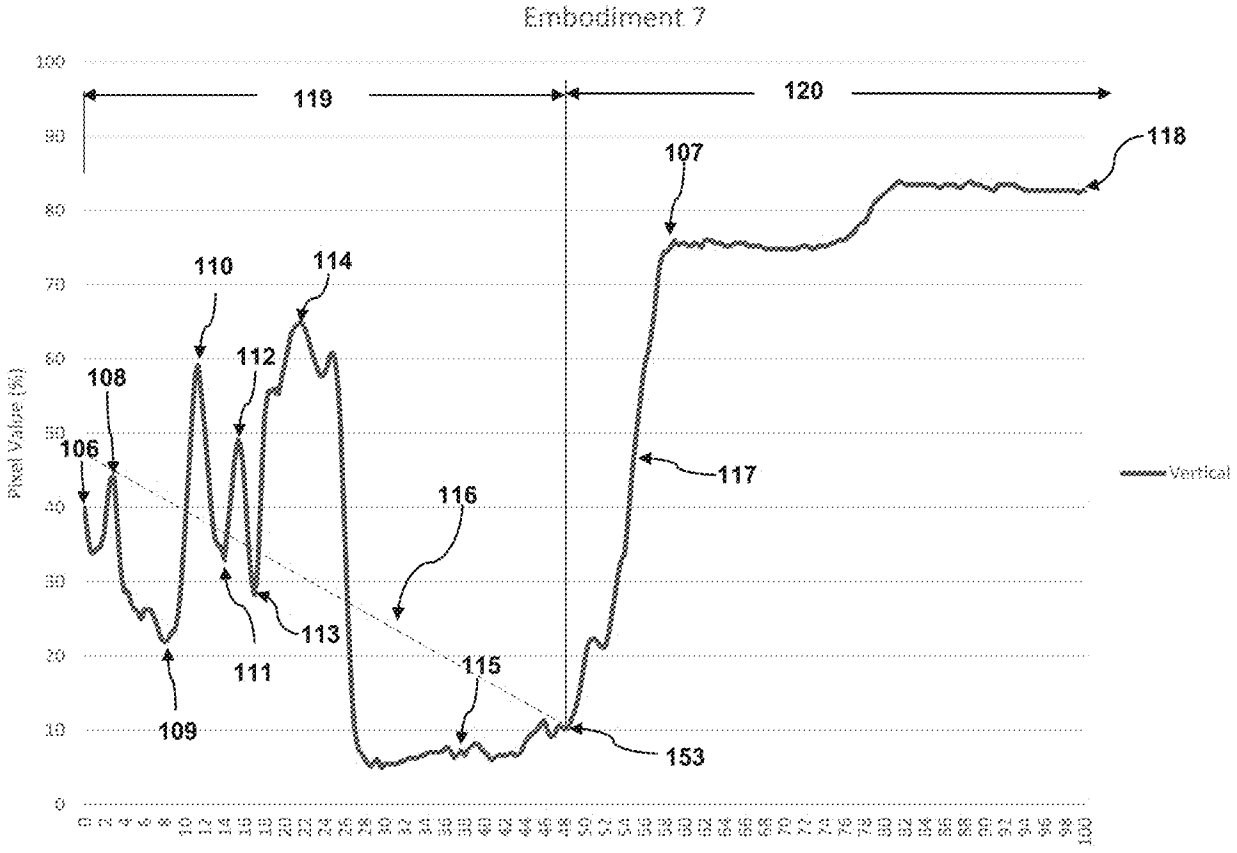
FIG. 9C illustrates a pixel value along a vertical line for the embodiment shown in FIG. 9A.

FIG. 9C illustrates the normalized pixel values measured at 501 equidistant points across 300 pixels (starting at the beginning edge of the first pixel and ending with the ending edge of the last pixel) located along the vertical line 52 of FIG. 9A.

FIG. 9C shows a first zone 119 and a second zone 120. The first zone 119 is located along the vertical line 52 where the image is being analyzed. The second zone 120 illustrates a portion of the vertical line 52 where the image ends and the base color of the golf ball is analyzed.

Within the first zone 119, the image being analyzed includes four major peaks shown as a first major peak 108, a second major peak 110, and a third major peak 112, and a fourth major peak 114. The first measurement point 106 is not considered a major peak because it does not increase by a value of more than ten pixel value points prior to reaching a maximum peak value.

In addition, the first zone 119 includes four major valleys shown as a first major valley 109, second major valley 111, third major valley 113, and fourth major valley 115. The fourth major valley 115 occurs before the image ends and the base color of the ball begins. The image end point 153 is defined as the point located in the fourth major valley 115 (or last major valley) before the significant slope increase along the last slope increase segment 117 before reaching the base color value at the peak 107 of the last slope increase to stabilize at a fairly constant pixel value with no major peaks until the last measurement point 118 (at a Line Distance % of one-hundred). The fourth major valley 115 extends a significant distance along the x-axis of the graph (or horizontal axis of the graph). The second zone 120 begins at the image end point 153 and continues until the last measurement point 118.

In FIG. 9C, a linear trend line 116 is fit to the data points located within the first zone 119 only and, therefore, the trend line does not include data from the second zone 120.

In the embodiment shown in FIG. 9C, four major peaks occur within a Line Distance % value of 48.4. The first zone 104 extends from 0 to 48.4. Therefore, the Major Peak Ratio is 0.08 (4/48.4).

In the embodiment shown in FIG. 9C, four major valleys occur within a Line Distance % value of 48.4. Therefore, the Major Valley Ratio is 0.08 (4/48.4). In some embodiments, the Major Peak Ratio and the Major Valley Ratio are equal to one another either along the same vertical or horizontal line, or between a horizontal line and a vertical line.

In yet another embodiment, FIG. 10A shows a color contrast image of an actual golf ball used to analyze color contrast variation along the normalized horizontal 50 and vertical line 52 that intersect at a center point 51. The image design located on the golf ball is identical to the image design provided in the sixth embodiment in FIG. 6.

Figure 10B:
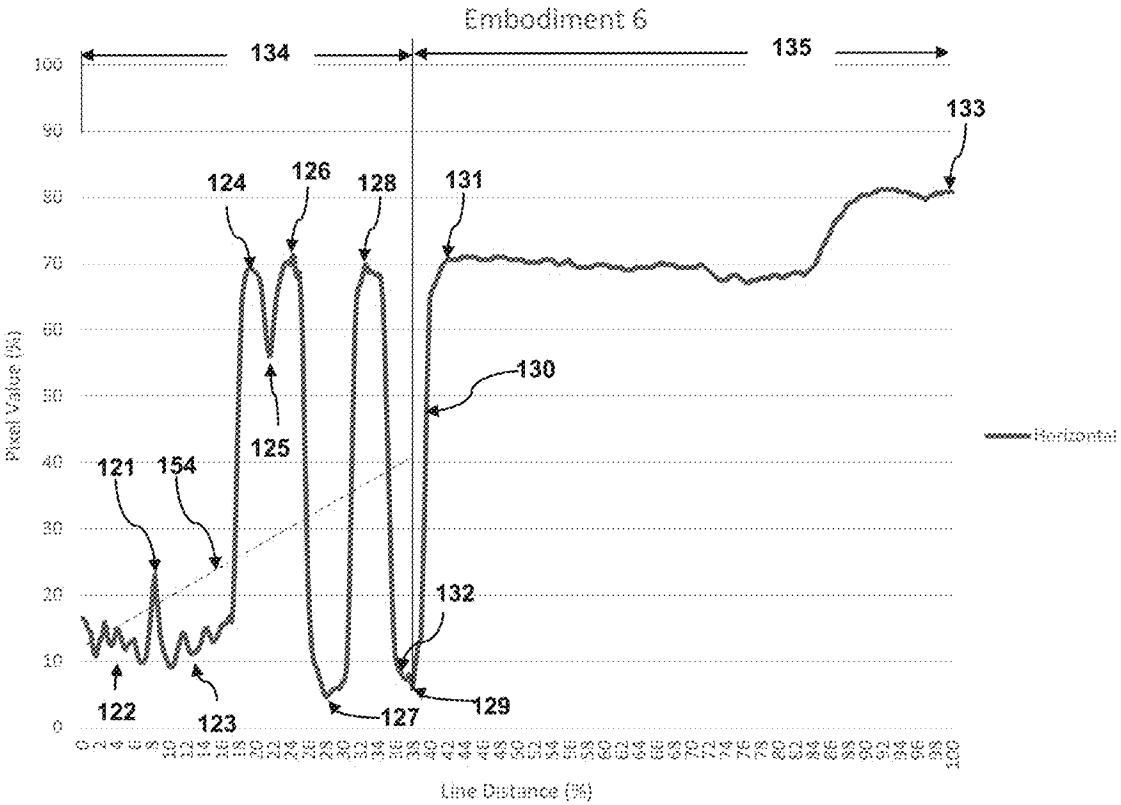
FIG. 10B illustrates a pixel value along a horizontal line for the embodiment shown in FIG. 10A.

FIG. 10B illustrates the normalized pixel values measured at 501 equidistant points across 300 pixels (starting at the beginning edge of the first pixel and ending with the ending edge of the last pixel) located along the horizontal line 50 of FIG. 10B.

FIG. 10B shows a first zone 134 and a second zone 135. The first zone 134 is located along the horizontal line 50 where the image is being analyzed. The second zone 135 illustrates a portion of the horizontal line 50 where the image ends and the base color of the golf ball is analyzed.

Within the first zone 134, the image being analyzed includes four major peaks shown as a first major peak 121, a second major peak 124, a third major peak 126 and fourth major peak 128. The beginning portion 122 is not considered a major valley because it does not decrease by a value of more than ten pixel value points prior to reaching a minimum valley value.

In addition, the first zone 134 includes four major valleys shown as a first major valley 123, second major valley 125, third major valley 127, and fourth major valley 132. The fourth major valley 132 occurs before the image ends and the base color of the ball begins. Even though the last major valley 132 does not increase by at least ten pixel values within the first zone 134, it is still considered a major valley within the first zone 134 because the minimum valley value occurs in the first zone 134. The image end point 129 is defined as the point located in the fourth major valley 132 (or last major valley) before the significant slope increase along the last slope increase segment 130 before reaching the base color value at the peak 132 of the last slope increase to stabilize at a fairly constant pixel value with no major peaks until the last measurement point 133 (at a Line Distance % of one-hundred). The second zone 135 begins at the image end point 129 and continues until the last measurement point 133.

In FIG. 10B, a linear trend line 154 is fit to the data points located within the first zone 134 only and, therefore, the trend line does not include data from the second zone 135.

In the embodiment shown in FIG. 10B, four major peaks occur within a Line Distance % value of 38. The first zone 134 extends from 0 to 38. Therefore, the Major Peak Ratio is 0.11 (4/38).

In the embodiment shown in FIG. 10B, four major valleys occur within a Line Distance % value of 38. Therefore, the Major Valley Ratio is 0.11 (4/38).

Figure 10C:
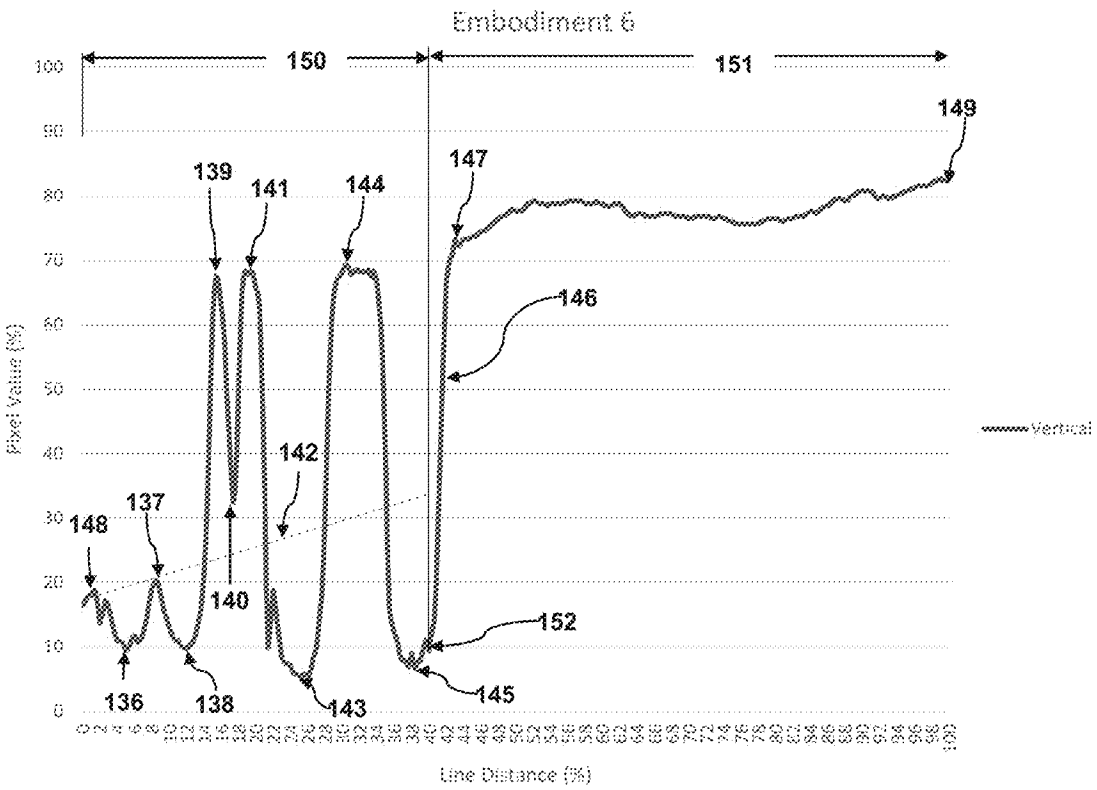
FIG. 10C illustrates a pixel value along a vertical line for the embodiment shown in FIG. 10A.

FIG. 10C illustrates the normalized pixel values measured at 501 equidistant points across 300 pixels (starting at the beginning edge of the first pixel and ending with the ending edge of the last pixel) located along the vertical line 52 of FIG. 10A.

FIG. 10C shows a first zone 150 and a second zone 151. The first zone 150 is located along the vertical line 52 where the image is being analyzed. The second zone 151 illustrates a portion of the vertical line 52 where the image ends and the base color of the golf ball is analyzed.

Within the first zone 150, the image being analyzed includes four major peaks shown as a first major peak 137, a second major peak 139, and a third major peak 141, and a fourth major peak 144.

In addition, the first zone 150 includes five major valleys shown as a first major valley 136, a second major valley 138, a third major valley 140, a fourth major valley 143 and a fifth major valley 145. The first major valley 136 decreases by an absolute total of ten pixel values relative to a previous minor peak 148. Consistent with how major valleys are analyzed, the fact that there are undulations in the graph line between the minor peak 148 and the minimum pixel value of the major valley 136 is irrelevant. The fifth major valley 145 occurs before the image ends and the base color of the ball begins. The image end point 152 is defined as the point located in the fifth major valley 145 (or last major valley) before the significant slope increase along the last slope increase segment 146 before reaching the base color value at the peak 147 of the last slope increase to stabilize at a fairly constant pixel value with no major peaks until the last measurement point 149 (at a Line Distance % of one-hundred). The second zone 151 begins at the image end point 152 and continues until the last measurement point 149.

In FIG. 10C, a linear trend line 142 is fit to the data points located within the first zone 150 only and, therefore, the trend line does not include data from the second zone 151.

In the embodiment shown in FIG. 10C, four major peaks occur within a Line Distance % value of 40. The first zone 150 extends from 0 to 40. Therefore, the Major Peak Ratio is 0.10 (4/40).

In the embodiment shown in FIG. 10C, five major valleys occur within a Line Distance % value of 40. Therefore, the Major Valley Ratio is 0.13 (5/40).

Table 1 provides the slope, intercept, R-squared, image end point location, and linear equations for the trend lines shown FIGS. 8B, 8C. 9B, 9C. 10B, and 10C, as previously described. All trend lines described herein are calculated utilizing the least squares method. The slope and intercept values can be obtained by using the "LINEST" function in Microsoft® Excel®. R-squared is defined as a statistical measure of how close the data are fitted to the regression line defined by the linear equation. A large R-squared value indicates the color contrast across the respective first zone is not very high, meaning the absolute difference between the major peaks and major valleys is lower relative to a high contrast black and white comparison. A low R-squared value indicates the color contrast is higher meaning that the absolute difference between the major peaks and major valleys is high and closer to a high contrast of black and white. In some embodiments, a lower contrast pixelated color arrangement is desired, in which case the R-squared value can range between 0.2 to 0.8, between 0.3 to 0.7, between 0.3 to 0.6, or between 0.4 to 0.55. In other embodiments, a high contrast pixelated color arrangement is desired in which case the R-squared value can range between 0 to 0.2, between 0.01 to 0.19, between 0.02 to 0.18, or between 0.03 to 0.17.

Within a single analyzed image, the R-squared (R^2) value between the horizontal line 50 and vertical line 52 can differ significantly and indicates whether the image is symmetrical or asymmetrical. For example, the difference between the R-squared value of the horizontal 50 and vertical 52 lines in Embodiment 1, shown in FIGS. 8B and 8C is about 0.12 (0.68 minus 0.56). The difference between the R-squared value of the horizontal 50 and vertical 52 lines in Embodiment 6, shown in FIGS. 10B and 10C is about 0.07 (0.14 minus 0.07). The difference between the R-squared value of the horizontal 50 and vertical 52 lines in Embodiment 7, shown in FIGS. 9B and 9C is about 0.15 (0.51 minus 0.36). In some embodiments, the difference between the R-squared value of the horizontal 50 and vertical 52 lines within in an image is between 0 and 0.9, between 0.01 and 0.8, between 0.02 and 0.7, between 0.03 and 0.6, between 0.04 and 0.5, between 0.05 and 0.4, between 0.06 and 0.3, or between 0.07 and 0.2.

TABLE 1

Trend Lines for First Zones

| Example | Slope | Intercept | R^2 | Image End Point | Linear Equation |
|---|---|---|---|---|---|
| Embodiment 1-Horizontal (FIG. 8B) | −1.37 | 70.76 | 0.68 | 39.8 | y = −1.37(x) + 70.76 |
| Embodiment 1-Vertical (FIG. 8C) | −0.91 | 71.18 | 0.56 | 47 | y = −0.91(x) + 71.18 |
| Embodiment 6-Horizontal (FIG. 10B) | 0.84 | 13.32 | 0.14 | 38 | y = 0.84(x) + 13.32 |
| Embodiment 6-Vertical (FIG. 10C) | 0.54 | 17.99 | 0.07 | 40 | y = 0.54(x) + 17.99 |
| Embodiment 7-Horizontal (FIG. 9B) | −1.33 | 51.78 | 0.51 | 42.8 | y = −1.33(x) + 51.78 |
| Embodiment 7-Vertical (FIG. 9C) | −0.86 | 47.58 | 0.36 | 48.4 | y = −0.86(x) + 47.58 |

Furthermore, the slope value can be either positive or negative. A negative slope value can indicate the image is becoming darker in pixel value as it moves from the center of the image to the edge of the image. A positive slope value can indicate the image is becoming lighter in pixel value as it moves from the center of the image to the edge of the image. In some embodiments, the slope value of either the horizontal line 50 or vertical line 52 can be between 0 and −10, between −0.01 and −9, between −0.1 and −5, between −0.2 and −4, between −0.3 and −3, between −0.4 and −2, between −0.5 and −1.5, or between −0.6 and −1.6.

Furthermore, in some embodiments, the slope value of either the horizontal line 50 or vertical line 52 can be between 0 and 10, between 0.01 and 9, between 0.1 and 5, between 0.2 and 4, between 0.3 and 3, between 0.4 and 2, between 0.5 and 1.5, or between 0.6 and 1.6. In some embodiments, the slope value can be between −10 and 10, between −5 and 5, between −2 and 2, or between −1.5 and 1.5

In some embodiments, the intercept value is between 5 and 80, between 10 and 70, between 15 and 65, between 20 and 60, between 30 and 60, or between 60 and 80. The intercept value indicates the color pixel value at the center point location of the image design.

Examples are also described, for convenience, with respect to CIELab color spaced using L*a*b* color values or L*C*h color values, but other color descriptions can be used. As used herein, L* is referred to as lightness, a* and b* are referred to as chromaticity coordinates, C* is referred to as chroma, and h is referred to as hue. In the CIELab color space, +a* is a red direction, −a* is a green direction, +b* is a yellow direction, and −b* is the blue direction. L* has a value of 100 for a perfect white diffuser. Chroma and hue are polar coordinates associated with a* and b*, wherein chroma (C*) is a distance from the axis along which a*=b*=0 and hue is an angle measured counterclockwise from the +a* axis. The following description is generally based on values associated with standard illuminant D65 at 10 degrees. This illuminant is similar to outside daylight lighting, but other illuminants can be used as well, if desired, and tabulated data provided herein generally includes values for illuminant A at 10 degrees and illuminant F2 at 10 degree. These illuminants are noted in tabulated data simply as D, A, and F for convenience. The terms brightness and intensity are used in the following description to refer to CIELab coordinate L*.

For convenient description, standard golf illumination is defined herein as illumination associated with common outdoor playing conditions in natural lighting, i.e., full sun, partial sun, partial shade, full shade, and overcast conditions at times a few hours after sunrise and a few hours before sunset.

In one embodiment, predominant white color of the golf ball has a CIELab lightness (L) of between 80 to 100, more particularly between 85 to 99, or between 90 to 99, a CIELab "a" value of between −5 to 0, more particularly between −4 to 0, and a CIELab b value of between −10 to 0, more particularly between −9 to 0, or between −8 to −2. It is understood that some golf balls may be covered in non-white or contrasting images and have very little white space. In such cases, the white color that is a target value for comparison may not be predominant in that it covers very little surface area of the ball. In some embodiments, the first color, second color, or third color may be the base color upon which an image is printed or applied. The base color or predominant color or base color may be white, black, red, yellow, blue, green, orange, purple, or any primary, secondary, or tertiary color or combination of any of the above. The first color, second color, and third color may be any of the colors listed herein while falling within the defined CIELab values.

In certain embodiments, an image may have at least a first color having a CIELab lightness (L) of 15 to 35, more particularly 20 to 30 or 25 to 30, a CIELab "a" value of −2.9 to 3, more particularly −2.5 to 1, and a CIELab b value of −1 to 10, more particularly 0 to 5 or 0 to 3, a second color having a CIELab lightness (L) of 60 to 100, more particularly 70 to 90, or 75 to 85, a CIELab "a" value of 5 to 15, more particularly 8 to 12, or 9 to 11, and a CIELab b value of 60 to 100, more particularly 70 to 90, or 75 to 85, and a third color having a CIELab lightness (L) of 30 to 50, more particularly 36 to 45, or 38 to 42, a CIELab "a" value of 30 to 50, more particularly 35 to 45, or 38 to 42, and a CIELab b value of 10 to 20, more particularly 12 to 18 or 13 to 15. In one embodiment having an image composed of at least three colors and up to fifty colors, at least a third of the colors have CIELab values within the range of values associated with the first color, described above. In another embodiment having an image composed of at least three colors and up to fifty colors, at least a third of the colors have CIELab values within the range of values associated with the second color, described above. In another embodiment having an image composed of at least three colors and up to fifty colors, at least a third of the colors have CIELab values within the range of values associated with the third color, described above. By way of example, in one embodiment, an image is composed of six colors on a golf ball. At least a third of the total colors, meaning two out of the six total colors, falls within the CIELab values of lightness (L) of 15 to 35, more particularly 20 to 30 or 25 to 30, a CIELab "a" value of −2.9 to 3, more particularly −2.5 to 1, and a CIELab b value of −1 to 10, more particularly 0 to 5 or 0 to 3. In some embodiments, at least one-quarter of the total number of colors in an image fall within the CIELab values associated with the first color, second color, or third color described above. For example, in an image of four, five six, seven, eight, nine, ten, total colors, at least a quarter of the total colors fall within the CIELab values described above and associated with the first color, second color, or third color. As described herein, the first color, second color, or third color can each include multiple colors that fall within each of their respective CIELab ranges. For example, the first color can include two different colors that both fall within the same CIELab ranges described above.

In certain embodiments, an image may have at least a first contrasting color and a second contrasting color wherein the absolute value difference between CIELab L values for the first contrasting color and the second contrasting color is at between 5 to 70, between 10 to 60, or more particularly between 10 to 55. In certain embodiments, an image may have at least a first contrasting color and a second contrasting color wherein the absolute value difference between CIELab "a" values for the first non-white or contrasting color and the second non-white or contrasting color is at between 3 and 50, between 5 and 45, or more particularly between 6 and 42. In certain embodiments, an image may have at least a first contrasting color and a second contrasting color wherein the absolute value difference between CIELab b values for the first contrasting color and the second contrasting color is between 5 and 90, between 10 and 85, or more particularly between 10 and 80.

Shown below are CIELab values for the image embodiment shown in FIG. 1.

Pix 1.0 Tech Color Measurements (based on Pantone® Matching System (PMS))

| ΔE*ab | | | | | | |
|---|---|---|---|---|---|---|
| Color | L | a | b | ΔE*ab from Target | | |
| Ball White (spec) | 90.5 | −3 | −7.5 | <-Target | | |
| Black 3C | 27.94 | −2.21 | 0.31 | 63.1 | | |
| Black C | 28.58 | 0.95 | 2.14 | 62.8 | <-Target | |
| Yellow PMS123C | 81.68 | 10.26 | 80.78 | 89.7 | 95.3 | <-Target |
| Red PMS187C | 40.97 | 40.93 | 14.65 | 69.8 | 43.7 | 83.5 |

Table 2 shows a ΔE*ab relative to the target value. In one embodiment, the ΔE*ab values are measured from the target value of the dominant white color of the golf ball or a base color that can be white or non-white. For example, if the majority of the surface area of the ball is a white color, this predominant white color will be utilized as the target specimen or color when calculating ΔE*ab for the first color, second color, and third color. In another embodiment, the ΔE*ab is calculated for the second and third colors utilizing the first color as the target color or specimen. In yet another embodiment, the ΔE*ab is calculated for the third color utilizing the second color as the target color specimen.

The value of ΔE*ab is calculated according the below equation in Eq. 1:

$$\Delta E^*ab=\sqrt{(\Delta L)2+(\Delta a)2+(\Delta b)2} \quad \text{Eq.1}$$

Where

ΔL is the lightness difference between the target specimen and the specimen having the color being evaluated; and Δa, Δb are differences of the CIE 1976 a and b*coordinates, respectively.

Table 2 illustrates the ΔE*ab values for a first color being either Black 3C or Black C relative to the predominant white color of the golf ball as the target color or specimen. In one embodiment, the ΔE*ab of the first color relative to the target white color is between 40 and 80, between 50 and 70, or between 55 and 65.

Table 2 also illustrates a second color being Yellow PMS123C and the ΔE*ab value of the second color when the target color or specimen is the predominant white color of the golf ball. In one embodiment, the ΔE*ab value of the second color is between 70 and 110, between 80 and 100 or between 85 and 95 relative to a white target color. In yet another embodiment, the ΔE*ab value of the second color is between 80 and 110, between 85 and 105, or between 90 and 100 when the target color is the first color.

Table 2 further illustrates the third color being Red PMS187C and the ΔE*ab value of the third color when the target color or specimen is the predominant white color of the golf ball. In one embodiment, the ΔE*ab value of the third color is between 50 and 90, between 60 and 80 or between 65 and 75 relative to a white target color. In yet another embodiment, the ΔE*ab value of the third color is between 25 and 55, between 30 and 50, or between 35 and 45 when the target color is the first color. In yet another embodiment, the ΔE*ab value of the third color is between 65 and 95, between 70 and 90, or between 75 and 85 when the target color is the second color.

In one embodiment, the ΔE*ab values of the first, second and third color relative to the predominate white color of the ball are between 40 and 100, between 50 and 95, or between 60 and 95. In one embodiment, the ΔE*ab values of the second and third color relative to the first color of the ball are between 30 and 110, between 35 and 98, or between 40 and 97. In some embodiments, where the golf ball has two colors or more, such as two to ten colors, or three to ten colors, the ΔE*ab values of all the image colors relative to the predominate white color of the ball are between 40 and 100, between 50 and 95, or between 60 and 95.

In one embodiment, the absolute value of the differences in CIELab values between the first color, second color, and third color relative to the base white ball color is evaluated.

TABLE 3

| Absolute Value of Differences in Table 2 | | | |
|---|---|---|---|
| Color | \|ΔL\| | \|Δa\| | \|Δb\| |
| Ball White (spec) | 0 | 0 | 0 |
| Black 3C | 62.56 | 0.79 | 7.81 |
| Black C | 61.92 | 3.95 | 9.64 |
| Yellow PMS123C | 8.82 | 13.26 | 88.28 |
| Red PMS187C | 49.53 | 43.93 | 22.15 |
| Average | 45.7075 | 15.4825 | 31.97 |

As shown in Table 3, the first color has an absolute value difference in "L" value (|ΔL|), relative to the base white color of the ball, of between 30 and 90, between 40 and 80, between 50 and 70, or between 55 and 65. The first color also has an absolute value difference in "a" value (|αa|), relative to the base white color of the ball, of between 0.1 and 10, between 0.2 and 7, or between 0.3 and 5. The first color also has an absolute value difference in "b" value (|Δb|), relative to the base white color of the ball, of between 3 and 12, between 4 and 11, or between 5 and 10.

As shown in Table 3, the second color has an absolute value difference in "L" value (|ΔL|), relative to the base white color of the ball, of between 1 and 15, between 3 and 12, between 4 and 11, or between 5 and 10. The second color also has an absolute value difference in "a" value (|Δa|), relative to the base white color of the ball, of between 3 and 20, between 5 and 18, or between 10 and 15. The second color also has an absolute value difference in "b" value (|Δb|), relative to the base white color of the ball, of between 50 and 100, between 60 and 95, or between 70 and 95.

Furthermore, as shown in Table 3, the third color has an absolute value difference in "L" value (|ΔL|), relative to the base white color of the ball, of between 25 and 75, between 30 and 70, between 40 and 60, or between 45 and 55. The third color also has an absolute value difference in "a" value (|Δa|), relative to the base white color of the ball, of between 20 and 60, between 30 and 50, or between 35 and 45. The third color also has an absolute value difference in "b" value (|Δb|), relative to the base white color of the ball, of between 5 and 50, between 10 and 40, or between 15 and 30.

In addition, as shown in Table 3, the average of at least a first, second, and third color has an absolute average value difference in "L" value (|ΔL|), relative to the base white color of the ball, of between 25 and 75, between 30 and 70, between 40 and 60, or between 45 and 55. The average of at least a first, second, and third color has an absolute average value difference in "a" value (|Δa|), relative to the base white color of the ball, of between 5 and 30, between 7 and 25, or between 5 and 20. The average of at least a first, second, and third color also has an absolute average value difference in "b" value (|Δb|), relative to the base white color of the ball, of between 5 and 50, between 10 and 45, or between 15 and 40. In cases where there are more than three colors in an image located on a ball, for example three to twenty colors, the colors may still have an average that falls within the absolute average values described above for |ΔL|, |Δa|, |Δb|.

The image may be created on the golf ball by any type of printing or application method. An illustrative method is ink pad printing. Another method is ink jet printing.

In certain embodiments, pixelating methods may be used to provide the different colors in an image. In a pixelating method multiple layers of ink droplets are applied to the surface of a golf ball. For example, a first layer of ink droplets of a first color is applied in a desired pattern onto the golf ball surface. Subsequently, a second layer of ink droplets of a second color is applied in a desired pattern onto the golf ball surface. In certain embodiments, the first ink droplets and the second ink droplets blend together to form the final desired color. In other embodiments, the first ink droplets and the second ink droplets do not blend together and do not overlap. Additional layers of ink droplets may be applied in a similar manner as desired.

Applying ink droplets at different stages of the process enables minimization of the image film thickness so that the effective film thickness of the final image is close to that of a single layer. This pixelating approach allowing for thinner layers also improves adhesion of the ink, shear resistance of the finished ball, and minimizes thickness variations. In addition, pixelating creates a level of transparency that improves ultraviolet (UV) curing of the image ink. For example, without pixelating underlying layers of ink may not cure and at least a portion of the image may erode over an unacceptably short period of time.

In one embodiment, the individual pixels are circular. The number of pixels per surface area may vary. For example, there may be 120×120 dpi to 1200×1200 dpi. In certain embodiments, each individual pixel may have a dot size of non-zero mm to 0.1 mm.

In certain embodiments the total amount of ink used to create the images per ball is from 0.012 to 0.03 mL. The amount of ink used for the different colors may vary. For example, the ink volume of a first color (e.g., yellow) may be approximately 50% of the volume for a second color (e.g., red) and a third color (e.g., black). In certain embodiments, the ink volume of a first color is from 0.0024 mL to 0.006 mL, the ink volume of a second color is from 0.0048 mL to 0.012 mL, and the ink volume of a third color is from 0.0024 mL to 0.006 mL.

The thickness of the applied ink may vary depending upon the application method. For instance, a single layer of ink may be from 10 to 15 μm. The thickness of at least partially overlapped layers of two different colors of ink may be from 10 to 30 μm. The thickness of at least partially overlapped layers of three different colors of ink may be from 10 to 45 μm.

The image ink and/or ball paint may be UV curable compositions. For example, the image ink may be a UV curable epoxy. Alternatively, the image ink and/or ball paint may be curable by another mechanism such as heat. In certain embodiments, the paint is a white urethane composition. A clear coat (e.g., a UV curable composition) may be applied onto the paint and the images.

UV irradiation may be applied after each application of a pixelated layer or UV irradiation may be applied after application of a plurality of pixelated layers. In certain embodiments, each image is exposed for a certain amount of time (e.g., 1 to 30 seconds) to UV radiation if it is only a single pixelated layer. In certain embodiments, each image is exposed for a certain amount of time (e.g., 1 to 30 seconds) to UV radiation if there are a plurality of pixelated layers. However, UV curing should not exceed a certain time or intensity so as to avoid yellowing of the white paint or the outer layer composition. Thus, in certain embodiments, UV curing should not exceed 1.5 seconds or 2.5 J/cm$^2$.

Alternatively, each pixelated layer or a plurality of overlapping pixelated layers may be exposed to heat.

The surface area of an image may vary. In certain embodiments, the surface area covered by an image may be from 30 to 80 mm$^2$, more particularly 40 to 65 mm$^2$.

The image, or color contrast, may be applied to any type of golf ball. In certain embodiments, the golf ball has a core and at least one layer surrounding the core. In certain embodiments, the golf ball has a core, at least one mantle layer, and a cover layer. The image is applied to the outer surface of the cover layer. The golf ball may be a two-piece ball, a three-piece ball, a four-piece ball, a five-piece ball, or a six-piece ball.

The term "core" is intended to mean the elastic center of a golf ball. The core may be a unitary core having a center it may have one or more "core layers" of elastic material, which are usually made of rubbery material such as diene rubbers.

The term "cover layer" is intended to mean the outermost layer of the golf ball; this is the layer that is directly in contact with paint and/or ink on the surface of the golf ball. If the cover consists of two or more layers, only the outermost layer is designated the cover layer, and the remaining layers (excluding the outermost layer) are commonly designated intermediate layers as herein defined. The term "outer cover layer" as used herein is used interchangeably with the term "cover layer."

The term "mantle layer" may be used interchangeably herein with the terms "intermediate layer" and is intended to mean any layer(s) in a golf ball disposed between the core and the outer cover layer. Should a ball have more than one mantle layer, these may be distinguished as "inner intermediate layer" or "inner mantle layer" which terms may be used interchangeably to refer to the intermediate layer nearest the core and furthest from the outer cover, as opposed to the "outer intermediate layer" or "outer mantle layer" which terms may also be used interchangeably to refer to the intermediate layer furthest from the core and closest to the outer cover, and if there are three intermediate layers, these may be distinguished as "inner intermediate layer" or "inner mantle layer" which terms are used interchangeably to refer to the intermediate or mantle layer nearest the core and furthest from the outer cover, as opposed to the "outer intermediate layer" or "outer mantle layer" which terms are also used interchangeably to refer to the intermediate layer further from the core and closer to the outer cover, and as opposed to the "intermediate layer" or "intermediate mantle layer" which terms are also used interchangeably to refer to the intermediate layer between the inner intermediate layer and the outer intermediate layer.

The image can be used on golf balls of any desired size. "The Rules of Golf" by the USGA dictate that the size of a competition golf ball must be at least 1.680 inches in diameter; however, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred; however, diameters anywhere in the range of from 1.70 to about 2.0 inches can be used. Oversize golf balls with diameters above about 1.760 inches to as big as 2.75 inches are also within the scope of the invention.

Each of the mantle layers of the golf balls may have a thickness of less than 0.080 inch, more particularly less than 0.065 inch, and most particularly less than 0.055 inch.

In certain embodiments the inner mantle may have a material Shore D hardness of 15 to 65, particularly 25 to 60, and more particularly 30 to 58. The inner mantle may have a flexural modulus of 2 to 35, particularly 10 to 30, and more particularly 15 to 35, kpsi. The intermediate mantle may have a flexural modulus of 10 to 50, particularly 25 to 50, and most particularly 25 to 40, kpsi, and a material Shore D hardness of 40 to 70, more particularly from 45 to 65, and most particularly from 50 to 60. The outer mantle may have a material Shore D hardness of 55 to 75, particularly 58 to 70, and more particularly 60 to 68. The outer mantle material may have a flexural modulus of 30 to 80, particularly 40 to 80, and most particularly 50 to 75, kpsi. The core, mantle layer(s) and cover layer(s) may each include one or more of the following polymers.

Such polymers include synthetic and natural rubbers, thermoset polymers such as thermoset polyurethanes and thermoset polyureas, as well as thermoplastic polymers including thermoplastic elastomers such as unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyesters, copolyesters, polyamides, copolyamides, polycarbonates, polyolefins, polyphenylene oxide, polyphenylene sulfide, diallyl phthalate polymer, polyimides, polyvinyl chloride, polyamide-ionomer, polyurethane-ionomer, polyvinyl alcohol, polyarylate, polyacrylate, polyphenylene ether, impact-modified polyphenylene ether, polystyrene, high impact polystyrene, acrylonitrile-butadiene-styrene copolymer styrene-acrylonitrile (SAN), acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, and polysiloxane and any and all combinations thereof. One example is Paraloid EXL 2691A which is a methacrylate-butadiene-styrene (MBS) impact modifier available from Rohm & Haas Co.

More particularly, the synthetic and natural rubber polymers may include the traditional rubber components used in golf ball applications including, both natural and synthetic rubbers, such as cis-1,4-polybutadiene, trans-1,4-polybutadiene, 1,2-polybutadiene, cis-polyisoprene, trans-polyisoprene, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

The 1,4-polybutadiene rubbers have a molecular weight distribution (Mw/Mn) of from about 1.2 to about 4.0, preferably from about 1.7 to about 3.7, even more preferably from about 2.0 to about 3.5, most preferably from about 2.2 to about 3.2. The polybutadiene rubbers have a Mooney viscosity ($ML_{1+4}$ (100° C.)) of from about 20 to about 80, preferably from about 30 to about 70, even more preferably from about 30 to about 60, most preferably from about 35 to about 50. The term "Mooney viscosity" used herein refers in each case to an industrial index of viscosity as measured with a Mooney viscometer, which is a type of rotary plastometer (see JIS K6300). This value is represented by the symbol $ML_{1+4}$ (100° C.), wherein "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

Examples of 1,2-polybutadienes having differing tacticity, all of which are suitable as unsaturated polymers for use in the presently disclosed compositions, are atactic 1,2-polybutadiene, isotactic 1,2-polybutadiene, and syndiotactic 1,2-polybutadiene. Syndiotactic 1,2-polybutadiene having crystallinity suitable for use as an unsaturated polymer in the presently disclosed compositions are polymerized from a 1,2-addition of butadiene. The presently disclosed golf balls may include syndiotactic 1,2-polybutadiene having crystallinity and greater than about 70% of 1,2-bonds, more preferably greater than about 80% of 1,2-bonds, and most preferably greater than about 90% of 1,2-bonds. Also, the 1,2-polybutadiene may have a mean molecular weight between about 10,000 and about 350,000, more preferably between about 50,000 and about 300,000, more preferably between about 80,000 and about 200,000, and most preferably between about 10,000 and about 150,000. Examples of suitable syndiotactic 1,2-polybutadienes having crystallinity suitable for use in golf balls are sold under the trade names RB810, RB820, and RB830 by JSR Corporation of Tokyo, Japan. These have more than 90% of 1,2 bonds, a mean molecular weight of approximately 120,000, and crystallinity between about 15% and about 30%.

Examples of olefinic thermoplastic elastomers include metallocene-catalyzed polyolefins, ethylene-octene copolymer, ethylene-butene copolymer, and ethylene-propylene copolymers all with or without controlled tacticity as well as blends of polyolefins having ethyl-propylene-non-conjugated diene terpolymer, rubber-based copolymer, and dynamically vulcanized rubber-based copolymer. Examples of these include products sold under the trade names SANTOPRENE, DYTRON, VISAFLEX, and VYRAM by Advanced Elastomeric Systems of Houston, Texas, and SARLINK by DSM of Haarlen, the Netherlands.

Examples of rubber-based thermoplastic elastomers include multiblock rubber-based copolymers, particularly those in which the rubber block component is based on butadiene, isoprene, or ethylene/butylene. The non-rubber repeating units of the copolymer may be derived from any suitable monomers, including meth (acrylate) esters, such as methyl methacrylate and cyclohexylmethacrylate, and vinyl arylenes, such as styrene. Examples of styrenic copolymers are resins manufactured by Kraton Polymers (formerly of Shell Chemicals) under the trade names KRATON D (for styrene-butadiene-styrene and styrene-isoprene-styrene types) and KRATON G (for styrene-ethylene-butylene-styrene and styrene-ethylene-propylene-styrene types) and Kuraray under the trade name SEPTON. Examples of randomly distributed styrenic polymers include paramethylstyrene-isobutylene (isobutene) copolymers developed by ExxonMobil Chemical Corporation and styrene-butadiene random copolymers developed by Chevron Phillips Chemical Corp.

Examples of copolyester thermoplastic elastomers include polyether ester block copolymers, polylactone ester block copolymers, and aliphatic and aromatic dicarboxylic acid copolymerized polyesters. Polyether ester block copolymers are copolymers comprising polyester hard segments polymerized from a dicarboxylic acid and a low molecular weight diol, and polyether soft segments polymerized from an alkylene glycol having 2 to 10 atoms. Polylactone ester block copolymers are copolymers having polylactone chains instead of polyether as the soft segments discussed above for polyether ester block copolymers. Aliphatic and aromatic dicarboxylic copolymerized polyesters are copolymers of an acid component selected from aromatic dicarboxylic acids, such as terephthalic acid and isophthalic acid, and aliphatic acids having 2 to 10 carbon atoms with at least one diol component, selected from aliphatic and alicyclic diols having 2 to 10 carbon atoms. Blends of aromatic polyester and aliphatic polyester also may be used for these. Examples of these include products marketed under the trade names HYTREL by E.I. DuPont de Nemours & Company, and SKYPEL by S.K. Chemicals of Seoul, South Korea.

Examples of other thermoplastic elastomers suitable as additional polymer components include those having functional groups, such as carboxylic acid, maleic anhydride, glycidyl, norbornene, and hydroxyl functionalities. An example of these includes a block polymer having at least one polymer block A comprising an aromatic vinyl compound and at least one polymer block B comprising a conjugated diene compound, and having a hydroxyl group at the terminal block copolymer, or its hydrogenated product. An example of this polymer is sold under the trade name SEPTON HG-252 by Kuraray Company of Kurashiki, Japan. Other examples of these include: maleic anhydride functionalized triblock copolymer consisting of polystyrene end blocks and poly (ethylene/butylene), sold under the trade name KRATON FG 1901X by Shell Chemical Company; maleic anhydride modified ethylene-vinyl acetate copolymer, sold under the trade name FUSABOND by E.I. DuPont de Nemours & Company; ethylene-isobutyl acrylate-methacrylic acid terpolymer, sold under the trade name NUCREL by E.I. DuPont de Nemours & Company; ethylene-ethyl acrylate-methacrylic anhydride terpolymer, sold under the trade name BONDINE AX 8390 and 8060 by Sumitomo Chemical Industries; brominated styrene-isobutylene copolymers sold under the trade name BROMO XP-50 by Exxon Mobil Corporation; and resins having glycidyl or maleic anhydride functional groups sold under the trade name LOTADER by Elf Atochem of Puteaux, France.

Another example of a polymer for making any of the mantle layers or cover layer is blend of a polyamide (which may be a polyamide as described above) with a functional polymer modifier of the polyamide. The functional polymer modifier of the polyamide can include copolymers or terpolymers having a glycidyl group, hydroxyl group, maleic anhydride group or carboxylic group, collectively referred to as functionalized polymers. These copolymers and terpolymers may comprise an α-olefin. Examples of suitable α-olefins include ethylene, propylene, 1-butene, 1-pentene, 3-methyl-1-butene, 1-hexene, 4-methyl-1-petene, 3-methyl-1-pentene, 1-octene, 1-decene-, 1-dodecene, 1-tetradecene, 1-hexadecene, 1-octadecene, 1-eicocene, 1-dococene, 1-tetracocene, 1-hexacocene, 1-octacocene, and 1-triacontene. One or more of these α-olefins may be used.

Examples of suitable glycidyl groups in copolymers or terpolymers in the polymeric modifier include esters and ethers of aliphatic glycidyl, such as allylglycidylether, vinylglycidylether, glycidyl maleate and itaconatem glycidyl acrylate and methacrylate, and also alicyclic glycidyl esters and ethers, such as 2-cyclohexene-1-glycidylether, cyclohexene-4,5 diglyxidylcarboxylate, cyclohexene-4-glycidyl carboxylate, 5-norboenene-2-methyl-2-glycidyl carboxylate, and endocis-bicyclo (2,2,1)-5-heptene-2,3-diglycidyl dicarboxylate. These polymers having a glycidyl group may comprise other monomers, such as esters of unsaturated carboxylic acid, for example, alkyl (meth)acrylates or vinyl esters of unsaturated carboxylic acids. Polymers having a glycidyl group can be obtained by copolymerization or graft polymerization with homopolymers or copolymers.

Examples of suitable terpolymers having a glycidyl group include LOTADER AX8900 and AX8920, marketed by Atofina Chemicals, ELVALOY marketed by E.I. Du Pont de Nemours & Co., and REXPEARL marketed by Nippon Petrochemicals Co., Ltd. Additional examples of copolymers comprising epoxy monomers and which are suitable for use within the scope of the present invention include styrene-butadiene-styrene block copolymers in which the polybutadiene block contains epoxy group, and styrene-isoprene-styrene block copolymers in which the polyisoprene block contains epoxy. Commercially available examples of these epoxy functional copolymers include ESBS A1005, ESBS A1010, ESBS A1020, ESBS AT018, and ESBS AT019, marketed by Daicel Chemical Industries, Ltd.

Examples of polymers or terpolymers incorporating a maleic anhydride group suitable for use within the scope of the present invention include maleic anhydride-modified ethylene-propylene copolymers, maleic anhydride-modified ethylene-propylene-diene terpolymers, maleic anhydride-modified polyethylenes, maleic anhydride-modified polypropylenes, ethylene-ethylacrylate-maleic anhydride terpolymers, and maleic anhydride-indene-styrene-cumarone polymers. Examples of commercially available copolymers incorporating maleic anhydride include: BONDINE, marketed by Sumitomo Chemical Co., such as BONDINE AX8390, an ethylene-ethyl acrylate-maleic anhydride terpolymer having a combined ethylene acrylate and maleic anhydride content of 32% by weight, and BONDINE TX TX8030, an ethylene-ethyl acrylate-maleic anhydride terpolymer having a combined ethylene acrylate and maleic anhydride content of 15% by weight and a maleic anhydride content of 1% to 4% by weight; maleic anhydride-containing LOTADER 3200, 3210, 6200, 8200, 3300, 3400, 3410, 7500, 5500, 4720, and 4700, marketed by Atofina Chemicals; EXXELOR VA1803, a maleic anhydride-modified ethylene-propylene copolymer having a maleic anhydride content of 0.7% by weight, marketed by Exxon Chemical Co.; and KRATON FG 1901X, a maleic anhydride functionalized triblock copolymer having polystyrene endblocks and poly (ethylene/butylene) midblocks, marketed by Shell Chemical.

Preferably the functional polymer component for blending with a polyamide is a maleic anhydride grafted polymers preferably maleic anhydride grafted polyolefins (for example, Exxellor VA1803).

Styrenic block copolymers are copolymers of styrene with butadiene, isoprene, or a mixture of the two. Additional unsaturated monomers may be added to the structure of the styrenic block copolymer as needed for property modification of the resulting SBC/urethane copolymer. The styrenic block copolymer can be a diblock or a triblock styrenic polymer. Examples of such styrenic block copolymers are described in, for example, U.S. Pat. No. 5,436,295 to Nishikawa et al. The styrenic block copolymer can have any known molecular weight for such polymers, and it can possess a linear, branched, star, dendrimeric or combination molecular structure. The styrenic block copolymer can be unmodified by functional groups, or it can be modified by hydroxyl group, carboxyl group, or other functional groups, either in its chain structure or at one or more terminus. The styrenic block copolymer can be obtained using any common process for manufacture of such polymers. The styrenic block copolymers also may be hydrogenated using well-known methods to obtain a partially or fully saturated diene monomer block.

Other preferred materials suitable for use as additional polymers in the presently disclosed compositions include polyester thermoplastic elastomers marketed under the tradename SKYPEL™ by SK Chemicals of South Korea, or diblock or triblock copolymers marketed under the tradename SEPTON™ by Kuraray Corporation of Kurashiki, Japan, and KRATON™ by Kraton Polymers Group of Companies of Chester, United Kingdom. For example, SEPTON HG 252 is a triblock copolymer, which has polystyrene end blocks and a hydrogenated polyisoprene midblock and has hydroxyl groups at the end of the polystyrene blocks. HG-252 is commercially available from Kuraray America Inc. (Houston, Texas).

Additional other polymer components include polyalkenamers as described, for example, in US-2006-0166762-A1, which is incorporated herein by reference in its entirety. Examples of suitable polyalkenamer rubbers are polypentenamer rubber, polyheptenamer rubber, polyoctenamer rubber, polydecenamer rubber and polydodecenamer rubber. For further details concerning polyalkenamer rubber, see *Rubber Chem. & Tech.*, Vol. 47, page 511-596, 1974, which is incorporated herein by reference. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring.

If a polyalkenamer rubber is present, the polyalkenamer rubber preferably contains from about 50 to about 99, preferably from about 60 to about 99, more preferably from about 65 to about 99, even more preferably from about 70 to about 90 percent of its double bonds in the trans-configuration. The preferred form of the polyalkenamer has a trans content of approximately 80%, however, compounds having other ratios of the cis- and trans-isomeric forms of the polyalkenamer can also be obtained by blending available products for use in making the composition.

The polyalkenamer rubber has a molecular weight (as measured by GPC) from about 10,000 to about 300,000, preferably from about 20,000 to about 250,000, more preferably from about 30,000 to about 200,000, even more preferably from about 50,000 to about 150,000.

The polyalkenamer rubber has a degree of crystallization (as measured by DSC secondary fusion) from about 5 to about 70, preferably from about 6 to about 50, more preferably from about from 6.5 to about 50%, even more preferably from about from 7 to about 45%.

More preferably, the polyalkenamer rubber is a polymer prepared by polymerization of cyclooctene to form a trans-polyoctenamer rubber as a mixture of linear and cyclic macromolecules.

A further example of a polymer is a specialty propylene elastomer as described, for example, in US 2007/0238552 A1, and incorporated herein by reference in its entirety. A specialty propylene elastomer includes a thermoplastic propylene-ethylene copolymer composed of a majority amount of propylene and a minority amount of ethylene. These copolymers have at least partial crystallinity due to adjacent isotactic propylene units. Although not bound by any theory, it is believed that the crystalline segments are physical crosslinking sites at room temperature, and at high temperature (i.e., about the melting point), the physical crosslinking is removed and the copolymer is easy to process. According to one embodiment, a specialty propylene elastomer includes at least about 50 mole % propylene co-monomer. Specialty propylene elastomers can also include functional groups such as maleic anhydride, glycidyl, hydroxyl, and/or carboxylic acid. Suitable specialty propylene elastomers include propylene-ethylene copolymers produced in the presence of a metallocene catalyst. More specific examples of specialty propylene elastomers are illustrated below. Specialty propylene elastomers are commercially available under the tradename VISTAMAXX from ExxonMobil Chemical.

Another example of an additional polymer component includes the thermoplastic polyurethanes, which are the reaction product of a diol or polyol and an isocyanate, with or without a chain extender. Isocyanates used for making the urethanes encompass diisocyanates and polyisocyanates. Examples of suitable isocyanates include the following: trimethylene diisocyanate, tetramethylene diisocyanate, pentamethylene diisocyanate, hexamethylene diisocyanate, ethylene diisocyanate, diethylidene diisocyanate, propylene diisocyanate, butylene diisocyanate, bitolylene diisocyanate, tolidine isocyanate, isophorone diisocyanate, dimeryl diisocyanate, dodecane-1,12-diisocyanate, 1,10-decamethylene diisocyanate, cyclohexylene-1,2-diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis (phenyl isocyanate), 1-methyl-2,4-cyclohexane diisocyanate, 1-methyl-2,6-cyclohexane diisocyanate, 1,3-bis(isocyanato-methyl) cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclohexyl isocyanate, dicyclohexylmethane 4,4'-diisocyanate, 1,4-bis(isocyanatomethyl) cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianisidine diisocyanate, 4,4'-diphenyl ether diisocyanate, 1, 3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω,ω'-diisocyanato-1,4-diethylbenzene, polymethylene polyphenylene polyisocyanate, polybutylene diisocyanate, isocyanurate modified compounds, and carbodiimide modified compounds, as well as biuret modified compounds of the above polyisocyanates. Each isocyanate may be used either alone or in combination with one or more other isocyanates. These isocyanate mixtures can include triisocyanates, such as biuret of hexamethylene diisocyanate and triphenylmethane triisocyanate, and polyisocyanates, such as polymeric diphenylmethane diisocyanate.

Polyols used for making the polyurethane in the copolymer include polyester polyols, polyether polyols, polycarbonate polyols and polybutadiene polyols. Polyester polyols are prepared by condensation or step-growth polymerization utilizing diacids. Primary diacids for polyester polyols are adipic acid and isomeric phthalic acids. Adipic acid is used for materials requiring added flexibility, whereas phthalic anhydride is used for those requiring rigidity. Some examples of polyester polyols include poly (ethylene adipate) (PEA), poly (diethylene adipate) (PDA), poly (propylene adipate) (PPA), poly (tetramethylene adipate) (PBA), poly (hexamethylene adipate) (PHA), poly (neopentylene adipate) (PNA), polyols composed of 3-methyl-1,5-pentanediol and adipic acid, random copolymer of PEA and PDA, random copolymer of PEA and PPA, random copolymer of PEA and PBA, random copolymer of PHA and PNA, caprolactone polyol obtained by the ring-opening polymerization of ε-caprolactone, and polyol obtained by opening the ring of β-methyl-8-valerolactone with ethylene glycol can be used either alone or in a combination thereof. Additionally, polyester polyol may be composed of a copolymer of at least one of the following acids and at least one of the following glycols. The acids include terephthalic acid, isophthalic acid, phthalic anhydride, oxalic acid, malonic acid, succinic acid, pentanedioic acid, hexanedioic acid, octanedioic acid, nonanedioic acid, adipic acid, azelaic acid, sebacic acid, dodecanedioic acid, dimer acid (a mixture), p-hydroxybenzoate, trimellitic anhydride, ε-caprolactone, and β-methyl-8-valerolactone. The glycols include ethylene glycol, propylene glycol, butylene glycol, pentylene glycol, 1,4-butanediol, 1,5-pentanediol, 1,6-hexanediol, neopentylene glycol, polyethylene glycol, polytetramethylene glycol, 1,4-cyclohexane dimethanol, pentaerythritol, and 3-methyl-1,5-pentanediol.

Polyether polyols are prepared by the ring-opening addition polymerization of an alkylene oxide (e.g. ethylene oxide and propylene oxide) with an initiator of a polyhydric alcohol (e.g. diethylene glycol), which is an active hydride. Specifically, polypropylene glycol (PPG), polyethylene glycol (PEG) or propylene oxide-ethylene oxide copolymer can be obtained. Polytetramethylene ether glycol (PTMG) is prepared by the ring-opening polymerization of tetrahydrofuran, produced by dehydration of 1,4-butanediol or hydrogenation of furan. Tetrahydrofuran can form a copolymer with alkylene oxide. Specifically, tetrahydrofuran-propylene oxide copolymer or tetrahydrofuran-ethylene oxide copolymer can be formed. A polyether polyol may be used either alone or in a mixture.

Polycarbonate polyol is obtained by the condensation of a known polyol (polyhydric alcohol) with phosgene, chloroformic acid ester, dialkyl carbonate or diallyl carbonate. A particularly preferred polycarbonate polyol contains a polyol component using 1,6-hexanediol, 1,4-butanediol, 1,3-butanediol, neopentylglycol or 1,5-pentanediol. A polycarbonate polyol can be used either alone or in a mixture.

Polybutadiene polyol includes liquid diene polymer containing hydroxyl groups, and an average of at least 1.7 functional groups, and may be composed of diene polymer or diene copolymer having 4 to 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant. A polybutadiene polyol can be used either alone or in a mixture.

As stated above, the urethane also may incorporate chain extenders. Non-limiting examples of these extenders include polyols, polyamine compounds, and mixtures of these. Polyol extenders may be primary, secondary, or tertiary polyols. Specific examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol.

Suitable polyamines that may be used as chain extenders include primary, secondary and tertiary amines; polyamines have two or more amines as functional groups. Examples of these include: aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as 4,4'-methylene bis-2-chloroaniline, 2,2', 3,3'-tetrachloro-4,4'-diaminophenyl methane, p,p'-methylenedianiline, p-phenylenediamine or 4,4'-diaminodiphenyl; and 2,4,6-tris (dimethylaminomethyl) phenol. Aromatic diamines have a tendency to provide a stiffer product than aliphatic or cycloaliphatic diamines. A chain extender may be used either alone or in a mixture.

Polyurethanes or polyureas typically are prepared by reacting a diisocyanate with a polyol (in the case of polyurethanes) or with a polyamine (in the case of a polyurea). Thermoplastic polyurethanes or polyureas may consist solely of this initial mixture or may be further combined with a chain extender to vary properties such as hardness of the thermoplastic. Thermoset polyurethanes or polyureas typically are formed by the reaction of a diisocyanate and a polyol or polyamine respectively, and an additional crosslinking agent to crosslink or cure the material to result in a thermoset.

In what is known as a one-shot process, the three reactants, diisocyanate, polyol or polyamine, and optionally a chain extender or a curing agent, are combined in one step. Alternatively, a two-step process may occur in which the first step involves reacting the diisocyanate and the polyol (in the case of polyurethane) or the polyamine (in the case of a polyurea) to form a so-called prepolymer, to which can then be added either the chain extender or the curing agent. This procedure is known as the prepolymer process.

In addition, although depicted as discrete component packages as above, it is also possible to control the degree of crosslinking, and hence the degree of thermoplastic or thermoset properties in a final composition, by varying the stoichiometry not only of the diisocyanate-to-chain extender or curing agent ratio, but also the initial diisocyanate-to-polyol or polyamine ratio. Of course in the prepolymer process, the initial diisocyanate-to-polyol or polyamine ratio is fixed on selection of the required prepolymer.

Finally, in addition to discrete thermoplastic or thermoset materials, it also is possible to modify a thermoplastic polyurethane or polyurea composition by introducing materials in the composition that undergo subsequent curing after molding the thermoplastic to provide properties similar to those of a thermoset. For example, Kim in U.S. Pat. No. 6,924,337, the entire contents of which are hereby incorporated by reference, discloses a thermoplastic urethane or urea composition optionally comprising chain extenders and further comprising a peroxide or peroxide mixture, which can then undergo post curing to result in a thermoset.

Also, Kim et al. in U.S. Pat. No. 6,939,924, the entire contents of which are hereby incorporated by reference, discloses a thermoplastic urethane or urea composition, optionally also comprising chain extenders, that is prepared from a diisocyanate and a modified or blocked diisocyanate which unblocks and induces further cross-linking post extrusion. The modified isocyanate preferably is selected from the group consisting of: isophorone diisocyanate (IPDI)-based uretdione-type crosslinker; a combination of a uretdione adduct of IPDI and a partially e-caprolactam-modified IPDI; a combination of isocyanate adducts modified by e-caprolactam and a carboxylic acid functional group; a caprolactam-modified Desmodur diisocyanate; a Desmodur diisocyanate having a 3,5-dimethyl pyrazole modified isocyanate; or mixtures of these.

Finally, Kim et al. in U.S. Pat. No. 7,037,985 B2, the entire contents of which are hereby incorporated by reference, discloses thermoplastic urethane or urea compositions further comprising a reaction product of a nitroso compound and a diisocyanate or a polyisocyanate. The nitroso reaction product has a characteristic temperature at which it decomposes to regenerate the nitroso compound and diisocyanate or polyisocyanate. Thus, by judicious choice of the post-processing temperature, further crosslinking can be induced in the originally thermoplastic composition to provide thermoset-like properties.

Any isocyanate available to one of ordinary skill in the art is suitable for use according to the invention. Isocyanates for use with the present invention include, but are not limited to, aliphatic, cycloaliphatic, aromatic aliphatic, aromatic, any derivatives thereof, and combinations of these compounds having two or more isocyanate (NCO) groups per molecule. As used herein, aromatic aliphatic compounds should be understood as those containing an aromatic ring, wherein the isocyanate group is not directly bonded to the ring. One example of an aromatic aliphatic compound is a tetramethylene diisocyanate (TMXDI). The isocyanates may be organic polyisocyanate-terminated prepolymers, low free isocyanate prepolymer, and mixtures thereof. The isocyanate-containing reactable component also may include any isocyanate-functional monomer, dimer, trimer, or polymeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R preferably is a cyclic, aromatic, or linear or branched hydrocarbon moiety containing from about 1 to about 50 carbon atoms. The isocyanate also may contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of isocyanates that can be used with the present invention include, but are not limited to, substituted and isomeric mixtures including 2,2'-, 2,4'-, and 4,4'-diphenylmethane diisocyanate (MDI); 3,3'-dimethyl-4,4'-biphenylene diisocyanate (TODI); toluene diisocyanate (TDI); polymeric MDI; carbodiimide-modified liquid 4,4'-diphenylmethane diisocyanate; para-phenylene diisocyanate (PPDI); meta-phenylene diisocyanate (MPDI); triphenyl methane-4,4'- and triphenyl methane-4,4"-triisocyanate; naphthylene-1,5-diisocyanate; 2,4'-, 4,4'-, and 2,2-biphenyl diisocyanate; polyphenylene polymethylene polyisocyanate (PMDI) (also known as polymeric PMDI); mixtures of MDI and PMDI; mixtures of PMDI and TDI; ethylene diisocyanate; propylene-1,2-diisocyanate; trimethylene diisocyanate; butylenes diisocyanate; bitolylene diisocyanate; toluidine diisocyanate; tetramethylene-1,2-diisocyanate; tetramethylene-1,3-diisocyanate; tetramethylene-1,4-diisocyanate; pentamethylene diisocyanate; 1,6-hexamethylene diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; diethylidene diisocyanate; methylcyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis (isocyanatomethyl) dicyclohexane; isophorone diisocyanate (IPDI); dimeryl diisocyanate, dodecane-1,12-diisocyanate, 1,10-decamethylene diisocyanate, cyclohexylene-1,2-diisocyanate, 1,10-decamethylene diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3-cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis (phenyl isocyanate), 1-methyl-2,4-cyclohexane diisocyanate, 1-methyl-2,6-cyclohexane diisocyanate, 1,3-bis (isocyanato-methyl) cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclo-hexyl isocyanate, 1-isocyanato-3,3,5-trimethyl-5-isocyanatomethylcyclohexane, cyclohexyl isocyanate, dicyclohexylmethane 4,4'-diisocyanate, 1,4-bis(isocyanatomethyl) cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianidine diisocyanate, 4,4'-diphenyl ether diisocyanate, 1, 3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω, ω'-diisocyanato-1,4-diethylbenzene, polymethylene polyphenylene polyisocyanate, isocyanurate modified compounds, and carbodiimide modified compounds, as well as biuret modified compounds of the above polyisocyanates. These isocyanates may be used either alone or in combination. These combination isocyanates include triisocyanates, such as biuret of hexamethylene diisocyanate and triphenylmethane triisocyanates, and polyisocyanates, such as polymeric diphenylmethane diisocyanate.triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, and mixtures thereof, dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

In view of the advantages of injection molding versus the more complex casting process, under some circumstances it is advantageous to have formulations capable of curing as a thermoset but only within a specified temperature range above that of the typical injection molding process. This allows parts, such as golf ball cover layers, to be initially injection molded, followed by subsequent processing at higher temperatures and pressures to induce further crosslinking and curing, resulting in thermoset properties in the final part. Such an initially injection moldable composition is thus called a post curable urethane or urea composition.

If a post curable urethane composition is required, a modified or blocked diisocyanate which subsequently unblocks and induces further cross-linking post extrusion may be included in the diisocyanate starting material. Modified isocyanates used for making the polyurethanes of the present invention generally are defined as chemical compounds containing isocyanate groups that are not reactive at room temperature, but that become reactive once they reach a characteristic temperature. The resulting isocyanates can act as crosslinking agents or chain extenders to form crosslinked polyurethanes. The degree of crosslinking is governed by type and concentration of modified isocyanate presented in the composition. The modified isocyanate used in the composition preferably is selected, in part, to have a characteristic temperature sufficiently high such that the urethane in the composition will retain its thermoplastic behavior during initial processing (such as injection molding). If a characteristic temperature is too low, the composition crosslinks before processing is completed, leading to process difficulties. The modified isocyanate preferably is selected from isophorone diisocyanate (IPDI)-based uretdione-type crosslinker; a combination of a uretdione adduct of IPDI and a partially e-caprolactam-modified IPDI; a combination of isocyanate adducts modified by e-caprolactam and a carboxylic acid functional group; a caprolactam-modified Desmodur diisocyanate; a Desmodur diisocyanate having a 3,5-dimethyl pyrazole modified isocyanate; or mixtures of these. Particular preferred examples of modified isocyanates include those marketed under the trade name CRELAN by Bayer Corporation. Examples of these include: CRELAN TP LS 2147; CRELAN NI 2; isophorone diisocyanate (IPDI)-based uretdione-type crosslinker, such as CRELAN VP LS 2347; a combination of a uretdione adduct of IPDI and a partially e-caprolactam-modified IPDI, such as CRELAN VP LS 2386; a combination of isocyanate adducts modified by e-caprolactam and a carboxylic acid functional group, such as CRELAN VP LS 2181/1; a caprolactam-modified Desmodur diisocyanate, such as CRELAN NW5; and a Desmodur diisocyanate having a 3,5-dimethyl pyrazole modified isocyanate, such as CRELAN XP 7180. These modified isocyanates may be used either alone or in combination. Such modified diisocyanates are described in more detail in U.S. Pat. No. 6,939,924, the entire contents of which are hereby incorporated by reference.

As an alternative if a post curable polyurethane or polyurea composition is required, the diisocyanate may further comprise reaction product of a nitroso compound and a diisocyanate or a polyisocyanate. The reaction product has a characteristic temperature at which it decomposes regenerating the nitroso compound and diisocyanate or polyisocyanate, which can, by judicious choice of the post processing temperature, in turn induce further crosslinking in the originally thermoplastic composition resulting in thermoset-like properties. Such nitroso compounds are described in more detail in U.S. Pat. No. 7,037,985 B2, the entire contents of which are hereby incorporated by reference.

Any polyol now known or hereafter developed is suitable for use according to the invention. Polyols suitable for use in the present invention include, but are not limited to, polyester polyols, polyether polyols, polycarbonate polyols and polydiene polyols such as polybutadiene polyols.

Polyester polyols are prepared by condensation or step-growth polymerization utilizing diacids. Primary diacids for polyester polyols are adipic acid and isomeric phthalic acids. Adipic acid is used for materials requiring added flexibility, whereas phthalic anhydride is used for those requiring rigidity. Some examples of polyester polyols include poly (ethylene adipate) (PEA), poly (diethylene adipate) (PDA), poly (propylene adipate) (PPA), poly (tetramethylene adipate) (PBA), poly (hexamethylene adipate) (PHA), poly (neopentylene adipate) (PNA), polyols composed of 3-methyl-1,5-pentanediol and adipic acid, random copolymer of PEA and PDA, random copolymer of PEA and PPA, random copolymer of PEA and PBA, random copolymer of PHA and PNA, caprolactone polyol obtained by the ring-opening polymerization of ε-caprolactone, and polyol obtained by opening the ring of β-methyl-δ-valerolactone with ethylene glycol can be used either alone or in a combination thereof. Additionally, polyester polyol may be composed of a copolymer of at least one of the following acids and at least one of the following glycols. The acids include terephthalic acid, isophthalic acid, phthalic anhydride, oxalic acid, malonic acid, succinic acid, pentanedioic acid, hexanedioic acid, octanedioic acid, nonanedioic acid, adipic acid, azelaic acid, sebacic acid, dodecanedioic acid, dimer acid (a mixture), ρ-hydroxybenzoate, trimellitic anhydride, ε-caprolactone, and β-methyl-δ-valerolactone. The glycols includes ethylene glycol, propylene glycol, butylene glycol, pentylene glycol, 1,4-butanediol, 1,5-pentanediol, 1,6-hexanediol, neopentylene glycol, polyethylene glycol, polytetramethylene glycol, 1,4-cyclohexane dimethanol, pentaerythritol, and 3-methyl-1,5-pentanediol.

Polyether polyols are prepared by the ring-opening addition polymerization of an alkylene oxide (e.g. ethylene oxide and propylene oxide) with an initiator of a polyhydric alcohol (e.g. diethylene glycol), which is an active hydride. Specifically, polypropylene glycol (PPG), polyethylene glycol (PEG) or propylene oxide-ethylene oxide copolymer can be obtained. Polytetramethylene ether glycol (PTMG) is prepared by the ring-opening polymerization of tetrahydrofuran, produced by dehydration of 1,4-butanediol or hydrogenation of furan. Tetrahydrofuran can form a copolymer with alkylene oxide. Specifically, tetrahydrofuran-propylene oxide copolymer or tetrahydrofuran-ethylene oxide copolymer can be formed. The polyether polyol may be used either alone or in a combination.

Polycarbonate polyol is obtained by the condensation of a known polyol (polyhydric alcohol) with phosgene, chloroformic acid ester, dialkyl carbonate or diallyl carbonate. Particularly preferred polycarbonate polyols contain a polyol component using 1,6-hexanediol, 1,4-butanediol, 1,3-butanediol, neopentylglycol or 1,5-pentanediol. Polycarbonate polyols can be used either alone or in a combination with other polyols.

Polydiene polyols include liquid diene polymer containing hydroxyl groups having an average of at least 1.7 functional groups, and may comprise diene polymers or diene copolymers having from about 4 to about 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant.

Polybutadiene polyol includes liquid diene polymer containing hydroxyl groups having an average of at least 1.7 functional groups, and may be composed of diene polymer or diene copolymer having 4 to 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant Any polyamine available to one of ordinary skill in the polyurethane art is suitable for use according to the disclosure herein. Polyamines suitable for use include, but are not limited to, amine-terminated compounds typically are selected from amine-terminated hydrocarbons, amine-terminated polyethers, amine-terminated polyesters, amine-terminated polycaprolactones, amine-terminated polycarbonates, amine-terminated polyamides, and mixtures thereof. The amine-terminated compound may be a polyether amine selected from polytetramethylene ether diamines, polyoxypropylene diamines, poly (ethylene oxide capped oxypropylene) ether diamines, triethyleneglycoldiamines, propylene oxide-based triamines, trimethylolpropane-based triamines, glycerin-based triamines, and mixtures thereof.

Diisocyanate and polyol or polyamine components may be combined to form a prepolymer prior to reaction with a chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

In one embodiment, the number of free NCO groups in the urethane or urea prepolymer may be less than about 14 percent. Preferably the urethane or urea prepolymer has from about 3 percent to about 11 percent, more preferably from about 4 to about 9.5 percent, and even more preferably from about 3 percent to about 9 percent, free NCO on an equivalent weight basis.

Polyol chain extenders or curing agents may be primary, secondary, or tertiary polyols. Non-limiting examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol.

Diamines and other suitable polyamines may be added to the compositions to function as chain extenders or curing agents. These include primary, secondary and tertiary amines having two or more amines as functional groups. Exemplary diamines include aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis (2-hydroxypropyl) ethylenediamine, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, 4,4'-methylene bis-2-chloroaniline, 2,2', 3,3'-tetrachloro-4,4'-diamino-phenyl methane, p,p'-methylenedianiline, p-phenylenediamine or 4,4'-diaminodiphenyl; and 2,4,6-tris (dimethylaminomethyl) phenol.

Further examples include ethylene diamine; 1-methyl-2,6-cyclohexyl diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol bis-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-(bis-propylamine); monoethanolamine, diethanolamine; triethanolamine; monoisopropanolamine, diisopropanolamine; isophoronediamine; and mixtures thereof.

Aromatic diamines have a tendency to provide a stiffer (i.e., having a higher Mooney viscosity) product than aliphatic or cycloaliphatic diamines.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1. (the contents of all of which are hereby incorporated herein by reference), slow-reacting polyamines are diamines having amine groups that are sterically and/or electronically hindered by electron withdrawing groups or bulky groups situated proximate to the amine reaction sites. The spacing of the amine reaction sites will also affect the reactivity speed of the polyamines.

Suitable curatives for use in the present invention are selected from the slow-reacting polyamine group include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP.

When slow-reacting polyamines are used as the curing agent to produce urethane elastomers, a catalyst is typically needed to promote the reaction between the urethane prepolymer and the curing agent. Specific suitable catalysts include TEDA (1) dissolved in di-propylene glycol (such as TEDA L33 available from Witco Corp. Greenwich, Conn., and DABCO 33 LV available from Air Products and Chemicals Inc.). Catalysts are added at suitable effective amounts, such as from about 2% to about 5%, and (2) more preferably TEDA dissolved in 1,4-butane diol from about 2% to about 5%. Another suitable catalyst includes a blend of 0.5% 33LV or TEDA L33 (above) with 0.1% dibutyl tin dilaurate (available from Witco Corp. or Air Products and Chemicals, Inc.) which is added to a curative such as VIBRACURE® A250. Unfortunately, as is well known in the art, the use of a catalyst can have a significant effect on the ability to control the reaction and thus, on the overall processability.

To eliminate the need for a catalyst, a fast-reacting curing agent, or agents, can be used that does not have electron withdrawing groups or bulky groups that interfere with the reaction groups. However, the problem with lack of control associated with the use of catalysts is not completely eliminated since fast-reacting curing agents also are relatively difficult to control.

Preferred curing agent blends include using dicyandiamide in combination with fast curing agents such as diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis (2-hydroxypropyl) ethylenediamine and Curalon L, a trade name for a mixture of aromatic diamines sold by Uniroyal, Inc. or any and all combinations thereof. A preferred fast-reacting curing agent is diethyl-2,4-toluene diamine, which has two commercial grades names, Ethacure® 100 and Ethacure® 100LC commercial grade has lower color and less by-product. In other words, it is considered a cleaner product to those skilled in the art.

Advantageously, the use of the Ethacure® 100LC commercial grade results in a golf ball that is less susceptible to yellowing when exposed to UV light conditions. A player appreciates this desirable aesthetic effect although it should be noted that the instant invention may use either of these two commercial grades for the curing agent diethyl-2,4-toluenediamine.

If a reduced-yellowing post curable composition is required, the chain extender or curing agent can further comprise a peroxide or peroxide mixture. Before the composition is exposed to sufficient thermal energy to reach the activation temperature of the peroxide, the composition of (a) and (b) behaves as a thermoplastic material. Therefore, it can readily be formed into golf ball layers using injection molding. However, when sufficient thermal energy is applied to bring the composition above the peroxide activation temperature, crosslinking occurs, and the thermoplastic polyurethane is converted into crosslinked polyurethane.

Examples of suitable peroxides for use in compositions within the scope of the present invention include aliphatic peroxides, aromatic peroxides, cyclic peroxides, or mixtures of these. Primary, secondary, or tertiary peroxides can be used, with tertiary peroxides most preferred. Also, peroxides containing more than one peroxy group can be used, such as 2,5-bis-(tert-butylperoxy)-2,5-dimethyl hexane and 1,4-bis-(tert-butylperoxy-isopropyl)-benzene. Also, peroxides that are either symmetrical or asymmetric can be used, such as tert-butylperbenzoate and tert-butylcumylperoxide. Additionally, peroxides having carboxy groups also can be used. Decomposition of peroxides used in compositions within the scope of the present invention can be brought about by applying thermal energy, shear, reactions with other chemical ingredients, or a combination of these. Homolytically decomposed peroxide, heterolytically decomposed peroxide, or a mixture of those can be used to promote crosslinking reactions in compositions within the scope of this invention. Examples of suitable aliphatic peroxides and aromatic peroxides include diacetylperoxide, di-tert-butylperoxide, dibenzoylperoxide, dicumylperoxide, 2,5-bis-(t-butylperoxy)-2,5-dimethyl hexane, 2,5-dimethyl-2,5-di (benzoylperoxy) hexane, 2,5-dimethyl-2,5-di (butylperoxy)-3-hexyne, n-butyl-4,4-bis (t-butylperoxyl) valerate, 1,4-bis-(t-butylperoxyisopropyl)-benzene, t-butyl peroxybenzoate, 1,1-bis-(t-butylperoxy)-3,3,5 tri-methylcyclohexane, and di (2,4-dichloro-benzoyl). Peroxides for use within the scope of this invention may be acquired from Akzo Nobel Polymer Chemicals of Chicago, Illinois, Atofina of Philadelphia, Pennsylvania and Akrochem of Akron, Ohio. Further details of this post curable system are disclosed in U.S. Pat. No. 6,924,337, the entire contents of which are hereby incorporated by reference.

The core, cover layer and, optionally, one or more inner cover layers of the golf ball may further comprise one or more ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the Lit, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which can be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ $\alpha,\beta$ ethylenically unsaturated carboxylic acid, such as acrylic or methacrylic acid, and is present in an amount from about 0 wt. % to about 50 wt. %, particularly about 2 to about 30 weight %, of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight %, particularly about 5 wt. % to about 35 wt. %, of the E/X/Y copolymer, and wherein the acid groups present in said ionomeric polymer are partially (e.g., about 1% to about 90%) neutralized with a metal selected from the group consisting of lithium, sodium, potassium, magnesium, calcium, barium, lead, tin, zinc or aluminum, or a combination of such cations.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specifically, they include bimodal polymer blend compositions comprising:

a) a high molecular weight component having weight average molecular weight (Mw) of about 80,000 to about 500,000 and comprising one or more ethylene/$\alpha$, $\beta$-ethylenically unsaturated $C_{3-8}$ carboxylic acid copolymers and/or one or more ethylene, alkyl (meth) acrylate, (meth)acrylic acid terpolymers; said high molecular weight component being partially neutralized with metal ions selected from the group consisting of lithium, sodium, zinc, calcium, magnesium, and a mixture of any these; and b) a low molecular weight component having a weight average molecular weight (Mw) of about from about 2,000 to about 30,000 and comprising one or more ethylene/$\alpha$, $\beta$-ethylenically unsaturated $C_{3-8}$ carboxylic acid copolymers and/or one or more ethylene, alkyl (meth)acrylate, (meth)acrylic acid terpolymers; said low molecular weight component being partially neutralized with metal ions selected from the group consisting of lithium, sodium, zinc, calcium, magnesium, and a mixture of any these.

In addition to the unimodal and bimodal ionomers, also included are the so-called "modified ionomers" examples of which are described in U.S. Pat. Nos. 6,100,321, 6,329,458 and 6,616,552 and U.S. Patent Publication No. US 2003/0158312 A1, the entire contents of all of which are herein incorporated by reference.

The modified unimodal ionomers may be prepared by mixing:

a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, zinc, calcium, magnesium, and a mixture of any of these; and b) from about 5 to about 40 weight percent (based on the total weight of said modified ionomeric polymer) of one or more fatty acids or metal salts of said fatty acid, the metal selected from the group consisting of calcium, sodium, zinc, potassium, and lithium, barium and magnesium and the fatty acid preferably being stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing;

a) a high molecular weight component having weight average molecular weight (Mw) of about 80,000 to about 500,000 and comprising one or more ethylene/$\alpha$, $\beta$-ethylenically unsaturated $C_{3-8}$ carboxylic acid copolymers and/or one or more ethylene, alkyl (meth) acrylate, (meth)acrylic acid terpolymers; said high molecular weight component being partially neutralized with metal ions selected from the group consisting of lithium, sodium, zinc, calcium, potassium, magnesium, and a mixture of any of these; and b) a low molecular weight component having a weight average molecular weight (Mw) of about from about 2,000 to about 30,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said low molecular weight component being partially neutralized with metal ions selected from the group consisting of lithium, sodium, zinc, calcium, potassium, magnesium, and a mixture of any of these; and c) from about 5 to about 40 weight percent (based on the total weight of said modified ionomeric polymer) of one or more fatty acids or metal salts of said fatty acid, the metal selected from the group consisting of calcium, sodium, zinc, potassium and lithium, barium and magnesium and the fatty acid preferably being stearic acid.

The fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3$ $(CH_2)_x$ COOH, wherein the carbon atom count includes the carboxyl group. The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($C_{18}$, i.e., $CH_3$ $(CH_2)_{16}$ COOH), palmitic acid ($C_{16}$, i.e., $CH_3$ $(CH_2)_{14}$ COOH), pelargonic acid ($C_9$, i.e., $CH_3$ $(CH_2)_7$ COOH) and lauric acid ($C_{12}$. i.e., $CH_3$ $(CH_2)_{10}$ OCOOH). Examples of suitable unsaturated fatty acids, i.e., a fatty acid in which there are one or more double bonds between the carbon atoms in the alkyl chain, include but are not limited to oleic acid ($C_{13}$, i.e., $CH_3$ $(CH_2)_7$ CH:CH$(CH_2)_7$ COOH).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion.

An example of such a modified ionomer polymer is DuPont® HPF-1000 available from E. I. DuPont de Nemours and Co. Inc.

A preferred ionomer composition may be prepared by blending one or more of the unimodal ionomers, bimodal ionomers, or modified unimodal or bimodal ionomeric polymers as described herein, and further blended with a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 wt. % to about 25, preferably from about 10 to about 25, and most preferably about 10 to about 20 wt. % of the total composition.

In particular embodiment, blends used to make the core, intermediate and/or cover layers may include about 5 to about 95 wt. %, particularly about 5 to about 75 wt. %, preferably about 5 to about 55 wt. %, of a specialty propylene elastomer(s) and about 95 to about 5 wt. %, particularly about 95 to about 25 wt. %, preferably about 95 to about 45 wt. %, of at least one ionomer, especially a high-acid ionomer.

In yet another embodiment, a blend of an ionomer and a block copolymer can be included in the composition. An example of a block copolymer is a functionalized styrenic block copolymer, the block copolymer incorporating a first polymer block having an aromatic vinyl compound, a second polymer block having a conjugated diene compound, and a hydroxyl group located at a block copolymer, or its hydrogenation product, in which the ratio of block copolymer to ionomer ranges from 5:95 to 95:5 by weight, more preferably from about 10:90 to about 90:10 by weight, more preferably from about 20:80 to about 80:20 by weight, more preferably from about 30:70 to about 70:30 by weight and most preferably from about 35:65 to about 65:35 by weight. A preferred block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

In a further embodiment, the core, mantle and/or cover layers (and particularly a mantle layer) can comprise a composition prepared by blending together at least three materials, identified as Components A, B, and C, and melt-processing these components to form in-situ a polymer blend composition incorporating a pseudo-crosslinked polymer network. Such blends are described in more detail in commonly-assigned U.S. Pat. No. 6,930,150, which is incorporated by reference herein in its entirety. Component A is a monomer, oligomer, prepolymer or polymer that incorporates at least five percent by weight of at least one type of an anionic functional group, and more preferably between about 5% and 50% by weight. Component B is a monomer, oligomer, or polymer that incorporates less by weight of anionic functional groups than does Component A, Component B preferably incorporates less than about 25% by weight of anionic functional groups, more preferably less than about 20% by weight, more preferably less than about 10% by weight, and most preferably Component B is free of anionic functional groups. Component C incorporates a metal cation, preferably as a metal salt. The pseudo-crosslinked network structure is formed in-situ, not by covalent bonds, but instead by ionic clustering of the reacted functional groups of Component A. The method can incorporate blending together more than one of any of Components A, B, or C.

The polymer blend can include either Component A or B dispersed in a phase of the other. Preferably, blend compositions comprises between about 1% and about 99% by weight of Component A based on the combined weight of Components A and B, more preferably between about 10% and about 90%, more preferably between about 20% and about 80%, and most preferably, between about 30% and about 70%. Component C is present in a quantity sufficient to produce the preferred amount of reaction of the anionic functional groups of Component A after sufficient melt-processing. Preferably, after melt-processing at least about 5% of the anionic functional groups in the chemical structure of Component A have been consumed, more preferably between about 10% and about 90%, more preferably between about 10% and about 80%, and most preferably between about 10% and about 70%.

The composition preferably is prepared by mixing the above materials into each other thoroughly, either by using a dispersive mixing mechanism, a distributive mixing mechanism, or a combination of these. These mixing methods are well known in the manufacture of polymer blends. As a result of this mixing, the anionic functional group of Component A is dispersed evenly throughout the mixture. Next, reaction is made to take place in-situ at the site of the anionic functional groups of Component A with Component C in the presence of Component B. This reaction is prompted by addition of heat to the mixture. The reaction results in the formation of ionic clusters in Component A and formation of a pseudo-crosslinked structure of Component A in the presence of Component B. Depending upon the structure of Component B, this pseudo-crosslinked Component A can combine with Component B to form a variety of interpenetrating network structures. For example, the materials can form a pseudo-crosslinked network of Component A dispersed in the phase of Component B. or Component B can be dispersed in the phase of the pseudo-crosslinked network of Component A. Component B may or may not also form a network, depending upon its structure, resulting in either: a fully-interpenetrating network, i.e., two independent networks of Components A and B penetrating each other, but not covalently bonded to each other; or, a semi-interpenetrating network of Components A and B, in which Component B forms a linear, grafted, or branched polymer interspersed in the network of Component A. For example, a reactive functional group or an unsaturation in Component B can be reacted to form a crosslinked structure in the presence of the in-situ-formed, pseudo-crosslinked structure of Component A, leading to formation of a fully-interpenetrating network. Any anionic functional groups in Component B also can be reacted with the metal cation of Component C, resulting in pseudo-crosslinking via ionic cluster attraction of Component A to Component B.

The level of in-situ-formed pseudo-crosslinking in the compositions formed by the present methods can be controlled as desired by selection and ratio of Components A and B, amount and type of anionic functional group, amount and type of metal cation in Component C, type and degree of chemical reaction in Component B, and degree of pseudo-crosslinking produced of Components A and B.

As discussed above, the mechanical and thermal properties of the polymer blend for the inner mantle layer and/or the outer mantle layer can be controlled as required by a modifying any of a number of factors, including: chemical structure of Components A and B, particularly the amount and type of anionic functional groups; mean molecular weight and molecular weight distribution of Components A and B; linearity and crystallinity of Components A and B; type of metal cation in Component C; degree of reaction achieved between the anionic functional groups and the metal cation; mix ratio of Component A to Component B; type and degree of chemical reaction in Component B; presence of chemical reaction, such as a crosslinking reaction, between Components A and B; and the particular mixing methods and conditions used.

As discussed above, Component A can be any monomer, oligomer, prepolymer, or polymer incorporating at least 5% by weight of anionic functional groups. Those anionic functional groups can be incorporated into monomeric, oligomeric, prepolymeric, or polymeric structures during the synthesis of Component A, or they can be incorporated into a pre-existing monomer, oligomer, prepolymer, or polymer through sulfonation, phosphonation, or carboxylation to produce Component A.

Preferred, but non-limiting, examples of suitable copolymers and terpolymers include copolymers or terpolymers of: ethylene/acrylic acid, ethylene/methacrylic acid, ethylene/itaconic acid, ethylene/methyl hydrogen maleate, ethylene/maleic acid, ethylene/methacrylic acid/ethylacrylate, ethylene/itaconic acid/methyl methacrylate, ethylene/methyl hydrogen maleate/ethyl acrylate, ethylene/methacrylic acid/vinyl acetate, ethylene/acrylic acid/vinyl alcohol, ethylene/propylene/acrylic acid, ethylene/styrene/acrylic acid, ethylene/methacrylic acid/acrylonitrile, ethylene/fumaric acid/vinyl methyl ether, ethylene/vinyl chloride/acrylic acid, ethylene/vinyldiene chloride/acrylic acid, ethylene/vinyl fluoride/methacrylic acid, and ethylene/chlorotrifluoroethylene/methacrylic acid, or any metallocene-catalyzed polymers of the above-listed species.

Another family of thermoplastic elastomers for use in the golf balls are polymers of i) ethylene and/or an alpha olefin; and ii) an α, β-ethylenically unsaturated $C_3$-$C_{20}$ carboxylic acid or anhydride, or an α, β-ethylenically unsaturated $C_3$-$C_{20}$ sulfonic acid or anhydride or an α, β-ethylenically unsaturated $C_3$-$C_{20}$ phosphoric acid or anhydride and, optionally iii) a $C_1$-$C_{10}$ ester of an α, β-ethylenically unsaturated $C_3$-$C_{20}$ carboxylic acid or a $C_1$-$C_{10}$ ester of an α, β-ethylenically unsaturated $C_3$-$C_{20}$ sulfonic acid or a $C_1$-$C_{10}$ ester of an α, β-ethylenically unsaturated $C_3$-$C_{20}$ phosphoric acid.

Preferably, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred. Preferably, the carboxylic acid ester if present may be selected from the group consisting of vinyl esters of aliphatic carboxylic acids wherein the acids have 2 to 10 carbon atoms and vinyl ethers wherein the alkyl groups contain 1 to 10 carbon atoms.

Examples of such polymers suitable for use include, but are not limited to, an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, and the like.

Most preferred are ethylene/(meth)acrylic acid copolymers and ethylene/(meth)acrylic acid/alkyl (meth)acrylate terpolymers, or ethylene and/or propylene maleic anhydride copolymers and terpolymers.

The acid content of the polymer may contain anywhere from 1 to 30 percent by weight acid. In some instances, it is preferable to utilize a high acid copolymer (i.e., a copolymer containing greater than 16% by weight acid, preferably from about 17 to about 25 weight percent acid, and more preferably about 20 weight percent acid).

Examples of such polymers which are commercially available include, but are not limited to, the Escor® 5000, 5001, 5020, 5050, 5070, 5100, 5110 and 5200 series of ethylene-acrylic acid copolymers sold by Exxon and the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Michigan.

Also included are the bimodal ethylene/carboxylic acid polymers as described in U.S. Pat. No. 6,562,906. These polymers comprise ethylene/α, β-ethylenically unsaturated $C_{3-8}$ carboxylic acid high copolymers, particularly ethylene (meth)acrylic acid copolymers and ethylene, alkyl (meth) acrylate, (meth)acrylic acid terpolymers, having molecular weights of about 80,000 to about 500,000 which are melt blended with ethylene/α, β-ethylenically unsaturated $C_{3-8}$ carboxylic acid copolymers, particularly ethylene/(meth) acrylic acid copolymers having molecular weights of about 2,000 to about 30,000.

As discussed above, Component B can be any monomer, oligomer, or polymer, preferably having a lower weight percentage of anionic functional groups than that present in Component A in the weight ranges discussed above, and most preferably free of such functional groups. Examples of suitable materials for Component B include, but are not limited to, the following: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyurethane, polyarylate, polyacrylate, polyphenyl ether, modified-polyphenyl ether, high-impact polystyrene, diallyl phthalate polymer, metallocene catalyzed polymers, acrylonitrile-styrene-butadiene (ABS), styrene-acrylonitrile (SAN) (including olefin-modified SAN and acrylonitrile styrene acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-propylene copolymer, ethylene vinyl acetate, polyurea, and polysiloxane or any metallocene-catalyzed polymers of these species. Particularly suitable polymers for use as Component B include polyethylene-terephthalate, polybutyleneterephthalate, polytrimethylene-terephthalate, ethylene-carbon monoxide copolymer, polyvinyl-diene fluorides, polyphenylenesulfide, polypropyleneoxide, polyphenyloxide, polypropylene, functionalized polypropylene, polyethylene, ethylene-octene copolymer, ethylene-methyl acrylate, ethylene-butyl acrylate, polycarbonate, polysiloxane, functionalized polysiloxane, copolymeric ionomer, terpolymeric ionomer, polyetherester elastomer, polyesterester elastomer, polyetheramide elastomer, propylene-butadiene copolymer, modified copolymer of ethylene and propylene, styrenic copolymer (including styrenic block copolymer and randomly distributed styrenic copolymer, such as styrene-isobutylene copolymer and styrene-butadiene copolymer), partially or fully hydrogenated styrene-butadiene-styrene block copolymers such as styrene-(ethylene-propylene)-styrene or styrene-(ethylene-butylene)-styrene block copolymers, partially or fully hydrogenated styrene-butadiene-styrene block copolymers with functional group, polymers based on ethylene-propylene-(diene), polymers based on functionalized ethylene-propylene-diene), dynamically vulcanized polypropylene/ethylene-propylene-diene-copolymer, thermoplastic vulcanizates based on ethylene-propylene-(diene), thermoplastic polyetherurethane, thermoplastic polyesterurethane, compositions for making thermoset polyurethane, thermoset polyurethane, natural rubber, styrene-butadiene rubber, nitrile rubber, chloroprene rubber, fluorocarbon rubber, butyl rubber, acrylic rubber, silicone rubber, chlorosulfonated polyethylene, polyisobutylene, alfin rubber, polyester rubber, epichlorohydrin rubber, chlorinated isobutylene-isoprene rubber, nitrile-isobutylene rubber, 1,2-polybutadiene, 1,4-polybutadiene, cis-polyisoprene, trans-polyisoprene, and polybutylene-octene.

Preferred materials for use as Component B include polyester elastomers marketed under the name PEBAX and LOTADER marketed by ATOFINA Chemicals of Philadelphia, Pennsylvania; HYTREL, FUSABOND, and NUCREL marketed by E.I. DuPont de Nemours & Co. of Wilmington, Delaware; SKYPEL and SKYTHANE by S.K. Chemicals of Seoul, South Korea; SEPTON and HYBRAR marketed by Kuraray Company of Kurashiki, Japan; ESTHANE by Noveon; and KRATON marketed by Kraton Polymers. A most preferred material for use as Component B is SEPTON HG-252.

As stated above, Component C is a metal cation. These metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal carbonates, or metal acetates. In addition to Components A, B, and C, other materials commonly used in polymer blend compositions, can be incorporated into compositions prepared using these methods, including: crosslinking agents, co-crosslinking agents, accelerators, activators, UV-active chemicals such as UV initiators, EB-active chemicals, colorants, UV stabilizers, optical brighteners, antioxidants, processing aids, mold release agents, foaming agents, and organic, inorganic or metallic fillers or fibers, including fillers to adjust specific gravity.

Various known methods are suitable for preparation of polymer blends. For example, the three components can be premixed together in any type of suitable mixer, such as a V-blender, tumbler mixer, or blade mixer. This premix then can be melt-processed using an internal mixer, such as Banbury mixer, roll-mill or combination of these, to produce a reaction product of the anionic functional groups of Component A by Component C in the presence of Component B. Alternatively, the premix can be melt-processed using an extruder, such as single screw, co-rotating twin screw, or counter-rotating twin screw extruder, to produce the reaction product. The mixing methods discussed above can be used together to melt-mix the three components to prepare the compositions of the present invention. Also, the components can be fed into an extruder simultaneously or sequentially.

Most preferably, Components A and B are melt-mixed together without Component C, with or without the premixing discussed above, to produce a melt-mixture of the two components. Then, Component C separately is mixed into the blend of Components A and B. This mixture is melt-mixed to produce the reaction product. This two-step mixing can be performed in a single process, such as, for example, an extrusion process using a proper barrel length or screw configuration, along with a multiple feeding system. In this case, Components A and B can be fed into the extruder through a main hopper to be melted and well-mixed while flowing downstream through the extruder. Then Component C can be fed into the extruder to react with the mixture of Components A and B between the feeding port for Component C and the die head of the extruder. The final polymer composition then exits from the die. If desired, any extra steps of melt-mixing can be added to either approach of the method of the present invention to provide for improved mixing or completion of the reaction between Components A and C. Also, additional components discussed above can be incorporated either into a premix, or at any of the melt-mixing stages. Alternatively, Components A, B, and C can be melt-mixed simultaneously to form in-situ a pseudo-crosslinked structure of Component A in the presence of Component B, either as a fully or semi-interpenetrating network.

Illustrative polyamides for use in the compositions/golf balls disclosed include those obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, decamethylenediamine, 1,4-cyclohexyldiamine or m-xylylenediamine; (2) a ring-opening polymerization of cyclic lactam, such as ε-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; (4) copolymerization of a cyclic lactam with a dicarboxylic acid and a diamine; or any combination of (1)-(4). In certain examples, the dicarboxylic acid may be an aromatic dicarboxylic acid or a cycloaliphatic dicarboxylic acid. In certain examples, the diamine may be an aromatic diamine or a cycloaliphatic diamine. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The polyamide may be any homopolyamide or copolyamide. One example of a group of suitable polyamides is thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12).

One class of copolyamide elastomers are polyether amide elastomers. Illustrative examples of polyether amide elastomers are those that result from the copolycondensation of polyamide blocks having reactive chain ends with polyether blocks having reactive chain ends, including:

(1) polyamide blocks of diamine chain ends with polyoxyalkylene sequences of dicarboxylic chains;
(2) polyamide blocks of dicarboxylic chain ends with polyoxyalkylene sequences of diamine chain ends obtained by cyanoethylation and hydrogenation of polyoxyalkylene alpha-omega dihydroxylated aliphatic sequences known as polyether diols; and
(3) polyamide blocks of dicarboxylic chain ends with polyether diols, the products obtained, in this particular case, being polyetheresteramides.

More specifically, the polyamide elastomer can be prepared by polycondensation of the components (i) a diamine and a dicarboxylate, lactames or an amino dicarboxylic acid (PA component), (ii) a polyoxyalkylene glycol such as polyoxyethylene glycol, polyoxy propylene glycol (PG component) and (iii) a dicarboxylic acid.

The polyamide blocks of dicarboxylic chain ends come, for example, from the condensation of alpha-omega aminocarboxylic acids of lactam or of carboxylic diacids and diamines in the presence of a carboxylic diacid which limits the chain length. The molecular weight of the polyamide sequences is preferably between about 300 and 15,000, and more preferably between about 600 and 5,000. The molecular weight of the polyether sequences is preferably between about 100 and 6,000, and more preferably between about 200 and 3,000.

The amide block polyethers may also comprise randomly distributed units. These polymers may be prepared by the simultaneous reaction of polyether and precursor of polyamide blocks. For example, the polyether diol may react with a lactam (or alpha-omega amino acid) and a diacid which limits the chain in the presence of water. A polymer is obtained that has primarily polyether blocks and/or polyamide blocks of very variable length, but also the various reactive groups that have reacted in a random manner and which are distributed statistically along the polymer chain.

Suitable amide block polyethers include those as disclosed in U.S. Pat. Nos. 4,331,786; 4,115,475; 4,195,015; 4,839,441; 4,864,014; 4,230,848 and 4,332,920.

The polyether may be, for example, a polyethylene glycol (PEG), a polypropylene glycol (PPG), or a polytetramethylene glycol (PTMG), also designated as polytetrahydrofurane (PTHF). The polyether blocks may be along the polymer chain in the form of diols or diamines. However, for reasons of simplification, they are designated PEG blocks, or PPG blocks, or also PTMG blocks.

The polyether block comprises different units such as units which derive from ethylene glycol, propylene glycol, or tetramethylene glycol.

The amide block polyether comprises at least one type of polyamide block and one type of polyether block. Mixing of two or more polymers with polyamide blocks and polyether blocks may also be used. The amide block polyether also can comprise any amide structure made from the method described on the above.

Preferably, the amide block polyether is such that it represents the major component in weight, i.e., that the amount of polyamide which is under the block configuration and that which is eventually distributed statistically in the chain represents 50 weight percent or more of the amide block polyether. Advantageously, the amount of polyamide and the amount of polyether is in a ratio (polyamide/polyether) of 1/1 to 3/1.

One type of polyetherester elastomer is the family of Pebax, which are available from Elf-Atochem Company. Preferably, the choice can be made from among Pebax 2533, 3533, 4033, 1205, 7033 and 7233. Blends or combinations of Pebax 2533, 3533, 4033, 1205, 7033 and 7233 can also be prepared, as well. Pebax 2533 has a hardness of about 25 shore D (according to ASTM D-2240), a Flexural Modulus of 2.1 kpsi (according to ASTM D-790), and a Bayshore resilience of about 62% (according to ASTM D-2632). Pebax 3533 has a hardness of about 35 shore D (according to ASTM D-2240), a Flexural Modulus of 2.8 kpsi (according to ASTM D-790), and a Bayshore resilience of about 59% (according to ASTM D-2632). Pebax 7033 has a hardness of about 69 shore D (according to ASTM D-2240) and a Flexural Modulus of 67 kpsi (according to ASTM D-790). Pebax 7333 has a hardness of about 72 shore D (according to ASTM D-2240) and a Flexural Modulus of 107 kpsi (according to ASTM D-790).

Some examples of suitable polyamides for use include those commercially available under the tradenames PEBAX, CRISTAMID and RILSAN marketed by Atofina Chemicals of Philadelphia, Pennsylvania, GRIVORY and GRILAMID marketed by EMS Chemie of Sumter, South Carolina, TROGAMID and VESTAMID available from Degussa, and ZYTEL marketed by E.I. DuPont de Nemours & Co., of Wilmington, Delaware.

The layer or core compositions can also incorporate one or more fillers. Such fillers are typically in a finely divided form, for example, in a size generally less than about 20 mesh, preferably less than about 100 mesh U.S. standard size, except for fibers and flock, which are generally elongated. Flock and fiber sizes should be small enough to facilitate processing. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten steel copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred embodiment the filler comprises a continuous or non-continuous fiber. In another preferred embodiment the filler comprises one or more so called nanofillers, as described in U.S. Pat. No. 6,794,447 and U.S. Patent Publication No. 2004-0092336A1 published May 13, 2004 and U.S. Patent Publication No. 2005-0059756A1 published Mar. 17, 2005, the entire contents of each of which are herein incorporated by reference.

Inorganic nanofiller material generally is made of clay, such as hydrotalcite, phyllosilicate, saponite, hectorite, beidellite, stevensite, vermiculite, halloysite, mica, montmorillonite, micafluoride, or octosilicate. To facilitate incorporation of the nanofiller material into a polymer material, either in preparing nanocomposite materials or in preparing polymer-based golf ball compositions, the clay particles generally are coated or treated by a suitable compatibilizing agent. The compatibilizing agent allows for superior linkage between the inorganic and organic material, and it also can account for the hydrophilic nature of the inorganic nanofiller material and the possibly hydrophobic nature of the polymer. Compatibilizing agents may exhibit a variety of different structures depending upon the nature of both the inorganic nanofiller material and the target matrix polymer. Non-limiting examples include hydroxy-, thiol-, amino-, epoxy-, carboxylic acid-, ester-, amide-, and siloxy-group containing compounds, oligomers or polymers. The nanofiller materials can be incorporated into the polymer either by dispersion into the particular monomer or oligomer prior to polymerization, or by melt compounding of the particles into the matrix polymer. Examples of commercial nanofillers are various Cloisite grades including 10A, 15A, 20A, 25A, 30B, and NA+ of Southern Clay Products (Gonzales, Texas) and the Nanomer grades including 1.24TL and C.30EVA of Nanocor, Inc. (Arlington Heights, Illinois).

As mentioned above, the nanofiller particles have an aggregate structure with the aggregates particle sizes in the micron range and above. However, these aggregates have a stacked plate structure with the individual platelets being roughly 1 nanometer (nm) thick and 100 to 1000 nm across. As a result, nanofillers have extremely high surface area, resulting in high reinforcement efficiency to the material at low loading levels of the particles. The sub-micron-sized particles enhance the stiffness of the material, without increasing its weight or opacity and without reducing the material's low-temperature toughness.

Nanofillers when added into a matrix polymer, can be mixed in three ways. In one type of mixing there is dispersion of the aggregate structures within the matrix polymer, but on mixing no interaction of the matrix polymer with the aggregate platelet structure occurs, and thus the stacked platelet structure is essentially maintained. As used herein, this type of mixing is defined as "undispersed".

However, if the nanofiller material is selected correctly, the matrix polymer chains can penetrate into the aggregates and separate the platelets, and thus when viewed by transmission electron microscopy or x-ray diffraction, the aggregates of platelets are expanded. At this point the nanofiller is said to be substantially evenly dispersed within and reacted into the structure of the matrix polymer. This level of expansion can occur to differing degrees. If small amounts of the matrix polymer are layered between the individual platelets then, as used herein, this type of mixing is known as "intercalation".

In some cases, further penetration of the matrix polymer chains into the aggregate structure separates the platelets, and leads to a complete breaking up of the platelet's stacked structure in the aggregate and thus when viewed by transmission electron microscopy (TEM), the individual platelets are thoroughly mixed throughout the matrix polymer. As used herein, this type of mixing is known as "exfoliated". An exfoliated nanofiller has the platelets fully dispersed throughout the polymer matrix; the platelets may be dispersed unevenly but preferably are dispersed evenly.

While not wishing to be limited to any theory, one possible explanation of the differing degrees of dispersion of such nanofillers within the matrix polymer structure is the effect of the compatibilizer surface coating on the interaction between the nanofiller platelet structure and the matrix polymer. By careful selection of the nanofiller it is possible to vary the penetration of the matrix polymer into the platelet structure of the nanofiller on mixing. Thus, the degree of interaction and intrusion of the polymer matrix into the nanofiller controls the separation and dispersion of the individual platelets of the nanofiller within the polymer matrix. This interaction of the polymer matrix and the platelet structure of the nanofiller is defined herein as the nanofiller "reacting into the structure of the polymer" and the subsequent dispersion of the platelets within the polymer matrix is defined herein as the nanofiller "being substantially evenly dispersed" within the structure of the polymer matrix.

If no compatibilizer is present on the surface of a filler such as a clay, or if the coating of the clay is attempted after its addition to the polymer matrix, then the penetration of the matrix polymer into the nanofiller is much less efficient, very little separation and no dispersion of the individual clay platelets occurs within the matrix polymer.

As used herein, a "nanocomposite" is defined as a polymer matrix having nanofiller intercalated or exfoliated within the matrix. Physical properties of the polymer will change with the addition of nanofiller and the physical properties of the polymer are expected to improve even more as the nanofiller is dispersed into the polymer matrix to form a nanocomposite.

Materials incorporating nanofiller materials can provide these property improvements at much lower densities than those incorporating conventional fillers. For example, a nylon-6 nanocomposite material manufactured by RTP Corporation of Wichita, Kansas uses a 3% to 5% clay loading and has a tensile strength of 11,800 psi and a specific gravity of 1.14, while a conventional 30% mineral-filled material has a tensile strength of 8,000 psi and a specific gravity of 1.36. Because use of nanocomposite materials with lower loadings of inorganic materials than conventional fillers provides the same properties, this use allows products to be lighter than those with conventional fillers, while maintaining those same properties.

Nanocomposite materials are materials incorporating from about 0.1% to about 20%, preferably from about 0.1% to about 15%, and most preferably from about 0.1% to about 10% of nanofiller reacted into and substantially dispersed through intercalation or exfoliation into the structure of an organic material, such as a polymer, to provide strength, temperature resistance, and other property improvements to the resulting composite. Descriptions of particular nanocomposite materials and their manufacture can be found in U.S. Pat. No. 5,962,553 to Ellsworth, U.S. Pat. No. 5,385,776 to Maxfield et al., and U.S. Pat. No. 4,894,411 to Okada et al. Examples of nanocomposite materials currently marketed include M1030D, manufactured by Unitika Limited, of Osaka, Japan, and 1015C2, manufactured by UBE America of New York, New York.

When nanocomposites are blended with other polymer systems, the nanocomposite may be considered a type of nanofiller concentrate. However, a nanofiller concentrate may be more generally a polymer into which nanofiller is mixed; a nanofiller concentrate does not require that the nanofiller has reacted and/or dispersed evenly into the carrier polymer.

Preferably the nanofiller material is added to the polymeric composition in an amount of from about 0.1% to about 20%, preferably from about 0.1% to about 15%, and most preferably from about 0.1% to about 10% by weight of nanofiller reacted into and substantially dispersed through intercalation or exfoliation into the structure of the polymeric composition.

If desired, the various polymer compositions used to prepare the golf balls can additionally contain other additives such as plasticizers, pigments, antioxidants, U.V, absorbers, optical brighteners, or any other additives generally employed in plastics formulation or the preparation of golf balls.

Another particularly well-suited additive for use in the presently disclosed compositions includes compounds having the general formula:

$$(R_2N)_m—R'—(X(O)_nOR_y)_m,$$

where R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1-3. These materials are more fully described in U.S. Provisional Patent Application No. 60/588,603, filed on Jul. 16, 2004, the entire contents of which are herein incorporated by reference. These materials include caprolactam, oenantholactam, decanolactam, undecanolactam, dodecanolactam, caproic 6-amino acid, 11-aminoundecanoicacid, 12-aminododecanoic acid, diamine hexamethylene salts of adipic acid, azeleic acid, sebacic acid and 1,12-dodecanoic acid and the diamine nonamethylene salt of adipic acid., 2-aminocinnamic acid, L-aspartic acid, 5-aminosalicylic acid, aminobutyric acid; aminocaproic acid; aminocapyryic acid; 1-(aminocarbonyl)-1-cyclopropanecarboxylic acid; aminocephalosporanic acid; aminobenzoic acid; aminochlorobenzoic acid; 2-(3-amino-4-chlorobenzoyl) benzoic acid; aminonaphtoic acid; aminonicotinic acid; aminonorbornanecarboxylic acid; aminoorotic acid; aminopenicillanic acid; aminopentenoic acid; (aminophenyl) butyric acid; aminophenyl propionic acid; aminophthalic acid; aminofolic acid; aminopyrazine carboxylic acid; aminopyrazole carboxylic acid; aminosalicylic acid; aminoterephthalic acid; aminovaleric acid; ammonium hydrogencitrate; anthranillic acid; aminobenzophenone carboxylic acid; aminosuccinamic acid, epsilon-caprolactam; omega-caprolactam, (carbamoylphenoxy) acetic acid, sodium salt; carbobenzyloxy aspartic acid; carbobenzyl glutamine; carbobenzyloxyglycine; 2-aminoethyl hydrogensulfate; aminonaphthalenesulfonic acid; aminotoluene sulfonic acid; 4,4'-methylene-bis-(cyclohexylamine) carbamate and ammonium carbamate.

Most preferably the material is selected from the group consisting of 4,4'-methylene-bis-(cyclohexylamine) carbamate (commercially available from R.T. Vanderbilt Co., Norwalk, Connecticut under the tradename Diak® 4), 11-aminoundecanoicacid, 12-aminododecanoic acid, epsilon-caprolactam; omega-caprolactam, and any and all combinations thereof.

In an especially preferred embodiment, a nanofiller additive component in the golf ball is surface modified with a compatibilizing agent comprising the earlier described compounds having the general formula:

$$(R_2N)_m—R'—(X(O)_nOR_y)_m,$$

A most preferred embodiment would be a filler comprising a nanofiller clay material surface modified with an amino acid including 12-aminododecanoic acid. Such fillers are available from Nanonocor Co. under the tradename Nanomer 1.24TL.

Prior to its use in golf balls, the core and/or layer compositions may be further formulated with one or more of the following blend components:

Any crosslinking or curing system typically used for crosslinking may be used to crosslink the polymer(s), if desired. Satisfactory crosslinking systems are based on sulfur-, peroxide-, azide-, maleimide- or resin-vulcanization agents, which may be used in conjunction with a vulcanization accelerator. Examples of satisfactory crosslinking system components are zinc oxide, sulfur, organic peroxide, azo compounds, magnesium oxide, benzothiazole sulfenamide accelerator, benzothiazyl disulfide, phenolic curing resin, m-phenylene bis-maleimide, thiuram disulfide and dipentamethylene-thiuram hexasulfide.

More preferable cross-linking agents include peroxides, sulfur compounds, as well as mixtures of these. Non-limiting examples of suitable cross-linking agents include primary, secondary, or tertiary aliphatic or aromatic organic peroxides. Peroxides containing more than one peroxy group can be used, such as 2,5-dimethyl-2,5-di (tert-butylperoxy) hexane and 1,4-di-(2-tert-butyl peroxyisopropyl) benzene. Both symmetrical and asymmetrical peroxides can be used, for example, tert-butyl perbenzoate and tert-butyl cumyl peroxide. Peroxides incorporating carboxyl groups also are suitable. The decomposition of peroxides used as cross-linking agents in the disclosed compositions can be brought about by applying thermal energy, shear, irradiation (e.g., ultra violet-active agents or electron beam-active agents), reaction with other chemicals, or any combination of these. Both homolytically and heterolytically decomposed peroxide can be used. Non-limiting examples of suitable peroxides include: diacetyl peroxide; di-tert-butyl peroxide; dibenzoyl peroxide; dicumyl peroxide; 2,5-dimethyl-2,5-di (benzoylperoxy) hexane; 1,4-bis-(t-butylperoxyisopropyl) benzene; t-butylperoxybenzoate; 2,5-dimethyl-2,5-di-(t-butylperoxy) hexyne-3, such as Trigonox 145-45B, marketed by Akrochem Corp. of Akron, Ohio; 1,1-bis (t-butylperoxy)-3,3,5 tri-methylcyclohexane, such as Varox 231-XL, marketed by R.T. Vanderbilt Co., Inc. of Norwalk, Connecticut; and di-(2,4-dichlorobenzoyl) peroxide.

The cross-linking agents can be blended in total amounts of about 0.01 part to about 5 parts, more preferably about 0.05 part to about 4 parts, and most preferably about 0.1 part to about 2 parts, by weight of the cross-linking agents per 100 parts by weight of the polymer-containing composition.

In a further embodiment, the cross-linking agents can be blended in total amounts of about 0.05 part to about 5 parts, more preferably about 0.2 part to about 3 parts, and most preferably about 0.2 part to about 2 parts, by weight of the cross-linking agents per 100 parts by weight of the polymer-containing composition.

Each peroxide cross-linking agent has a characteristic decomposition temperature at which 50% of the cross-linking agent has decomposed when subjected to that temperature for a specified time period ($t_{1/2}$). For example, 1,1-bis-(t-butylperoxy)-3,3,5-tri-methylcyclohexane at $t_{1/2}$=0.1 hour has a decomposition temperature of 138° C. and 2,5-dimethyl-2,5-di-(t-butylperoxy) hexyne-3 at $t_{1/2}$=0.1 hour has a decomposition temperature of 182° C. Two or more cross-linking agents having different characteristic decomposition temperatures at the same tin may be blended in the composition. For example, where at least one cross-linking agent has a first characteristic decomposition temperature less than 150° C., and at least one cross-linking agent has a second characteristic decomposition temperature greater than 150° C., the composition weight ratio of the at least one cross-linking agent having the first characteristic decomposition temperature to the at least one cross-linking agent having the second characteristic decomposition temperature can range from 5:95 to 95:5, or more preferably from 10:90 to 50:50.

Besides the use of chemical cross-linking agents, exposure of the polymer-containing composition to radiation also can serve as a cross-linking agent. Radiation can be applied to the polymer-containing composition by any known method, including using microwave or gamma radiation, or an electron beam device. Additives may also be used to improve radiation-induced crosslinking of the polymer-containing composition.

The polymer containing-composition may also be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The unsaturated carboxylic acid metal salt can be blended in the polymer-containing composition either as a preformed metal salt, or by introducing an α,β-unsaturated carboxylic acid and a metal oxide or hydroxide into the polymer-containing composition, and allowing them to react to form the metal salt. The unsaturated carboxylic acid metal salt can be blended in any desired amount, but preferably in amounts of about 1 part to about 100 parts by weight of the unsaturated carboxylic acid per 100 parts by weight of the polymer-containing composition.

The polymer-containing composition may also incorporate one or more of the so-called "peptizers".

The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di (pentachlorophenyl) disulfide; dibenzamido diphenyldisulfide (DBDD), and alkylated phenol sulfides, such as VULTAC marketed by Atofina Chemicals, Inc. of Philadelphia, Pennsylvania. Preferred organic sulfur compounds include pentachlorothiophenol, and dibenzamido diphenyldisulfide.

Examples of the metal salt of an organic sulfur compound include sodium, potassium, lithium, magnesium calcium, barium, cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers.

Suitable peptizers also may include one or more additional functional groups, such as halogens, particularly chlorine; a sulfur-containing moiety exemplified by thiols, where the functional group is sulfhydryl (—SH), thioethers, where the functional group is —SR, disulfides, ($R_1S$—$SR_2$), etc.; and combinations of functional groups. Such peptizers are more fully disclosed in U.S. Application No. 60/752,475 filed on Dec. 20, 2005 in the name of Hyun Kim et al, the entire contents of which are herein incorporated by reference. A most preferred example is a pyridine peptizer that also includes a chlorine functional group and a thiol functional group such as 2,3,5,6-tetrachloro-4-pyridinethiol (TCPT).

The peptizer, if employed in the golf balls, is present in an amount of from about 0.01 to about 10, preferably of from about 0.05 to about 7, more preferably of from about 0.1 to about 5 parts by weight per 100 parts by weight of the polymer-containing composition.

The polymer-containing composition can also comprise one or more accelerators of one or more classes. Accelerators are added to an unsaturated polymer to increase the vulcanization rate and/or decrease the vulcanization temperature. Accelerators can be of any class known for rubber processing including mercapto-, sulfenamide-, thiuram, dithiocarbamate, dithiocarbamyl-sulfenamide, xanthate, guanidine, amine, thiourea, and dithiophosphate accelerators. Specific commercial accelerators include 2-mercaptobenzothiazole and its metal or non-metal salts, such as Vulkacit Mercapto C, Mercapto MGC, Mercapto ZM-5, and ZM marketed by Bayer AG of Leverkusen, Germany, Nocceler M, Nocceler MZ, and Nocceler M-60 marketed by Ouchisinko Chemical Industrial Company, Ltd. of Tokyo, Japan, and MBT and ZMBT marketed by Akrochem Corporation of Akron, Ohio. A more complete list of commercially available accelerators is given in *The Vanderbilt Rubber Handbook:* 13$^{th}$ Edition (1990, R.T. Vanderbilt Co.), pp. 296-330, in *Encyclopedia of Polymer Science and Technology*, Vol. 12 (1970, John Wiley & Sons), pp. 258-259, and in *Rubber Technology Handbook* (1980, Hanser/Gardner Publications), pp. 234-236. Preferred accelerators include 2-mercaptobenzothiazole (MBT) and its salts.

The polymer-containing composition can further incorporate from about 0.01 part to about 10 parts by weight of the accelerator per 100 parts by weight of the polymer-containing composition. More preferably, the ball composition can further incorporate from about 0.02 part to about 5 parts, and most preferably from about 0.03 part to about 1.5 parts, by weight of the accelerator per 100 parts by weight of the polymer.

The core may be made from any of the polymers described above. In certain embodiments, the core is made from polybutadiene. In particular examples, the polybutadiene is the "major ingredient" of the core meaning that the polybutadiene constitutes at least 50, more particularly 60, most particularly 80, wt %, of all the ingredients in the core. In further embodiments, polybutadiene is the only polymer present in the core.

The mantle layer may be made from any suitable material, particularly those materials described herein. In certain examples, the mantle layers may include a unimodal ionomer; a bimodal ionomer; a modified unimodal ionomer; a modified bimodal ionomer; a thermoset polyurethane; a polyester elastomer; a copolymer comprising at least one first co-monomer selected from butadiene, isoprene, ethylene or butylene and at least one second co-monomer selected from a (meth)acrylate or a vinyl arylene; a polyalkenamer; or any and all combinations or mixtures thereof. The above-listed mantle layer material(s) may be the "major ingredient" of the mantle layer meaning that the material(s) constitutes at least 50, more particularly 60, most particularly 80, wt %, of all the ingredients in the mantle layer. In further embodiments, the above-listed mantle layer material(s) is the only polymer(s) present in the mantle layer(s).

The cover layer of the balls may have a thickness of about 0.01 to about 0.10, preferably from about 0.02 to about 0.08, more preferably from about 0.03 to about 0.06 inch.

The cover layer of the balls may have a hardness Shore D from about 40 to about 70, preferably from about 45 to about 70 or about 50 to about 70, more preferably from 47 to about 68 or about 45 to about 70, and most preferably from about 50 to about 65.

The cover layer may be made from any suitable material, particularly those disclosed herein. In preferred embodiments, illustrative examples include a thermoplastic elastomer, a thermoset polyurethane, a thermoplastic polyurethane, a unimodal ionomer, a bimodal ionomer, a modified unimodal ionomer, a modified bimodal ionomer; or any and all combinations or mixtures thereof. The above-listed cover layer material(s) may be the "major ingredient" of the cover layer meaning that the material(s) constitutes at least 50, more particularly 60, most particularly 80, wt %, of all the ingredients in the cover layer. In further embodiments, the above-listed cover layer material(s) is the only polymer(s) present in the cover layer(s).

A coating layer may be disposed on, or adjacent to, the outer cover layer. For example, the coating layer may be a thermoplastic resin-based paint and/or a thermosetting resin-based paint. Examples of such paints include vinyl acetate resin paints, vinyl acetate copolymer resin paints, EVA (ethylene-vinyl acetate copolymer resin) paints, acrylic ester (co) polymer resin paints, epoxy resin paints, thermosetting urethane resin paints, thermoplastic urethane resin paints, thermosetting acrylic resin paints, and unsaturated polyester resin paints. The coating layer may be transparent, semi-transparent, translucent, or matte.

Illustrative golf ball materials and constructions are described, for example, in U.S. Pat. Nos. 8,357,060, 8,715,113, and 9,421,425, all of which are incorporated herein by reference.

In view of the many possible embodiments to which the principles of the disclosed articles and methods may be applied, it should be recognized that the illustrated embodiments are only preferred examples of the invention and should not be taken as limiting the scope of the invention.

What is claimed is:

1. A golf ball comprising an outer surface having dimples located on the outer surface;

at least one core;

a ball center;

an equator plane that passes through the ball center;

at least one design element plane that is offset by a first distance from the equator plane that passes through the ball center;

at least one cover layer having an outer surface;

a base color located on the outer surface; and a plurality of images located on the outer surface, the plurality of images being provided with at least a first contrasting color, that is not the base color, and at least a second contrasting color, the first contrasting color and the second contrasting color have an absolute value difference between CIELab L values of between 5 to 70, an absolute value difference between CIELab "a" values of between 3 and 50, and an absolute value difference between CIELab "b" values of between 5 and 90;

the first contrasting color having an absolute value difference in CIELab L value, relative to the base color of the ball, of between 30 and 90 is provided; and wherein at least 5% of the plurality of images have a border design element that is a contrasting alignment feature aligned on the first design element plane, wherein the border design element includes a triangle-shaped element and a quadrilateral-shaped element.

2. The golf ball of claim 1, wherein at least 20% of the plurality of images have the first contrasting alignment feature.

3. The golf ball of claim 1, wherein at least two images of the plurality of images have a border design element that is a contrasting alignment feature aligned on the first design element plane, wherein the border design element includes a triangle-shaped element and a quadrilateral-shaped element.

4. The golf ball of claim 3, wherein at least three images of the plurality of images have a border design element that is a contrasting alignment feature aligned on the first design element plane, wherein the border design element includes a triangle-shaped element and a quadrilateral-shaped element.

5. The golf ball of claim 3, further comprising a second design element plane, wherein at least two images of the plurality of images have a border design element that is a contrasting alignment feature aligned on the second design element plane, wherein the border design element includes a triangle-shaped element and a quadrilateral-shaped element.

6. A golf ball comprising an outer surface having dimples located on the outer surface;

at least one core;

at least one cover layer having an outer surface;

a ball center;

an equator plane that passes through the ball center;

at least one design element plane that is offset by a first distance from the equator plane that passes through the ball center;

a base color located on the outer surface; and a plurality of images located on the outer surface, the plurality of images being provided with a first contrasting color and a second contrasting color, the first contrasting color and the second contrasting color have a $\Delta E^*ab$ value relative to the base color of the ball that is between 40 and 100; and wherein at least 5% of the plurality of images have a border design element that is a first contrasting alignment feature intersected by the first design element plane, wherein the border design element includes a triangle-shaped element and a quadrilateral-shaped element.

7. The golf ball of claim 6, wherein at least 20% of the plurality of images have the first contrasting alignment feature.

8. The golf ball of claim 6, wherein at least two images of the plurality of images have a border design element that is a contrasting alignment feature aligned on the first design element plane, wherein the border design element includes a triangle-shaped element and a quadrilateral-shaped element.

9. The golf ball of claim 8, wherein at least three images of the plurality of images have a border design element that is a contrasting alignment feature aligned on the first design element plane, wherein the border design element includes a triangle-shaped element and a quadrilateral-shaped element.

10. The golf ball of claim 8, further comprising a second design element plane, wherein at least two images of the plurality of images have a border design element that is a contrasting alignment feature aligned on the second design element plane, wherein the border design element includes a triangle-shaped element and a quadrilateral-shaped element.

11. The golf ball of claim 10, wherein the first design element plane and the second design element plane are parallel with the equator plane.

* * * * *